US008074471B2

(12) United States Patent
Hasegawa et al.

(10) Patent No.: US 8,074,471 B2
(45) Date of Patent: Dec. 13, 2011

(54) REFRIGERATION CYCLE APPARATUS AND FLUID MACHINE USED FOR THE SAME

(75) Inventors: Hiroshi Hasegawa, Osaka (JP); Masaru Matsui, Kyoto (JP); Takeshi Ogata, Osaka (JP); Fumitoshi Nishiwaki, Hyogo (JP); Hidetoshi Taguchi, Osaka (JP); Fuminori Sakima, Osaka (JP); Masanobu Wada, Kadoma (JP)

(73) Assignee: Panasonic Corporation, Osaka (JP)

( * ) Notice: Subject to any disclaimer, the term of this patent is extended or adjusted under 35 U.S.C. 154(b) by 503 days.

(21) Appl. No.: 12/438,438

(22) PCT Filed: Oct. 17, 2007

(86) PCT No.: PCT/JP2007/070268

§ 371 (c)(1),
(2), (4) Date: Feb. 23, 2009

(87) PCT Pub. No.: WO2008/050654

PCT Pub. Date: May 2, 2008

(65) Prior Publication Data

US 2010/0251757 A1 Oct. 7, 2010

(30) Foreign Application Priority Data

Oct. 25, 2006 (JP) ..... 2006-289817
Mar. 2, 2007 (JP) ..... 2007-052458

(51) Int. Cl.

| | |
|---|---|
| ***F25B 1/00*** | (2006.01) |
| ***F01C 1/30*** | (2006.01) |
| ***F01C 1/02*** | (2006.01) |
| ***F01C 1/063*** | (2006.01) |
| ***F03C 2/00*** | (2006.01) |

(52) U.S. Cl. ..... 62/498; 418/3; 418/55.1; 418/55.3; 418/64

(58) Field of Classification Search ..... 62/468, 62/498; 418/3, 13, 62, 64, 55.1, 55.3
See application file for complete search history.

(56) References Cited

U.S. PATENT DOCUMENTS

| | | | |
|---|---|---|---|
| 5,522,235 | A | 6/1996 | Matsuoka et al. |
| 6,321,564 | B1 | 11/2001 | Yamanaka et al. |
| 2004/0003622 | A1 | 1/2004 | Negishi |
| 2007/0053782 | A1 | 3/2007 | Okamoto et al. |

FOREIGN PATENT DOCUMENTS

| | | | |
|---|---|---|---|
| JP | 57-108555 | A | 7/1982 |
| JP | 59-015769 | A | 1/1984 |
| JP | 62-077562 | | 4/1987 |
| JP | 4-143491 | S | 5/1992 |
| JP | 6-193574 | A | 7/1994 |
| JP | 2000-329416 | A | 11/2000 |
| JP | 2003-172244 | | 6/2003 |
| JP | 2003-307358 | A | 10/2003 |

(Continued)

*Primary Examiner* — Chen Wen Jiang
(74) *Attorney, Agent, or Firm* — Hamre, Schumann, Mueller & Larson, P.C.

(57) ABSTRACT

A refrigeration cycle apparatus 1 includes a refrigerant circuit in which a refrigerant circulates. The refrigerant circuit is formed by connecting in sequence a compressor 2 for compressing the refrigerant, a radiator 3 for allowing the refrigerant compressed by compressor 2 to radiate heat, a fluid pressure motor 4 as a power recovery means, and an evaporator 5 for allowing the refrigerant discharged by the fluid pressure motor 4 to evaporate. The fluid pressure motor 4 performs a process for drawing the refrigerant and a process for discharging the refrigerant. These processes are performed substantially continuously.

33 Claims, 31 Drawing Sheets

FOREIGN PATENT DOCUMENTS

| | | | |
|---|---|---|---|
| JP | 2003-343935 | | 12/2003 |
| JP | 2004-044569 | A | 2/2004 |
| JP | 2005-106046 | A | 4/2005 |
| JP | 2005-172336 | | 6/2005 |
| JP | 2006-266171 | A | 10/2006 |

REFRIGERATION CYCLE APPARATUS AND FLUID MACHINE USED FOR THE SAME

TECHNICAL FIELD

The present invention relates to a refrigeration cycle apparatus and a fluid machine used for the refrigeration cycle apparatus.

BACKGROUND ART

Generally, a refrigerant circuit of a refrigeration cycle apparatuses has a structure in which a compressor for compressing a refrigerant, a gas cooler for cooling the refrigerant, an expansion valve for expanding the refrigerant and an evaporator for heating the refrigerant are connected in this order. In the refrigeration cycle of such a refrigerant circuit, the refrigerant undergoes a pressure drop from high pressure to low pressure at the expansion valve while being expanded, and an internal energy is released at that time. The internal energy to be released increases as a pressure difference between a low pressure side (evaporator side) and a high pressure side (gas cooler side) of the refrigerant circuit increases, lowering the energy efficiency of the refrigeration cycle.

In view of such a problem, a variety of techniques have been proposed for recovering the internal energy of the refrigerant released at an expander. JP 2004-44569 A, for example, proposes a technique for recovering energy by coupling a rotating shaft of a rotary type expander to a rotating shaft of a motor for driving a compressor.

FIG. 26 is a configuration diagram of a conventional refrigeration cycle apparatus 501 that recovers energy by coupling a shaft 507 of an expander 504 to a rotating shaft of a motor 506 for driving a compressor 502.

As shown in FIG. 26, the refrigeration cycle apparatus 501 includes a refrigerant circuit in which a gas cooler 503, the expander 504, an evaporator 505, and the compressor 502 are connected in this order. The expander 504 is a rotary type or scroll type expander having a shaft 507 as a rotating shaft. The shaft 507 is coupled to the motor 506 driving the compressor 502. Rotation energy (mechanical power) of the shaft 507 is transferred to the rotating shaft of the motor 506. Thus, a part of the internal energy released when the refrigerant undergoes a pressure drop from high pressure to low pressure at the expander 504 while being expanded is converted into the rotation energy of the shaft 507, transferred to the motor 506, and then is utilized as a part of mechanical power for driving the compressor 502. Accordingly, the refrigeration cycle apparatus 501 can realize high energy efficiency.

JP 57 (1982)-108555 A discloses a technique for recovering energy from a refrigerant using a medium-driven motor having no specific volumetric capacity ratio (an expansion ratio). FIG. 30 is a diagram showing the structure and operation principle of the medium-driven motor disclosed in JP 57 (1982)-108555A. A medium-driven motor 700 includes a cylinder 701, a rotor 702 (a piston) that rotates in the cylinder 701, and a vane 705 that divides a working chamber formed between the cylinder 701 and the rotor 702 into a suction side working chamber 706*a* and a discharge side working chamber 706*b*. The cylinder 701 has a suction port 703 so that a refrigerant can be drawn into the suction side working chamber 706*a*, and a discharge port 704 so that the refrigerant can be discharged from the discharge side working chamber 706*b*. Neither the suction port 703 nor the discharge port 704 has a valve, but the shape of the rotor 702 is determined to prevent the refrigerant from flowing from the suction port 703 to the discharge port 704 directly. Specifically, a part of an outer peripheral face of the rotor 702 has the same curvature radius as that of an inner peripheral face of the cylinder 701.

JP 2006-266171 A also discloses a technique for recovering mechanical power from a refrigerant. JP 2006-266171 A proposes a technique for recovering mechanical power by coupling a rotating shaft of a sub compressor provided on a suction side of a compressor to a rotating shaft of a rotary type expander.

FIG. 27 is a configuration diagram of a power-recovery-type refrigeration cycle apparatus 601 using an expander-compressor unit 608, described in JP 2006-266171 A. As shown in FIG. 27, the refrigeration cycle apparatus 601 includes a refrigerant circuit in which a sub compressor 602, a main compressor 603, a gas cooler 604, an expander 605, and an evaporator 606 are connected in this order.

FIG. 28 is a cross-sectional view of the expander-compressor unit 608. As shown in FIG. 28 and FIG. 27, the expander-compressor unit 608 is composed of the sub compressor 602 and the expander 605 sharing a rotating shaft 607. Thus, energy recovered by the expander 605 is supplied to the sub compressor 602 via the rotating shaft 607, and is utilized as a driving force for the sub compressor 602. Accordingly, the refrigeration cycle apparatus 601 shown in FIG. 27 can realize high energy efficiency.

FIG. 29 is a cross-sectional view of the expander 605. As shown in FIG. 29, the expander 605 is a swing type expander in which a piston 611*a* and a vane 611*b* are formed integrally. A shoe 612 is attached to the vane 611*b*. The shoe 612 has a narrow refrigerant passage 613 that communicates with a working chamber 614. In the expander 605, the vane 611*b* reciprocates, and the shoe 612 swings. The refrigerant passage 613 is opened and closed corresponding to the reciprocating motion of the vane 611*b* and the swinging motion of the shoe 612, and thereby timing for drawing the refrigerant is controlled.

The expanders disclosed in JP 2004-44569 A and JP 2006-266171 A each have a specific volumetric capacity ratio (a ratio of a discharge volume to a suction volume). Thus, in the expanders disclosed in JP 2004-44569 A and JP 2006-26617 A, a discharge pressure is determined automatically from a suction pressure and the volumetric capacity ratio of each of the expanders. However, the high pressure and low pressure of the refrigeration cycle vary, respectively, depending on its operating conditions. Accordingly, the discharge pressure of the expander (the pressure of the refrigerant being discharged from the expander) does not agree with the low pressure of the refrigeration cycle in some cases. For example, there arises a problem that overexpansion loss occurs when the discharge pressure of the expander becomes lower than the low pressure of the refrigeration cycle, lowering the efficiency in recovering the internal energy of the refrigerant at the expander.

That is, use of the expanders disclosed in the aforementioned documents makes it difficult to recover efficiently the internal energy of the refrigerant.

Moreover, the expander 605 shown in FIG. 28 and FIG. 29 has a complicated configuration, and is disadvantageous in terms of cost and productivity. In the expander 605, the narrow refrigerant passage 613 needs to be formed in the shoe 612 that swings. Thus, use of the expander 605 complicates the configuration of the refrigeration cycle apparatus, and tends to cause increased cost and reduced productivity.

Since the medium-driven motor 700 shown in FIG. 30 has no specific volumetric capacity ratio (the volumetric capacity ratio thereof is 1), the efficiency in recovering energy from the refrigerant hardly is affected by the pressure condition of the refrigeration cycle. Moreover, the cost and productivity problems hardly arise because it has a simple structure. In the medium-driven motor 700, however, a state in which a single working chamber 706 is formed in the cylinder 701 lasts for approximately 90° in terms of rotation angle of the rotor 702, as shown in Step 4 and Step 5 of FIG. 30. Moreover, as known from Step 5, a period during which both of the suction port 703 and the discharge port 704 are closed by the rotor 702 is relatively long. Thus, when the medium-driven motor 700 is included in the refrigerant circuit as a power recovery means, pulsation of the refrigerant in the refrigerant circuit becomes extremely strong, causing noise and vibration. Lubrication failure also tends to occur on the piston.

DISCLOSURE OF INVENTION

The present invention has been accomplished in view of the foregoing problems, and an object thereof is to provide a refrigeration cycle apparatus that has a simple structure and can be operated with high energy efficiency.

The present invention provides a refrigeration cycle apparatus including a refrigerant circuit in which a refrigerant circulates, the refrigerant circuit including: a compressor for compressing the refrigerant; a radiator for allowing the refrigerant compressed by the compressor to radiate heat; a power recovery means for performing a suction process for drawing the refrigerant coming from the radiator and a discharge process for discharging the drawn refrigerant, the suction process and the discharge process being performed substantially continuously; and an evaporator for allowing the refrigerant discharged by the power recovery means to evaporate.

In another aspect, the present invention provides a fluid machine for a refrigeration cycle apparatus including a refrigerant circuit with a compressor for compressing a refrigerant, a radiator for cooling the refrigerant compressed by the compressor, and an evaporator for evaporating the refrigerant, the fluid machine including a power recovery means that performs a suction process for drawing the refrigerant coming from the radiator and a discharge process for discharging the drawn refrigerant to a side of the evaporator. The suction process and the discharge process are performed substantially continuously.

The present invention makes it possible to realize a refrigeration cycle apparatus that can be operated with high energy efficiency while having a simple configuration.

BEST MODE FOR CARRYING OUT THE INVENTION

Figure 1:
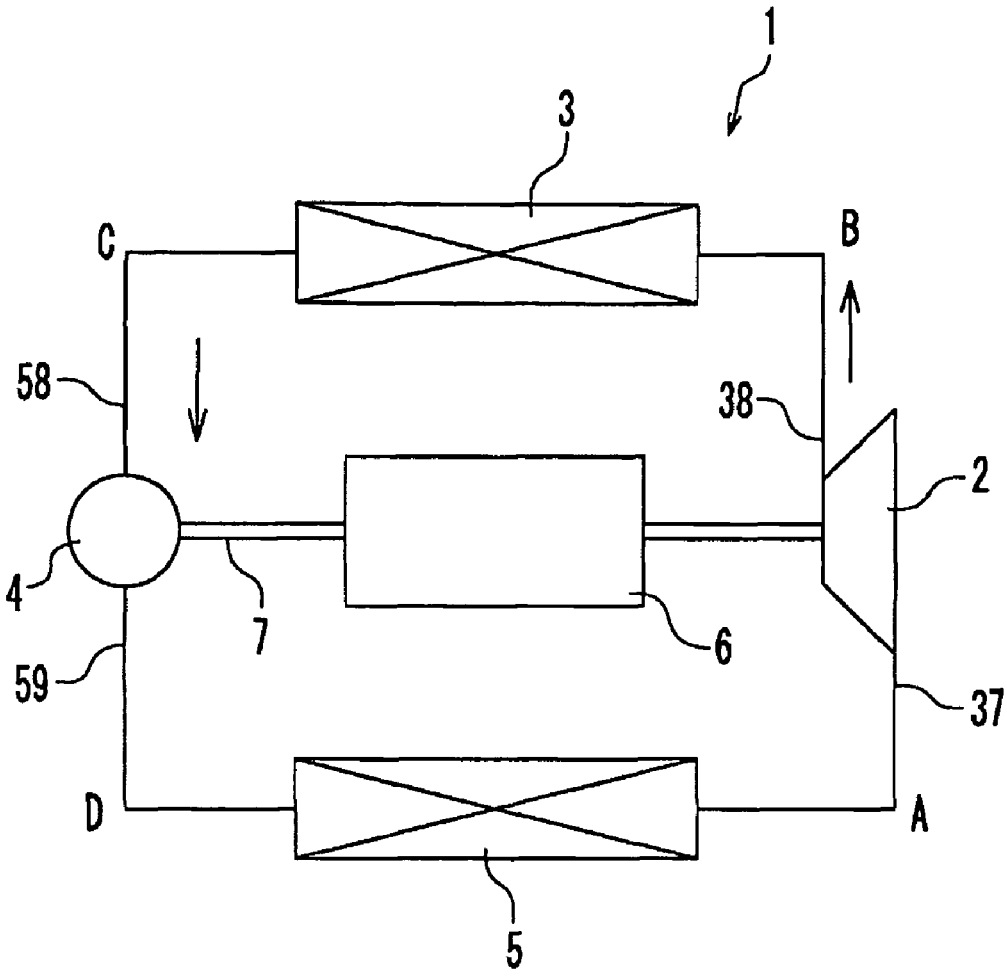
FIG. 1 is a configuration diagram of a refrigeration cycle apparatus according to Embodiment 1.

Hereinafter, embodiments of the present invention will be described with reference to the drawings. The present invention is not interpreted exclusively based on the embodiments described hereinafter. Furthermore, the embodiments may be used in combination without departing from the technical scope of the present invention.

Embodiment 1

Embodiment 1 is intended to suppress effectively the occurrence of overexpansion loss, and to enhance energy efficiency in operating a refrigeration cycle apparatus by using, as a power recovery means, a fluid pressure motor, which usually is used only with an incompressible medium because of its characteristics, for a refrigeration cycle apparatus using a compressible medium.

In this specification, a "fluid pressure motor" is a motor that is rotated by a pressure difference between a pressure of the suction side refrigerant (a pressure of the refrigerant to be drawn) and a pressure of the discharge side refrigerant (a pressure of the refrigerant in a pipe connected to a discharge port of the motor), and that starts a discharge process without changing the volume of the drawn refrigerant. More specifically, the fluid pressure motor is a motor that does not allow the drawn refrigerant to change its volume until the discharge process for the drawn refrigerant is started. After the discharge process is started, in other words, after an interior of the fluid pressure motor is brought into communication with a low pressure discharge passage, the pressure in the fluid pressure motor is reduced, causing the refrigerant to be expanded.

The technique disclosed in the specification is effective particularly for refrigeration cycle apparatuses using a refrigerant, such as carbon dioxide, that reaches a supercritical state on a high pressure side. When a refrigerant that reaches a supercritical state on a high pressure side is used, the refrigerant exhibits an extremely small expansion coefficient, which is represented by a ratio of the density of the refrigerant at an outlet of a radiator to the density of the refrigerant at an inlet of an evaporator. The energy released when this type of refrigerant is expanded is determined mostly by an internal energy released based on a pressure drop, and the portion determined by an internal energy released based on an increase in the specific volume is limited, smaller than the overexpansion loss in some cases. Accordingly, it can be advantageous, in terms of energy recovery efficiency, to intentionally give up recovering the internal energy released based on the increase in the specific volume, and employ a configuration capable of preventing the occurrence of overexpansion loss, than to employ a configuration trying to recover the whole quantity of the internal energy released.

In Embodiment 1, the fluid pressure motor used as a power recovery means performs a suction process for drawing the refrigerant and a discharge process for discharging the drawn refrigerant. The suction process and the discharge process are performed substantially continuously. Specifically, the fluid pressure motor is configured in such a manner that it allows substantially no period during which a suction passage and a discharge passage for the refrigerant are closed simultaneously. In other words, at least one of the intake passage and the discharge passage for the refrigerant is opened during substantially the whole period.

Accordingly, the occurrence of pressure pulsation is suppressed. This prevents problems from arising, such as damage to components of the refrigeration cycle apparatus, for example, a suction pipe forming the suction passage, unstable rotation of the fluid pressure motor due to a torque variation, and occurrence of vibration and noise. A phrase "it allows substantially no period during which a suction passage and a discharge passage for the refrigerant are closed simultaneously" is a concept incorporating a situation where the suction passage and the discharge passage are closed simultaneously but momentarily to a degree that causes no torque variation in the fluid pressure motor.

The refrigerant circuit is configured in such a manner that at least a part of the refrigerant discharged from the fluid pressure motor is brought into a gaseous phase as follows. The refrigerant obtains compressibility by partially being gaseous when discharged, alleviating water hammer pressure resulting from a variation in discharge flow speed caused by intermittent discharge of the refrigerant. As a result, the fluid pressure motor can be operated more smoothly, and vibration and noise can be reduced further.

Hereinafter, the configuration, work, and effect of Embodiment 1 will be described in detail with reference to FIG. 1 to FIG. 8.

—Outline of Refrigeration Cycle Apparatus 1—

FIG. 1 is a configuration diagram of a refrigeration cycle apparatus 1 according to Embodiment 1. The refrigeration cycle apparatus 1 includes a refrigerant circuit obtained by connecting a compressor 2, a first heat exchanger 3, a fluid pressure motor 4, and a second heat exchanger 5 in this order. Embodiment 1 describes an example in which the refrigerant circuit is filled with a refrigerant (specifically, carbon dioxide) that reaches a supercritical state on a high pressure side (a portion from the compressor 2 to the fluid pressure motor 4 via the first heat exchanger 3). In the present invention, however, the refrigerant is not limited to refrigerants that reach a supercritical state on the high pressure side. It may be a refrigerant that does not reach a supercritical state on the high pressure side (a fluorocarbon refrigerant, for example).

The compressor 2 is driven by a motor 6 and compresses the circulating refrigerant to a high temperature, high pressure state. The first heat exchanger 3 cools the refrigerant having been compressed to the high temperature, high pressure state by the compressor 2, and turns it to a low temperature, high pressure state by allowing the refrigerant to exchange heat with a fluid to be heated. The fluid pressure motor 4 draws the refrigerant in the low temperature, high pressure state due to the first heat exchanger 3, and discharges it to the second heat exchanger 5 side. In the fluid pressure motor 4, the volume of the drawn refrigerant does not change until a discharge process is started. When an interior of the fluid pressure motor 4 is brought into communication with the low pressure discharge passage and the discharge process is started, a pressure inside of the fluid pressure motor 4 is reduced, causing the refrigerant in the fluid pressure motor 4 to be expanded to have a low pressure. The second heat exchanger 5 heats the low pressure refrigerant discharged from the fluid pressure motor 4 by allowing the refrigerant to exchange heat with a fluid to be cooled. The refrigerant having been heated by the second heat exchanger 5 then is drawn into the compressor 2, and is compressed by the compressor 2 to return to the high temperature, high pressure state again. The refrigeration cycle apparatus 1 cools outside air (cooling), or heats outside air (heating) by repeating such a circulation of the refrigerant (refrigeration cycle).

—Specific Configuration of the Refrigeration Cycle Apparatus 1—

Figure 2:
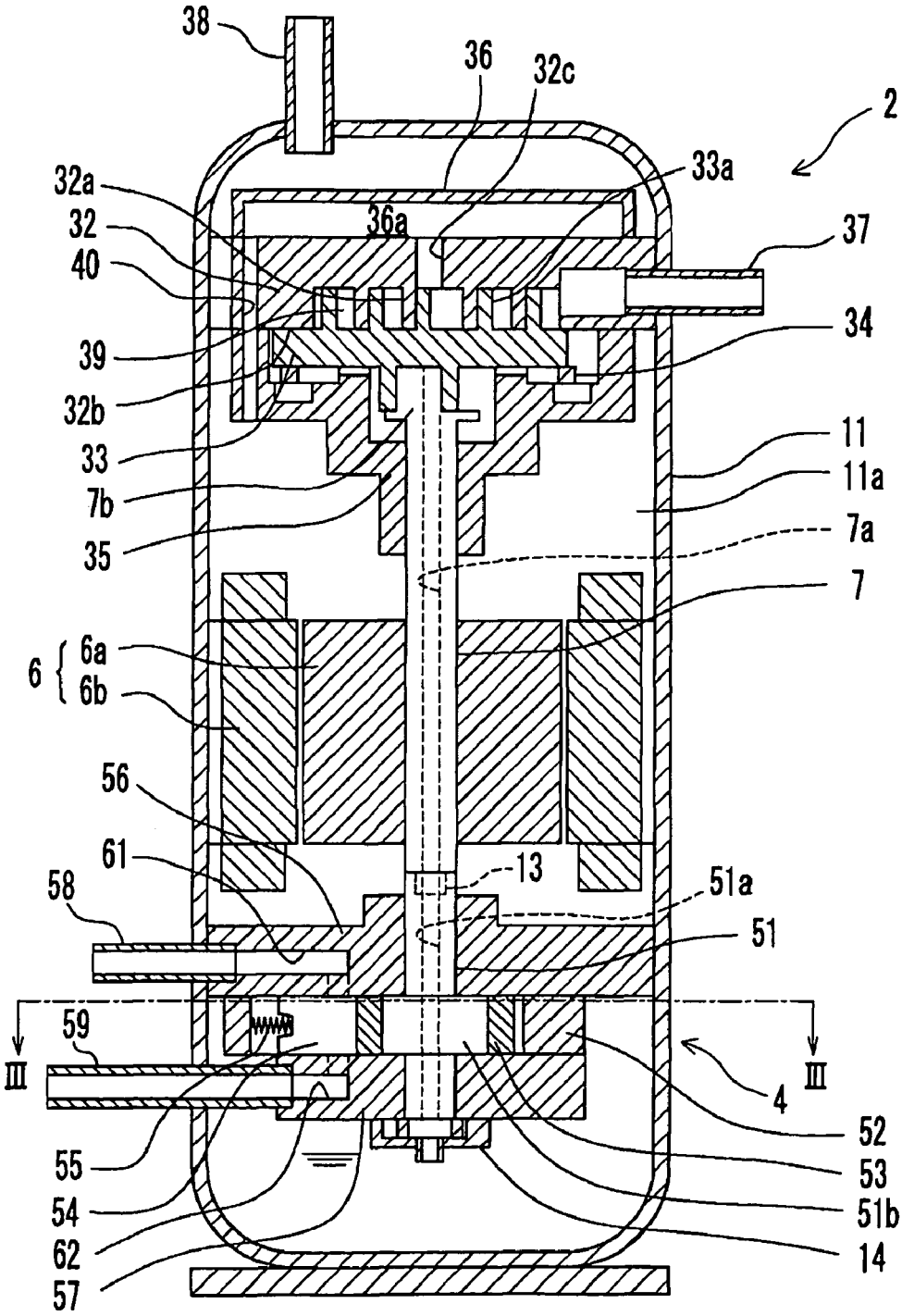
FIG. 2 is a cross-sectional view showing a configuration of a compressor, a motor, and a fluid pressure motor according to Embodiment 1.
Figure 3:
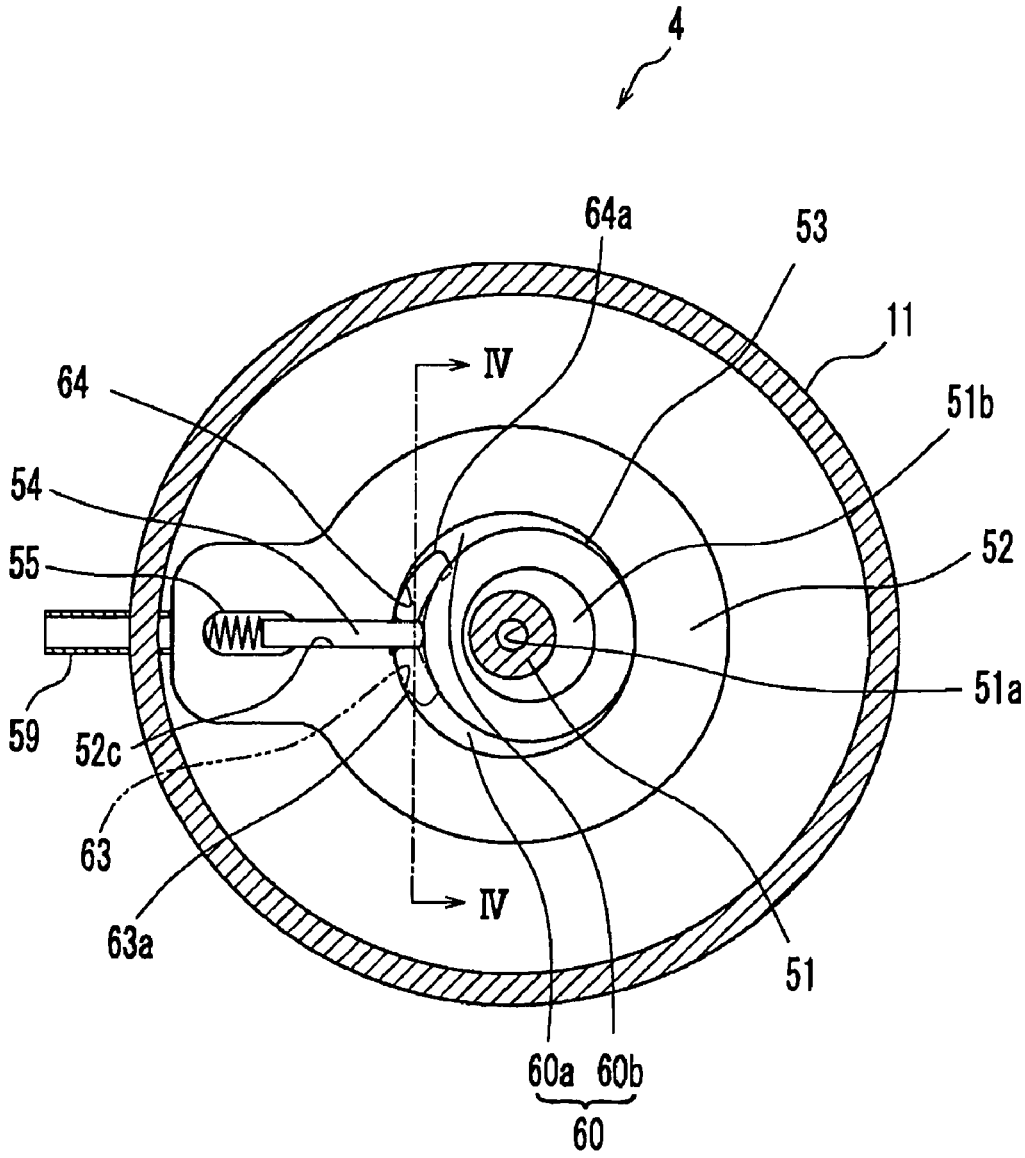
FIG. 3 is a fragmentary view taken along line III-III in FIG. 2.
Figure 4A:
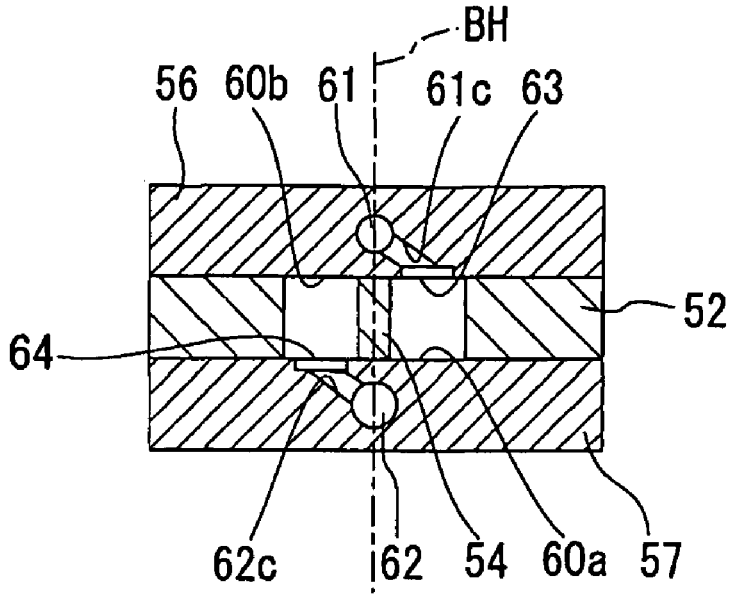
FIG. 4A is a fragmentary view taken along line IV-IV in FIG. 3.
Figure 4B:
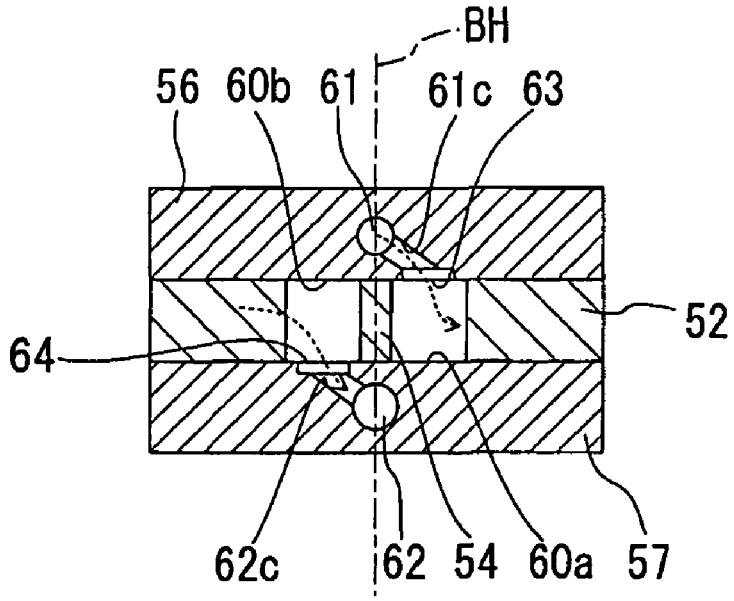
FIG. 4B is a fragmentary view showing a flowing direction of a refrigerant, taken along line IV-IV.
Figure 5:
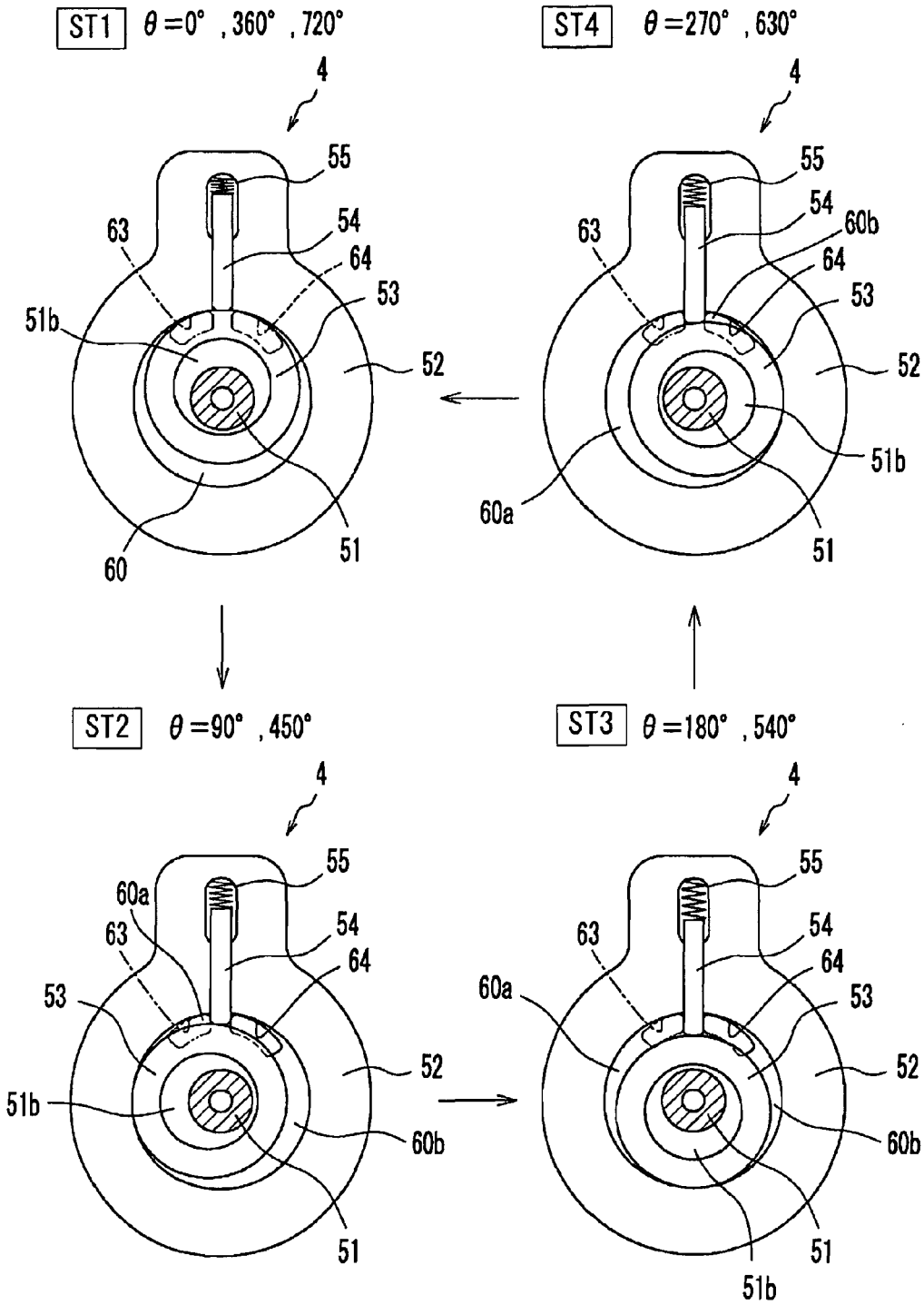
FIG. 5 is a view showing an operation principle of the fluid pressure motor according to Embodiment 1.

FIG. 2 is a cross-sectional view (a vertical cross-sectional view) showing the configurations of the compressor 2, the motor 6, and the fluid pressure motor 4 in Embodiment 1. FIG. 3 is a fragmentary view (transverse cross-sectional view) taken along line III-III in FIG. 2. FIG. 4A is a fragmentary view (transverse cross-sectional view) taken along line IV-IV in FIG. 3. FIG. 5 is a view showing an operation principle of the fluid pressure motor 4. It shows the state of the fluid pressure motor 4 every 90° with respect to a rotation angle θ of a shaft 51.

In the present embodiment, the compressor 2, the motor 6, and the fluid pressure motor 4 are accommodated integrally in a closed casing 1 to be made compact, as shown in FIG. 2.

—Configurations of the Motor 6 and the Compressor 2—

The motor 6 is disposed at a center of an internal space 11*a* of the closed casing 1. Specifically, the motor 6 is composed of a cylindrical stator 6*b* fixed unrotatably to the closed casing 1, and a rotor 6*a* that is provided in the stator 6*b* and rotates freely with respect to the stator 6*b*. A through hole is formed at a center of the rotor 6*a* viewed in plane. The through hole penetrates through the rotor 6*a* in an axial direction thereof. A shaft 7 (a compressor shaft), which extends upward and downward from the rotor 6*a*, is inserted into the through hole and fixed. More specifically, the shaft 7 is rotated by driving the motor 6.

The compressor 2 is a scroll type compressor, and is disposed and fixed at an upper portion of the internal space 11*a* of the closed casing 1. The compressor 2 includes a stationary scroll 32, an orbiting scroll 33, Oldham ring 34, a bearing member 35; a muffler 36, a suction pipe 37, and a discharge pipe 38.

The stationary scroll 32 is attached immovably to the closed casing 1. A lap 32*a* is formed on an underface of the stationary scroll 32. The lap 32*a* has a spiral shape (such as an involute shape) viewed in plane. The orbiting scroll 33 is disposed facing the stationary scroll 32. A lap 33*a* meshing with the lap 32*a* is formed on a surface of the orbiting scroll 33 facing the stationary scroll 32. The lap 33*a* has a spiral shape (such as an involute shape) viewed in plane. A crescent-shaped working chamber (a compression chamber) 39 is formed between the laps 32*a* and 33*a*. A peripheral portion of the orbiting scroll 33 abuts on and is supported by a thrust bearing 32*b* projecting downward in such a manner that the thrust bearing 32*b* constitutes a peripheral portion of the stationary scroll 32.

An eccentric portion 7*b* is inserted, fitted, and fixed in the orbiting scroll 33 at a central part of an underface of the orbiting scroll 33. The eccentric portion 7*b* is provided at an upper end of the shaft 7 extending from the rotor 6*a*, and has a central axis different from a central axis of the shaft 7. The Oldham ring 34 is disposed below the orbiting scroll 33. The Oldham ring 34 restrains rotation of the orbiting scroll 33. By the function of the Oldham ring 34, the orbiting scroll 33 scrolls while being off-centered with respect to the central axis of the shaft 7 as the shaft 7 rotates.

As the orbiting scroll 33 scrolls, the working chamber 39 formed between the lap 32*a* and the lap 33*a* moves from outside to inside while reducing its volumetric capacity. Thereby, the refrigerant drawn into the working chamber 39 through the suction pipe 37 is compressed. The compressed refrigerant is discharged to the internal space 11*a* of the closed casing 1 through a flow passage 40, via a discharge port 32*c* formed at a central part of the stationary scroll 32, and an internal space 36*a* of the muffler 36. The flow passage 40 penetrates through the stationary scroll 32 and the bearing member 35. The discharged refrigerant is held temporarily in the internal space 11*a*. While it is held therein, an oil for lubrication (a refrigeration oil) mixed with the refrigerant is separated by a gravitational force and/or a centrifugal force. The refrigerant from which the oil has been separated is discharged to the refrigerant circuit through the discharge pipe 38.

The compressor 2 has the shaft 7, and is not limited to a scroll type compressor as long as it performs a rotating operation around the shaft 7. The compressor 2 may be, for example, a rotary type compressor.

—Configuration of the Fluid Pressure Motor 4—

As shown in FIG. 2, the fluid pressure motor 4 is disposed below the motor 6. The present embodiment describes an example in which the fluid pressure motor 4 is a rotary type fluid pressure motor. "Rotary type" fluid pressure motors include both of a rolling piston type motor in which a piston and a vane each are provided as a separate member, as well as a swing type motor in which a piston and a vane are integrated. It should be noted, however, that the fluid pressure motor 4 is not particularly limited to the rotary type motor. The fluid pressure motor 4 may be, for example, a scroll type fluid pressure motor.

The fluid pressure motor 4 includes the shaft 51 as a rotating shaft. The shaft 51 is coupled to the shaft 7 by a joint 13 at the time of assembly, and rotates synchronously with the shaft 7. An oil pump 14 is provided at a lower end of the shaft 51. The oil pump 14 supplies an oil for lubrication and sealing to bearings, gaps, etc. in the compressor 2 and the fluid pressure motor 4 via oil supply holes 7*a* and 51*a* provided in the shafts 7 and 51, respectively.

The shaft 51 is provided with an eccentric portion 51*b* having a central axis different from a central axis of the shaft 51. The eccentric portion 51*b* is fitted to a tubular (specifically cylindrical) piston 53 provided around an outer periphery of the eccentric portion 51*b*. Accordingly, the piston 53 rotates eccentrically as the shaft 51 rotates.

Both ends of the piston 53 are closed by a first closing member 56 and a second closing member 57, respectively, and the first closing member 56 and the second closing member 57 serve as a bearing of the shaft 51, respectively. The piston 53 is disposed in a cylinder 52 having an inner peripheral face. The shaft 51 penetrates a center of the cylinder 52. A central axis of an internal space of the cylinder 52 coincides with the central axis of the shaft 51. Accordingly, the piston 53 is supported axially by the shaft 51 while being off-centered with respect to the central axis of the cylinder 52. As shown in FIG. 3, a working chamber 60 with a substantially invariable volumetric capacity (a total capacity) is formed between the piston 53 and the inner peripheral face of the cylinder 52.

A linear groove 52*c* communicating with the internal space of the cylinder 52 is formed in the cylinder 52 on a side of a top dead center thereof (on the left in FIG. 3). A plate-like partition member 54 is disposed in the groove 52*c* slidably and displaceably. One end of the partition member 54 is coupled to a spring 55 disposed behind the partition member 54. The partition member 54 is pushed in a direction toward the piston 53 by the spring 55, and another end of the partition member 54 always is pressed onto an outer peripheral face of the piston 53. Accordingly, the working chamber 60, which is formed by the piston 53, the cylinder 52, the first closing member 56, and the second closing member 57, is divided into a high pressure side suction working chamber 60*a* and a low pressure side discharge working chamber 60*b*.

As shown in FIG. 2, a suction passage 61 opens to a portion of the suction working chamber 60*a* adjacent to the partition member 54. The suction passage 61 is formed in the first closing member 56 located above the cylinder 52. The suction passage 61 communicates with a suction pipe 58. The refrigerant is guided from the suction pipe 58 into the suction working chamber 60*a* via the suction passage 61. On the other hand, a discharge passage 62 opens to a portion of the discharge working chamber 60*b* adjacent to the partition member 54. The discharge passage 62 is formed in the second closing member 57 that is located below the cylinder 52, and farther from the compressor 2 than the first closing member 56 in which the suction passage 61 is formed is. The discharge passage 62 communicates with a discharge pipe 59. The refrigerant is discharged from the discharge working chamber 60*b* to the discharge pipe 59 via the discharge passage 62.

As shown in FIG. 3, an opening 63 (a suction port 63) of the suction passage 61 to the suction working chamber 60*a* is formed in a substantially fan shape extending, in an arc shape, from the portion of the suction working chamber 60*a* adjacent to the partition member 54 in a direction in which the suction working chamber 60*a* stretches (counter clockwise in the case of FIG. 3). The suction port 63 is closed completely by the cylinder 52 only at a moment at which the piston 53 is located at the top dead center thereof. Thus, at least a part of the suction port 63 is opened during the whole period except for the moment at which the piston 53 is located at the top dead center. Specifically, an edge side 63*a* of the suction port 63, which is located outside with respect to a radial direction of the cylinder 52, is formed in an arc shape along the outer peripheral face of the piston 53 (that is, in an arc shape with the same radius as that of the outer peripheral face of the piston 53) when the piston 53 is located at the top dead center viewed in plane.

An opening 64 (a discharge port 64) of the discharge passage 62 to the discharge working chamber 60*b* is formed in a substantially fan shape extending, in an arc shape, from the portion of the discharge working chamber 60*b* adjacent to the partition member 54 in a direction in which the discharge working chamber 60*b* stretches (clockwise in the case of FIG. 3). The discharge port 64 is closed completely by the cylinder 52 only at the moment when the piston 53 is located at the top dead center. Thus, at least a part of the discharge port 64 is opened during the whole period except for the moment at which the piston 53 is located at the top dead center. Specifically, an edge side 64*a* of the discharge port 64, which is located outside with respect to the radial direction of the cylinder 52, is formed in an arc shape along the outer peripheral face of the piston 53 (that is, in an arc shape with the same radius as that of the outer peripheral face of the piston 53) when the piston 53 is located at the top dead center viewed in plane.

Figure 31:
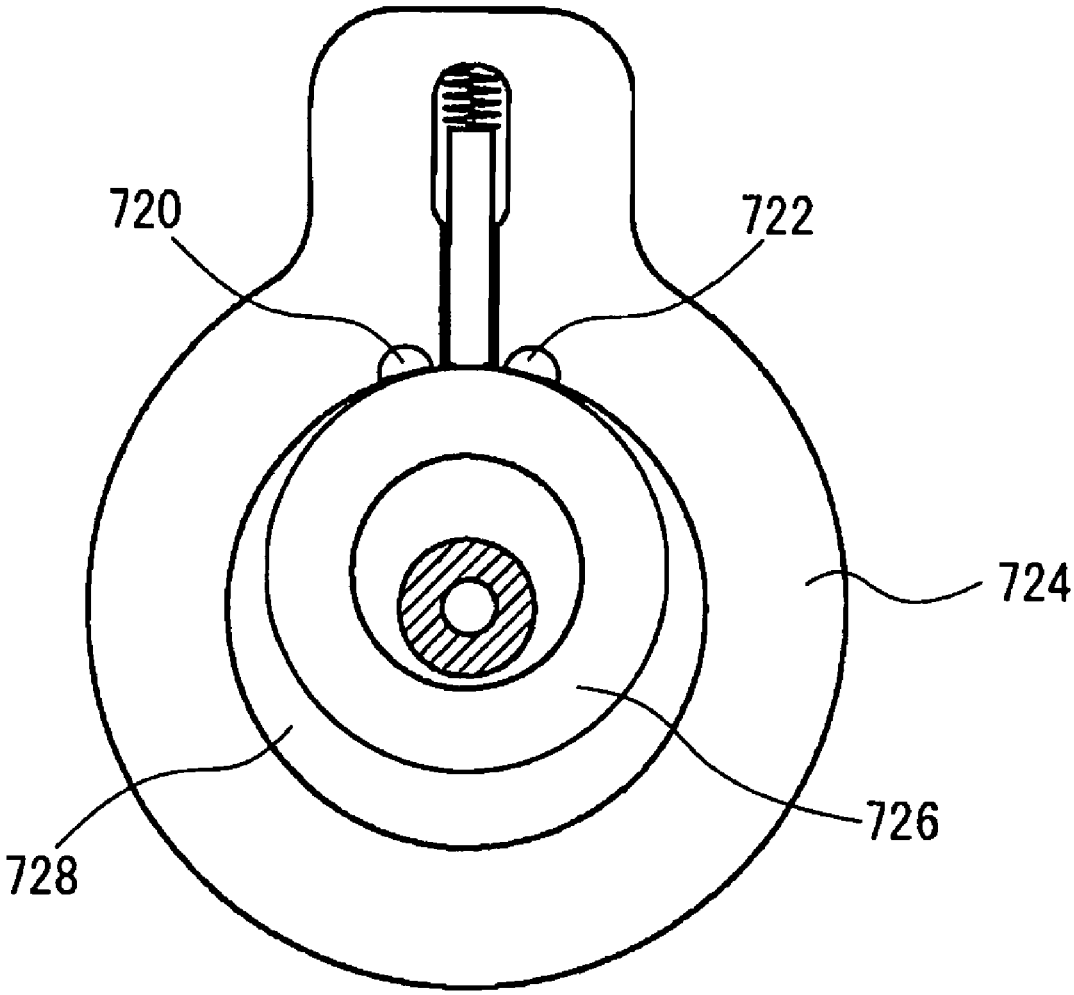
FIG. 31 is a configuration diagram of a conventional rotary type fluid machine.

FIG. 31 shows a configuration of a conventional rotary type fluid machine. In this fluid machine, a suction port 720 and a discharge port 722 each are formed on an inner peripheral face of a cylinder 724. The suction port 720 and the discharge port 722 are not closed completely at a moment when a piston 726 is located at a top dead center thereof. Accordingly, at this moment, it is possible for a fluid to flow directly from the suction port 720 to the discharge port 722 via a working chamber 728. This hinders efficient energy recovery when the fluid machine is used as a power recovery means.

In contrast, according to the present embodiment, both of the suction port 63 and the discharge port 64 are closed completely only at the moment when the piston 53 is located at the top dead center. Immediately after the piston 53 rotates away from the top dead center, the working chamber 60 is partitioned into the suction working chamber 60*a* and the discharge working chamber 60*b*, and the suction port 63 is brought into communication only with the suction working chamber 60*a* while the discharge port 64 is brought into communication only with the discharge working chamber 60*b*. In such a design, no direct flow of the refrigerant from the suction passage 61 to the discharge passage 62 can occur. Thereby, highly efficient energy recovery is realized.

Figure 30:
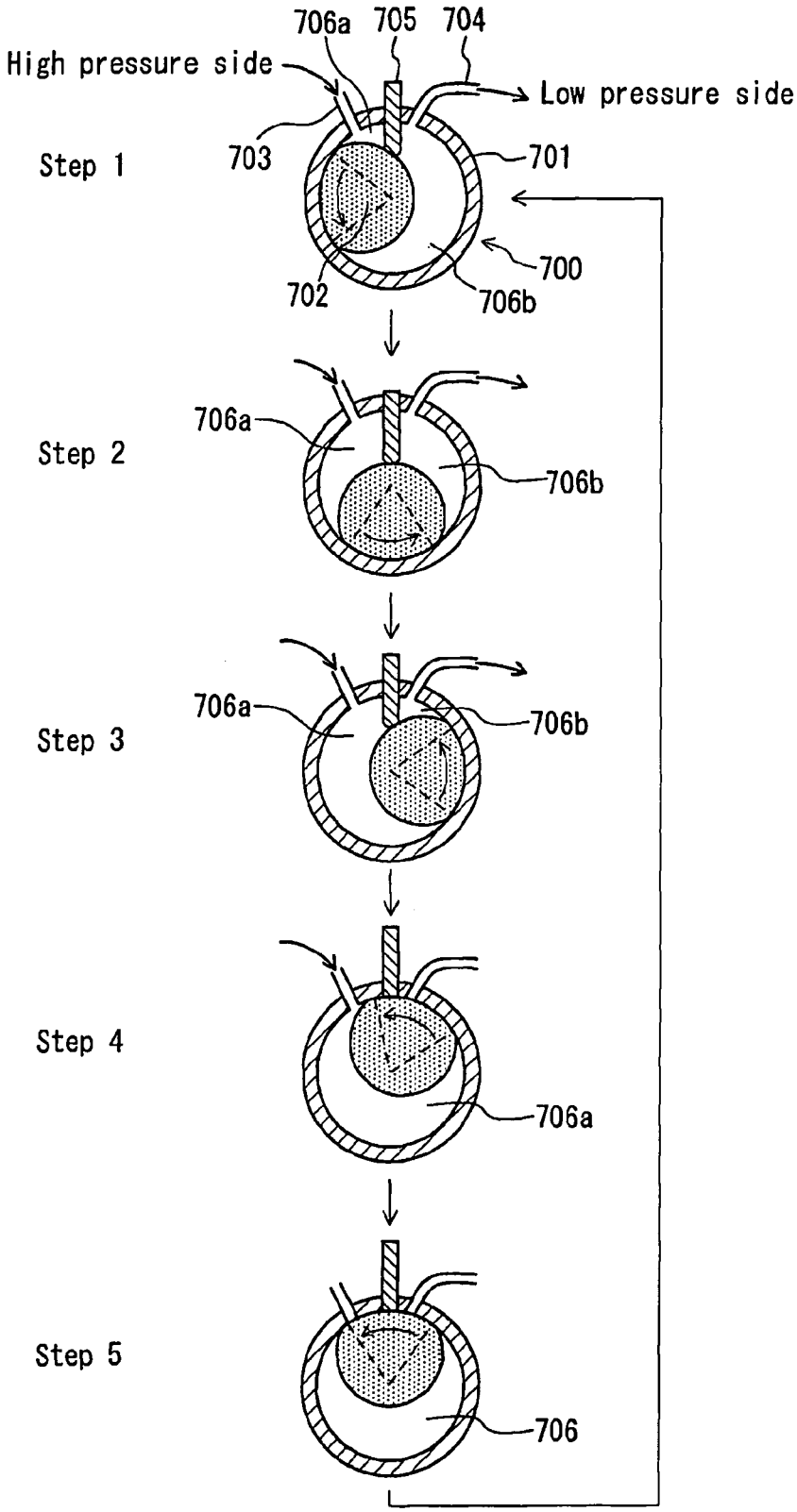
FIG. 30 is a view showing an operation principle of a conventional medium-driven motor.

During the whole period except for the moment at which the piston 53 is located at the top dead center, the suction port 63 is opened so that the suction passage 61 communicates with the suction working chamber 60*a*, and the discharge port 64 also is opened so that the discharge passage 62 communicates with the discharge working chamber 60*b*. More specifically, a configuration is realized that allows substantially no period during which the suction passage 61 and the discharge passage 62 are closed simultaneously. Thus, there hardly arise problems (mainly a pulsation problem) that occur, when both of the suction port 703 and the discharge port 704 are closed by the rotor 702 for a long time in the conventional medium-driven motor 700 shown in FIG. 30, for example.

"A moment at which the piston 53 is located at the top dead center thereof" is a moment at which the partition member 54 is pressed into the groove 52*c* most inwardly, that is, a moment at which the fluid pressure motor 4 is in the state of ST1 shown in FIG. 5. However, "a moment at which the piston 53 is located at the top dead center thereof" is not limited strictly to a moment at which the piston 53 is located at the top dead center, and may be a certain period that starts before and ends after the moment at which the piston 53 is located at the top dead center. When a rotation angle (θ) of the piston 53 located at the top dead center is defined as 0°, a configuration that makes both of the suction port 63 and the discharge port 64 to be closed for a period during which the rotation angle (θ) of the piston 53 is in a range of 0°±5° (or in a range of 0°±3°), for example, is included in the configuration that allows substantially no period during which the suction passage 61 and the discharge passage 62 are closed simultaneously.

In Embodiment 1, an opening area of the discharge port 64 is set to be larger than an opening area of the suction port 63. It should be noted, however, that the relationship between the opening area of the suction port 63 and the opening area of the discharge port 64 is not particularly limited. For example, the suction port 63 and the discharge port 64 may have the same opening area.

An opening portion 61*c* of the suction passage 61 to the suction working chamber 60*a* is formed inclined with respect to an axial direction (a vertical direction in FIG. 4A) of the cylinder 52 in such a manner that the opening portion 61*c* extends in the direction in which the suction working chamber 60*a* (the high pressure side working chamber) stretches, as shown in FIG. 4A. On the other hand, an opening portion 62*c* of the discharge passage 62 to the discharge working chamber 60*b* is formed inclined with respect to the axial direction of the cylinder 52 in such a manner that the opening portion 62*c* extends in the direction in which the discharge working chamber 60*b* (the low pressure side working chamber) stretches. As shown in FIG. 4A, an bore diameter (an inner diameter or a cross-sectional area) of the discharge passage 62 is set to be larger than an bore diameter of the suction passage 61.

—Operation Principle of the Fluid Pressure Motor 4—

Next, the operation principle of the fluid pressure motor 4 will be described with reference to FIG. 5. FIG. 5 shows four states from ST1 to ST4. ST1 is a view showing the case where the rotation angle (θ, which is defined as positive in a counter clockwise direction in FIG. 5) of the piston 53 is 0°, 360°, or 720°. ST2 is a view showing the case where the rotation angle (θ) of the piston 53 is 90° or 450°. ST3 is a view showing the case where the rotation angle (θ) of the piston 53 is 180° or 540°. ST4 is a view showing the case where the rotation angle (θ) of the piston 53 is 270° or 630°.

As shown in ST1 of FIG. 5, when the piston 53 is located at the top dead center (θ=0°), both of the suction port 63 and the discharge port 64 are closed by the piston 53, and the working chamber 60 is in an isolated state where it is out of communication with both of the suction passage 61 and the discharge passage 62. As the piston 53 rotates from this state and θ is increased, the suction working chamber 60*a*, which is formed by the inner peripheral face of the cylinder 52, the outer peripheral face of the piston 53, the first closing member 56, the second closing member 57, and the partition member 54, newly is formed, and a volumetric capacity of the suction working chamber 60*a* increases (ST2 to ST4). As the volumetric capacity of the suction working chamber 60*a* increases, the low temperature, high pressure refrigerant supplied from the first heat exchanger 3 side flows into the suction working chamber 60*a* via the suction passage 61. This suction process is performed until the rotation angle (θ) reaches 360°, that is, until the piston 53 is located at the top dead center once again.

At the moment when the piston 53 is located at the top dead center again, both of the suction port 63 and the discharge port 64 are closed by the piston 53 as shown in ST1, isolating the working chamber 60. Then, the discharge port 64 is opened as the piston 53 rotates further, bringing the isolated working chamber 60 into communication with the discharge passage 62 this time. In this way, the working chamber 60 is isolated only at the moment when the piston 53 is located at the top dead center, and the suction process and the discharge process are performed substantially continuously. The drawn refrigerant is discharged from the working chamber 60 without being compressed and expanded in the working chamber 60. The suction volume and the discharge volume are substantially equal to each other.

By the function of the compressor 2 disposed in the refrigerant circuit, a pressure on a side of the second heat exchanger 5 beyond the fluid pressure motor 4 is lower than that on a side of the first heat exchanger 3. At the moment when the isolated working chamber 60 is brought into communication with the discharge passage 62 and the working chamber 60 is turned into the discharge working chamber 60*b*, the low temperature, high pressure refrigerant in the discharge working chamber 60*b* is drawn to the low pressure side. Then, the pressure in the discharge working chamber 60*b* decreases momentarily, and becomes equal to the pressure of the low pressure side of the refrigerant circuit. As the rotation angle (θ) of the piston 53 increases, the refrigerant in the discharge working chamber 60*b* continuously is discharged to the low pressure side of the refrigerant circuit. And when the piston 53 is located at the top dead center (θ=720°) again, the discharge working chamber 60*b* disappears. The suction working chamber 60*a* is formed again synchronously with this discharge process, initiating the next suction process. In this way, a series of steps from the start of the suction process to the end of the discharge process is completed when the piston 53 rotates 720°.

The fluid pressure motor 4 is powered by a difference between the high pressure in the suction working chamber 60*a* and the low pressure in the discharge working chamber 60*b*, and thereby rotates counter clockwise the piston 53 and the shaft 51 coupled to the piston 53. A rotation torque of the shaft 51 is transferred to the shaft 7 coupled to the shaft 51, and utilized as a part of mechanical power for compressing the refrigerant at the compressor 2.

—Refrigeration Cycle—

Figure 6:
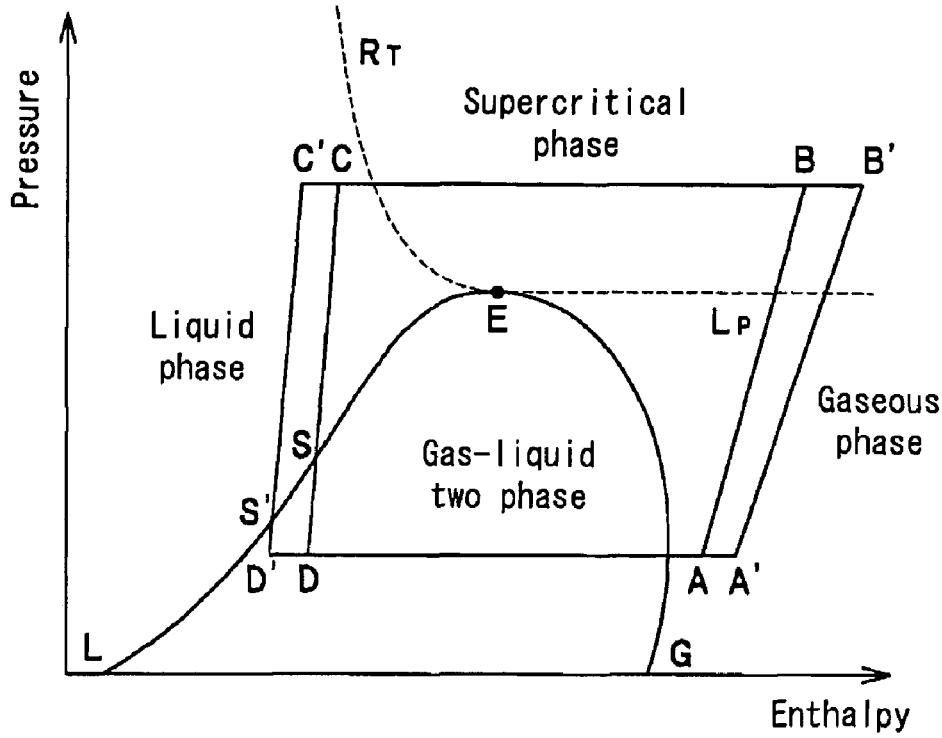
FIG. 6 is a Mollier diagram of a refrigeration cycle of the refrigeration cycle apparatus according to Embodiment 1.

Next, the refrigeration cycle of the refrigeration cycle apparatus 1 will be described in detail with reference to FIG. 6. Point E shown in FIG. 6 is a critical point. EL is a saturated liquid curve. EG is a saturated gas curve. $L_P$ is an isobaric curve passing through the critical point (Point E). $R_T$ is an isothermal curve passing through the critical point (Point E). On the Mollier diagram shown in FIG. 6, the region right to the saturated gas curve EG and below the isobaric curve $L_P$ represents a gaseous phase. The region left of the saturated liquid curve EL and below the isothermal curve $R_T$ represents a liquid phase. The region above the isobaric curve $L_P$ and isothermal curve $R_T$ represents a supercritical phase. The region right of the saturated liquid curve EL and left of the saturated gas curve EG represents a gas-liquid two phase. The closed loop ABCD in FIG. 6 shows the power-recovery-type refrigeration cycle shown in FIG. 1. AB in the closed loop ABCD shows the state change of the refrigerant in the compressor 2. BC shows the state change of the refrigerant in the first heat exchanger 3. CD shows the state change of the refrigerant in the fluid pressure motor 4. DA shows the state change of the refrigerant in the second heat exchanger 5.

In the compressor 2, the refrigerant is compressed from a low temperature, low pressure gaseous phase (Point A) to a high temperature, high pressure supercritical phase (Point B). And in the first heat exchanger 3, the refrigerant is cooled from the high temperature, high pressure supercritical phase (Point B) to a low temperature, high pressure liquid phase (Point C). Then, in the fluid pressure motor 4, the refrigerant is expanded (undergoes pressure drop) from the low temperature, high pressure liquid phase (Point C) to a gas-liquid two phase (Point D) via a saturated liquid (Point 5). In this pressure drop (expansion) process, a specific volume of the refrigerant does not vary so much because the refrigerant is in the incompressible, liquid phase from Point C to Point S. On the other hand, from Point S to Point D, there occurs a pressure drop accompanied by a rapid change in the specific volume due to a phase change from liquid phase to gaseous phase, that is, there occurs a pressure drop accompanied by expansion. The refrigerant then is heated in the second heat exchanger 5, and changed from the gas-liquid two phase (Point D) to the gaseous phase (Point A) while being evaporated.

A pressure drop (SD) in the gas-liquid two phase in the fluid pressure motor 4 is sufficiently small compared with a pressure drop (CS) in the single phase (liquid phase). This tendency is notable as Point C on the suction side of the fluid pressure motor 4 shifts to the lower enthalpy side, from the fact that the pressure drop in the gas-liquid two phase is changed from SD to S'D' when Point C shifts to Point C' that is on a side of lower enthalpy.

Figure 7:
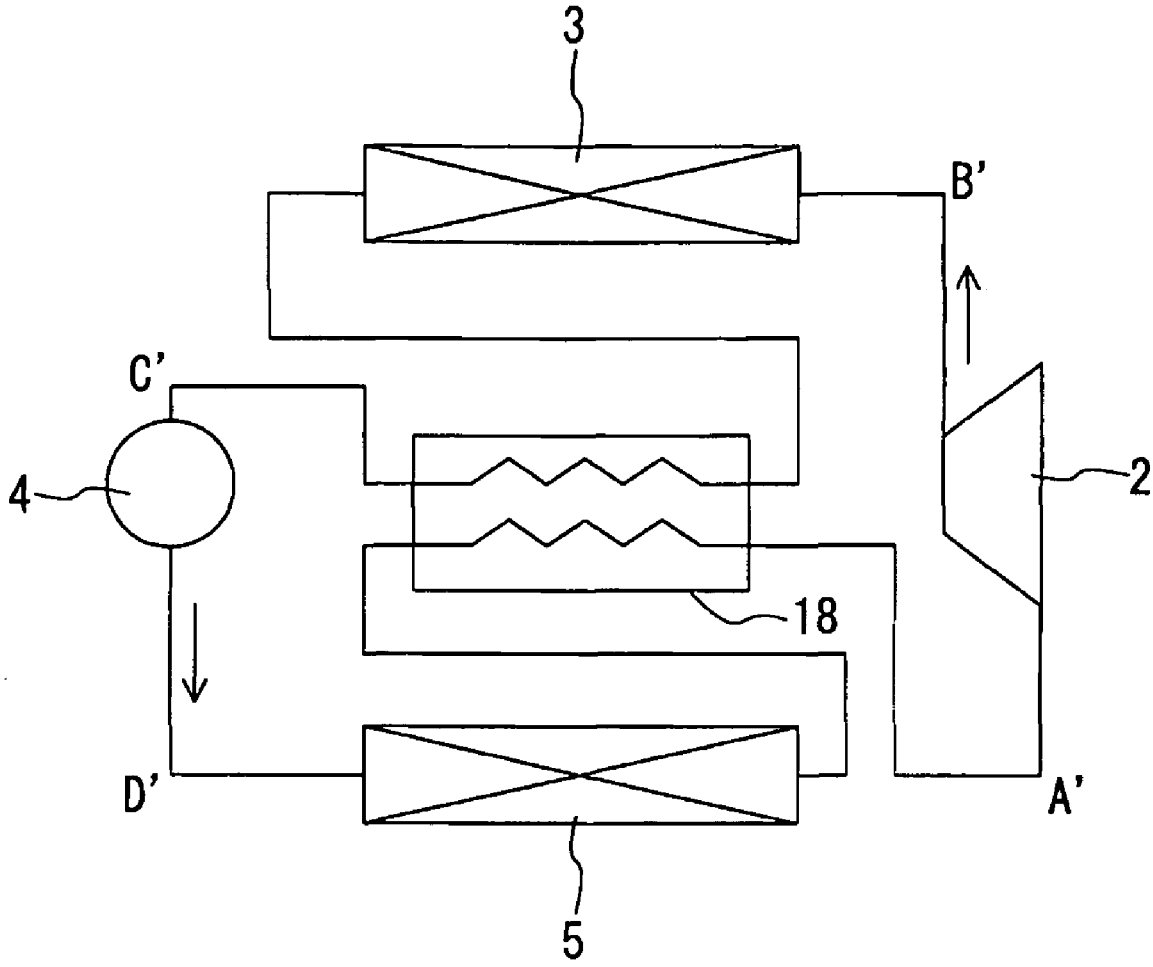
FIG. 7 is a configuration diagram of the refrigeration cycle apparatus including an internal heat exchanger.

When a high temperature side heat source of the refrigeration cycle is utilized for applications such as heating and hot water supply, a temperature of the medium (for example, air and water) that should be heated by the first heat exchanger 3 is lower than in the case where a low temperature side heat source is utilized for applications such as cooling. Accordingly, Point C tends to shift to the lower enthalpy side. Moreover, as shown in FIG. 7 (the motor 6 and the shaft 7 are omitted), when an internal heat exchanger 18 is provided at a position that is on the suction side of the compressor 2 and also is on the suction side of the fluid pressure motor 4, a heat exchange is performed between the refrigerant to be drawn into the compressor 2 and the refrigerant to be drawn into the fluid pressure motor 4. Then, as shown in FIG. 6, Point C shifts to Point C' and Point A shifts to Point A', respectively, specifying the refrigeration cycle by a closed loop A'B'C'D'. Accordingly, a tendency is observed more noticeably for the pressure drop (SD) in the gas-liquid two phase to become smaller than the pressure drop (CS) in the liquid phase. This tendency becomes still more noticeable in the case of using carbon dioxide than in the case of using chlorofluocarbon or hydrocarbon as the refrigerant of the refrigeration cycle.

—Work and Effect—

First, description will be made with respect to work and effect obtained by using, instead of a conventional expander, the fluid pressure motor 4 as a power recovery means, with reference to an example shown in FIG. 8.

Figure 8:
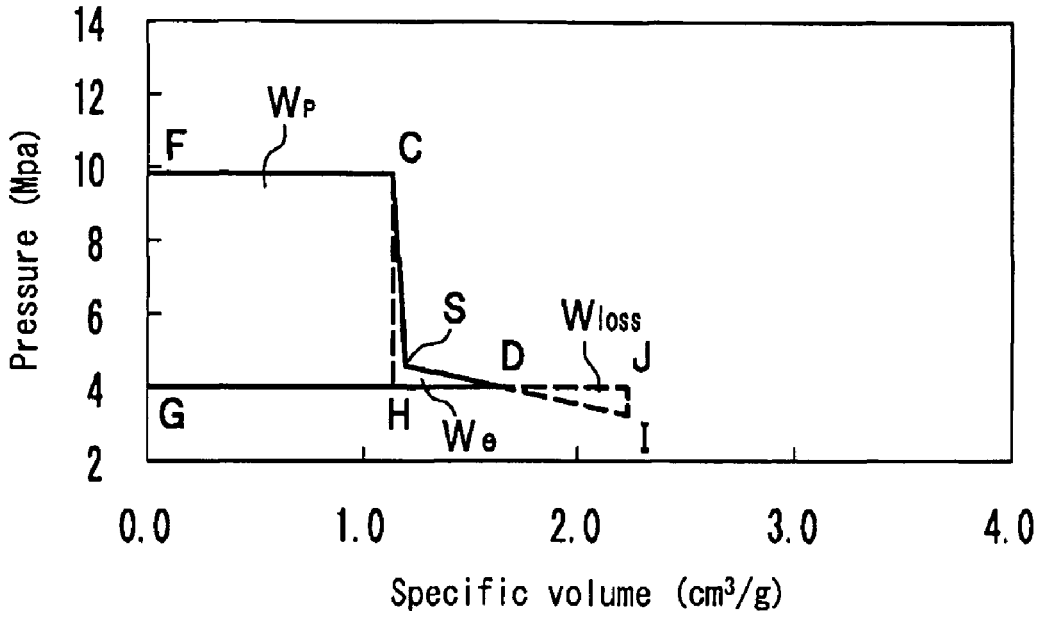
FIG. 8 is a graph showing a relationship between specific volume of the refrigerant and pressure of the refrigerant in the fluid pressure motor according to Embodiment 1.

FIG. 8 is a graph showing a relationship between specific volume and pressure of the refrigerant in the fluid pressure motor 4. Point C, Point D, and Point S in FIG. 8 correspond to Point C, Point D, and Point S in FIG. 6, respectively. FIG. 8 shows the result of a computer simulation when the refrigeration cycle apparatus 1 is used for a water heater. The pressure is 9.77 MPa, and the temperature is 16.3° C. at Point C. The pressure at Point D is 3.96 MPa. The entropy is assumed to be constant between Point C and Point D.

As shown in FIG. 8, in the incompressible-liquid-phase pressure drop (CS), the pressure only is reduced while the specific volume is almost fixed. In the case of pressure drop (SD) in the gas-liquid two phase, the specific volume greatly is increased because the pressure drop (SD) in the gas-liquid two phase is accompanied by a phase change from liquid phase to gaseous phase. More specifically, the pressure drop (CS) in the liquid phase becomes several times larger than the pressure drop (SD) in the gas-liquid two phase.

The area of the portion enclosed by F, C, S, D, H, and G in FIG. 8 corresponds to a theoretical value of a mechanical power that can be recovered from the refrigerant per unit mass. A theoretical recovery power $W_{all}$ corresponding to the area of a portion enclosed by F, C, 5, D, H, and G is represented by a sum total of a recovery power resulting from pressure drop $W_p$, which corresponds to the area of a portion enclosed by F, C, H, and G, and a recovery power resulting from an increase in specific volume $W_e$ (a recovery power resulting from expansion), which corresponds to the area of a portion enclosed by C, 5, D, and H. In the model shown in FIG. 8, $W_p$ accounts for approximately 96% of $W_{all}$, and $W_e$ accounts for approximately 4% of $W_{all}$, actually. As known from this, the proportion of the recovery power resulting from expansion $W_e$ in the theoretical recovery power $W_{all}$ is very small, and most of the theoretical recovery power $W_{all}$ is the recovery power resulting from pressure drop $W_p$.

Since the fluid pressure motor 4 used as a power recovery means in the present embodiment discharges the drawn refrigerant without expanding it, the fluid pressure motor 4 only can recover the recovery power $W_p$ out of the theoretical recovery power $W_{all}$. In contrast, when a conventional expander is used as a power recovery means, it is possible to recover all of the theoretical recovery power $W_{all}$, that is, it is possible to recover the recovery power $W_e$ as well.

As described above, however, the proportion of the recovery power resulting from expansion $W_e$ in the theoretical recovery power $W_{all}$ is very small, and most of the theoretical recovery power $W_{all}$ is the recovery power resulting from pressure drop $W_p$. Accordingly, the mechanical power that the fluid pressure motor 4 can recover practically is not so much different from the power that a conventional expander can recover, and it is possible to recover the mechanical power efficiently even when the fluid pressure motor 4 is used. Especially, the proportion of the recovery power resulting from expansion $W_e$ in the theoretical recovery power $W_{all}$ is extremely small in cases such as when the refrigerant is brought into the supercritical phase on the high-pressure side of the refrigeration cycle, and when the high temperature side heat source is utilized for applications such as heating and hot water supply. Therefore, even when the fluid pressure motor 4 is used as a power recovery means as in the present embodiment, it is possible to realize the refrigeration cycle apparatus 1 that can be operated with high energy efficiency.

Overexpansion loss may possibly occur when an expander with a specific volumetric capacity ratio is used as the power recovery means. In contrast, when the fluid pressure motor 4 is used as the power recovery means as in the present embodiment, there is no possibility for the overexpansion loss to occur.

If the overexpansion loss occurs, an energy corresponding to the area of the portion enclosed by D, J, and I shown in dashed lines in FIG. 8 is lost as the overexpansion loss. For example, as shown in FIG. 8, assuming that the specific volume of the refrigerant is expanded to reach Point I, at which the specific volume of the refrigerant becomes 2.0 times larger than that at Point C, the refrigerant once is overexpanded, between Point D and Point I, to a pressure lower than the pressure of the low pressure side of the refrigeration cycle. Then, the pressure is increased to Point J, the low pressure of the refrigeration cycle, at start of a discharge process, and the discharge process is performed until Point G. A loss due to this overexpansion of the refrigerant (an overexpansion loss $W_{loss}$) is approximately 3% of the theoretical recovery power $W_{all}$, an, and even equal to $W_e$ corresponding to approximately 4% of $W_{all}$, in the case shown in FIG. 8, for example. The magnitude of the overexpansion loss $W_{loss}$ varies depending on operating conditions of the refrigeration cycle apparatus 1. It may be equal to, or more than the recovery power resulting from expansion $W_e$ depending on the operating conditions.

As described above, even in the case of using the expander that theoretically is capable of recovering $W_e$ as well, it practically is impossible, because of the overexpansion loss, to recover so much mechanical power stably. In contrast, in case of using the fluid pressure motor 4 as the power recovery means, most of the theoretical recovery power $W_{all}$ can be recovered, and the loss due to overexpansion of the refrigerant $W_{loss}$ does not occur. Thereby, the mechanical power can be recovered in a stable manner regardless of operational status of the refrigeration cycle apparatus 1. In some cases, it is possible to recover mechanical power larger than that in the case of using the conventional expander as the power recovery means. In other words, it is possible to enhance further an average efficiency in recovering mechanical power by using the fluid pressure motor 4 as the power recovery means.

Since the fluid pressure motor 4 has a simpler configuration than that of conventional expanders, it is possible to reduce the cost of the refrigeration cycle apparatus 1 by using the fluid pressure motor 4 as the power recovery means. Furthermore, it also can reduce loss caused by friction on a sliding part or a sealing part, as well as loss caused by leakage of the refrigerant.

Moreover, since the present embodiment allows substantially no period during which the suction passage 61 and the discharge passage 62 are closed simultaneously, drawing of the refrigerant into the suction passage 61 and discharging of the refrigerant from the discharge passage 62 are performed not intermittently but substantially continuously. In the fluid pressure motor 4 of the present embodiment, the volumetric capacity of the suction working chamber 60*a* varies in a sine wave shape. The suction port 63 is closed only at a moment when the piston 53 is located at the top dead center thereof, as well as at a moment when a rate of the volumetric capacity variation of the suction working chamber 60*a* is equal to zero. In other words, the suction port 63 is closed only at a moment when a flow rate of the refrigerant being drawn into the suction working chamber 60*a* is equal to zero. On the other hand, the volumetric capacity of the discharge working chamber 60*b* varies in a sine wave shape. The discharge port 64 is closed only at a moment when the piston 53 is located at the top dead center thereof, as well as at a moment when a rate of the volumetric capacity variation of the discharge working chamber 60*b* is equal to zero. In other words, the discharge port 64 is closed only at the moment when a flow rate of the refrigerant being discharged from the discharge working chamber 60*b* is equal to zero. Accordingly, pressure pulsation and a water hammer phenomenon resulting therefrom is suppressed effectively. As a result, damage, vibration, and noise of components of the refrigeration cycle apparatus 1 are suppressed. Fluctuation in rotation torque of the compressor 2 also is reduced, allowing stable operation of the refrigeration cycle apparatus 1.

At least a part of the refrigerant discharged from the fluid pressure motor 4 is in a gaseous phase. Specifically, the refrigerant is discharged from the fluid pressure motor 4 in a gas-liquid two phase. More specifically, the pressure of the refrigerant is reduced simultaneously with start of the discharge process, and a part of the refrigerant changes its phase from liquid phase to gaseous phase, making a gas-liquid two phase. Water hammer pressure is somewhat generated also in the present embodiment because discharging of the refrigerant is stopped momentarily. However, the refrigerant in a gaseous phase discharged serves as a cushion and alleviates the water hammer pressure. This allows the fluid pressure motor 4 to be operated more smoothly, and allows vibration and noise to be reduced further.

As described with FIG. 31, in the configuration in which the suction port 720 and the discharge port 722 are formed on the inner peripheral face of the cylinder 724, it is not possible to close completely both of the suction port 720 and the discharge port 722 at the moment when the piston 726 is located at the top dead center thereof. In contrast, the suction port 63 is formed in the first closing member 56, and the discharge port 64 is formed in the second closing member 57 in the present embodiment. Accordingly, it is possible to close completely both of the suction port 63 and the discharge port 64 at the moment when the piston 53 is located at the top dead center thereof, and to suppress effectively a direct flow from the suction port 63 to the discharge port 64. As a result, it becomes possible to recover mechanical power efficiently, and to realize the refrigeration cycle apparatus 1 that can be operated with higher efficiency.

The suction port 63 may be formed in the second closing member 57, and the discharge port 64 may be formed in the first closing member 56. In other words, the suction passage 61 may be formed in the second closing member 57, and the discharge passage 62 may be formed in the first closing member 56. Furthermore, both of the suction port 63 and the discharge port 64 may be formed in the first closing member 56 or the second closing member 57. In other words, both of the suction passage 61 and the discharge passage 62 may be formed in the first closing member 56 or the second closing member 57. Similar effects also can be achieved by such configurations.

A configuration that allows both of the suction port 63 and the discharge port 64 to be closed completely at the moment when the piston 53 is located at the top dead center thereof can be realized by forming the edge side 63*a* of the suction port 63, which is located outside with respect to the radial direction of the cylinder 52, in an arc shape along the outer peripheral face of the piston 53 when the piston 53 is located at the top dead center viewed in plane, and by forming the edge side 64*a* of the discharge port 64, which is located outside with respect to the radial direction of the cylinder 52, in an arc shape along the outer peripheral face of the piston 53 when the piston 53 is located at the top dead center viewed in plane.

In the present embodiment, the opening portion 61*c* is formed inclined with respect to the axial direction of the cylinder 52 in such a manner that the opening portion 61*c* extends in the direction in which the suction working chamber 60*a* stretches, as described with reference to FIG. 4A. In other words, the opening portion 61*c*, which is a link portion of the suction passage 61 to the suction working chamber 60*a*, extends inclined in the first closing member 56 in such a manner that the opening portion 61*c* becomes distanced from a reference plane BH including the central axis of the shaft 51 and a center line parallel to a longitudinal direction of the partition member 54 as the opening portion 61*c* approaches the suction working chamber 60*a*. This reduces variation in the flow direction of the refrigerant when the refrigerant is drawn into the suction working chamber 60*a*, allowing the refrigerant to be drawn into the suction working chamber 60*a* smoothly, as indicated by a dashed line arrow in FIG. 4B. Accordingly, it is possible to suppress a pressure loss caused by a rapid change in the flow direction of the refrigerant during the suction process of the refrigerant, and to improve the efficiency in recovering mechanical power.

Likewise, the opening portion 62*c* is formed inclined with respect to the axial direction of the cylinder 52 in such a manner that the opening portion 62*c* extends in the direction in which the discharge working chamber 60*b* stretches. In other words, the opening portion 62*c*, which is a link portion of the discharge passage 62 to the discharge working chamber 60*b*, extends inclined in the second closing member 57 in such a manner that the opening portion 62*c* is closer to the reference plane BH including the central axis of the shaft 51 and the center line parallel to the longitudinal direction of the partition member 54 as the opening portion 62*c* becomes distanced from the discharge working chamber 60*b*. This reduces variation in the flow direction of the refrigerant when the refrigerant is discharged from the discharge working chamber 60*b*, allowing the refrigerant to be discharged from the discharge working chamber 60*b* smoothly, as indicated by a dashed line arrow in FIG. 4B. Accordingly, it is possible to suppress a pressure loss caused by a rapid change in the flow direction of the refrigerant during the discharge process of the refrigerant, and to enhance the efficiency in recovering mechanical power.

By forming the suction passage 61 in the first closing member 56 while forming the discharge passage 62 in the second closing member 57 different from the first closing member 56, interference between the suction passage 61 and the discharge passage 62, which are relatively adjacent to each other when viewed in plane, is prevented, increasing the design freedom. This configuration particularly is effective when the suction passage 61 and the discharge passage 62 are inclined with respect to the axis of the cylinder 52, as described with reference to FIG. 4A.

The suction passage 61, in which the refrigerant has a relatively high temperature, is formed in the first closing member 56 close to the compressor 2, and the discharge passage 62, in which the refrigerant has a relatively low temperature, is formed in the second closing member 57 distal from the compressor 2. This makes it possible to minimize heat transfer from the compressor 2 to the fluid pressure motor 4. Accordingly, it is possible to suppress effectively a reduction in COP (coefficient of performance) of the refrigeration cycle due to a reduction in quantity of heat exchange in the first heat exchanger 3 and the second heat exchanger 5.

In the present embodiment, the discharge passage 62 has an opening area larger than that of the suction passage 61. In other words, the opening area of the discharge port 64 is set to be larger than the opening area of the suction port 63. Since the discharged refrigerant has a specific volume larger than that of the drawn refrigerant, the pressure loss at discharging the refrigerant becomes larger than the pressure loss drawing the refrigerant. According to the configuration in which the discharge port 64 is large, it is possible to reduce effectively the pressure loss when the refrigerant is discharged, as well as to reduce the pressure loss of the refrigerant as a whole. Thus, the efficiency in recovering mechanical power further can be enhanced.

From the viewpoint of suppressing the pressure loss when the refrigerant is discharged from the fluid pressure motor 4 more effectively, a plurality of the discharge ports 64 may be provided. From the same viewpoint, it is also effective to make the bore diameter of the discharge passage 62 larger than that of the suction passage 61 as described with reference to FIG. 4A.

The present embodiment employs the fluid pressure motor 4 that is single-cylinder rotary type without a drawing mechanism such as a valve system. Thereby, it is possible to recover mechanical power by a configuration simpler than in the case of using, for example, a conventional scroll type expander, a multi-stage rotary type expander, and a single-cylinder rotary type expander with the drawing mechanism. The present embodiment is less expensive, and capable of enhancing mechanical efficiency by reducing a quantity of sliding parts of the mechanism to reduce friction loss. Moreover, the present embodiment makes it easy to use components common with those of rotary type compressors, and thereby a further cost reduction also can be expected.

Embodiment 2

Embodiment 1 describes an example in which the shaft 51 of the fluid pressure motor 4 is coupled to the shaft 7 of the motor 6, and the energy recovered by the fluid pressure motor 4 is supplied to the compressor 2 directly. However, the present invention is not limited to this configuration, and the energy recovered by the fluid pressure motor 4 may be converted into electric energy once, for example. Embodiment 2 will describe an example of such a configuration. In the present embodiment, the description will be made also with reference to FIG. 3 as in Embodiment 1. Elements having substantially the same functions as those in Embodiment 1 are referred to by the same reference numerals, and the explanations thereof are omitted. It should be noted, however, the direction in which the refrigerant is drawn into the fluid pressure motor 4 is variable in the present embodiment, as described in detail below. Accordingly, the suction pipe 58 is referred to as a first connecting pipe 58, the discharge pipe 59 is referred to as a second connecting pipe 59, the suction passage 61 is referred to as a first passage 61, and the discharge passage 62 is referred to as a second passage 62.

Figure 9:
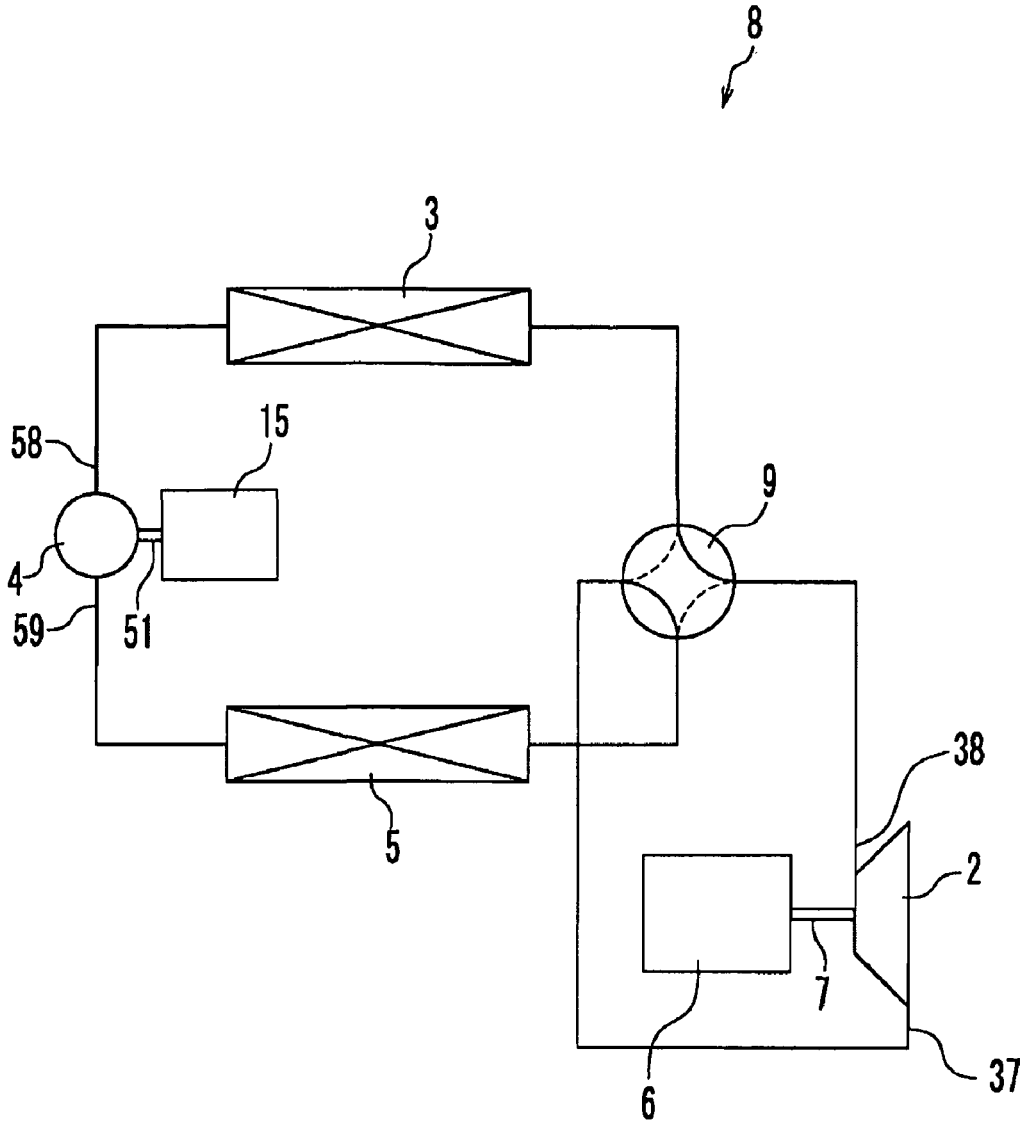
FIG. 9 is a configuration diagram of a refrigeration cycle apparatus according to Embodiment 2.
Figure 10:
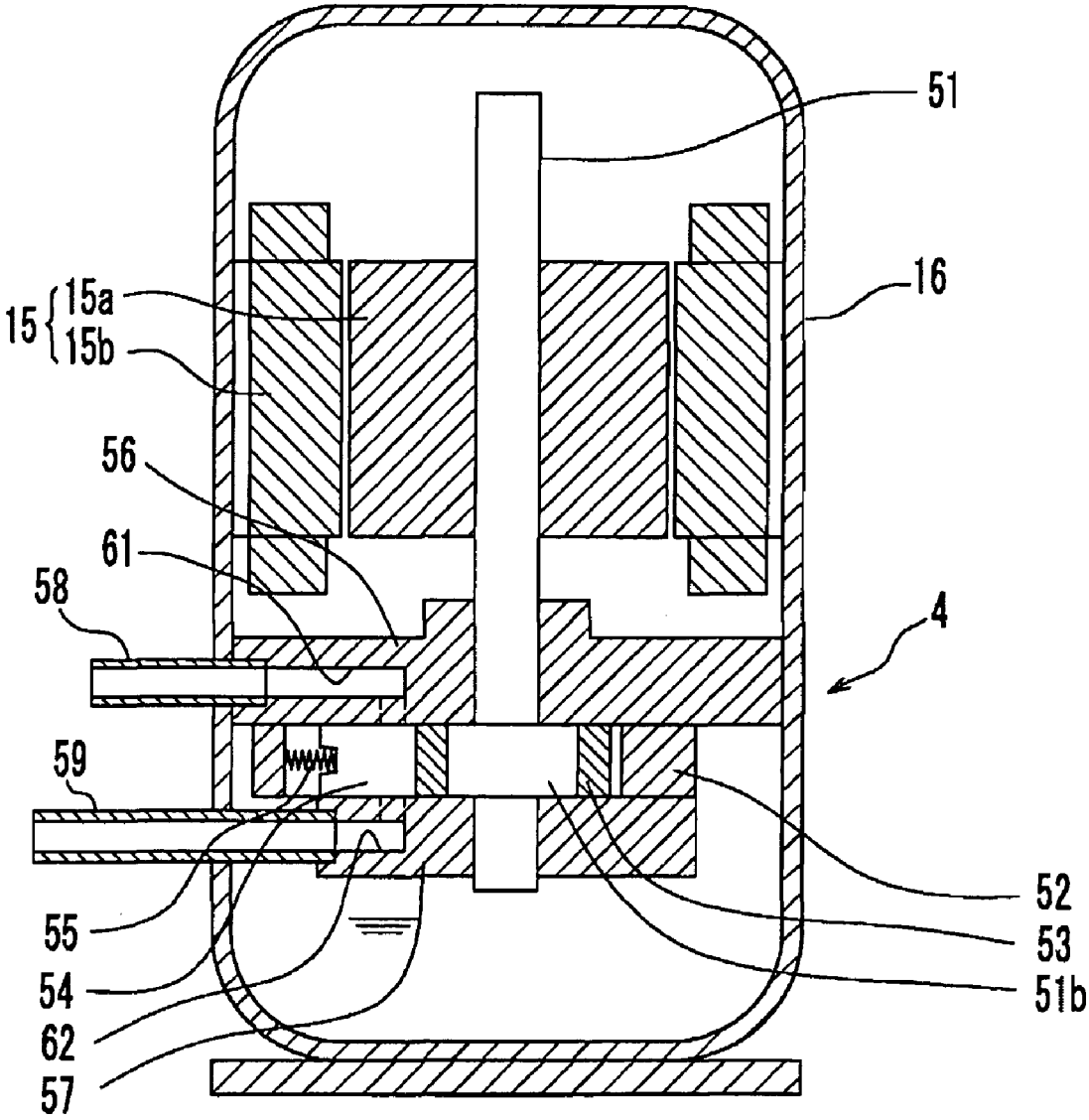
FIG. 10 is a vertical cross-sectional view of a fluid pressure motor including an electric generator according to Embodiment 2.

FIG. 9 is a configuration diagram of a power-recovery-type refrigeration cycle apparatus 8 according to Embodiment 2. FIG. 10 is a vertical cross-sectional view of the fluid pressure motor 4 of Embodiment 2 provided with an electric generator 15.

As described above, the refrigeration cycle apparatus 8 according to the present embodiment is different from the refrigeration cycle apparatus 1 according to Embodiment 1 in that the shaft 51 of the fluid pressure motor 4 is not coupled to the shaft 7 of the motor 6. In the present embodiment, the shaft 51 of the fluid pressure motor 4 is coupled to the electric generator 15, as shown in FIG. 9 and FIG. 10.

Specifically, the electric generator 15 is accommodated in a closed casing 16 together with the fluid pressure motor 4 to be made compact, as shown in FIG. 10. The electric generator 15 is provided with a cylindrical stator 15*b* attached to the closed casing 16 unrotatably and immovably. A cylindrical rotor 15*a* is disposed in the stator 15*b* rotatably with respect to the stator 15*b*. The rotor 15*a* has an outer diameter slightly smaller than an inner diameter of the stator 15*b*. The shaft 51 of the fluid pressure motor 4 is inserted and fixed in the rotor 15*a* in such a manner that it is unrotatable and incapable of up-and-down motions. The fluid pressure motor 4 is driven, the rotor 15*a* rotates relatively to the stator 15*b* as the shaft 51 rotates, and thereby electricity is generated. The electric generator 15 is designed so that it can generate electricity whether the shaft 51 rotates clockwise or counter clockwise.

Although not shown in FIG. 9 and FIG. 10, the electric generator 15 electrically is connected to a feed line to the motor 6 driving the compressor 2. Electric power generated by the electric generator 15 is supplied to the motor 6 and used as a part of mechanical power for driving the compressor 2.

In the present embodiment, a four-way valve 9 is provided in the refrigerant circuit as a switching mechanism capable of switching a flowing direction of the compressed refrigerant, as shown in FIG. 9. Accordingly, the flowing direction of the refrigerant having been compressed and discharged by the compressor 2 is variable.

Specifically, the suction port (the suction pipe 37) and the discharge port (the discharge pipe 38) of the compressor 2, the first heat exchanger 3, and the second heat exchanger 5 are connected to the four-way valve 9. Operating the four-way valve 9 makes it possible to switch between a first connection state (a connection state indicated by a solid line in FIG. 9) in which the discharge port of the compressor 2 is connected to the first heat exchanger 3 while the suction port of the compressor 2 is connected to the second heat exchanger 5, and a second connection state (a connection state indicated by a dashed line in FIG. 9) in which the discharge port of the compressor 2 is connected to the second heat exchanger 5 while the suction port of the compressor 2 is connected to the first heat exchanger 3.

In the second connection state, the refrigerant that has been compressed by the compressor 2 to the high temperature, high pressure state is supplied to the second heat exchanger 5. In this case, the second heat exchanger 5 functions as a gas cooler (a radiator), and the refrigerant is cooled in the second heat exchanger 5 to turn to the low temperature, high pressure state. The low temperature, high pressure refrigerant flows into the working chamber 60 from the second connecting pipe 59 of the fluid pressure motor 4 via the second passage 62. The refrigerant in the working chamber 60 is discharged to the first heat exchanger 3 side from the first connecting pipe 58 via the first passage 61. The refrigerant is heated and evaporated in the first heat exchanger 3, and then returns to the compressor 2 again. Thus, in the second connection state, the shaft 51 rotates in a direction opposite to that in the first connection state.

In the first connection state, the first heat exchanger 3 functions as the gas cooler (the radiator), and the second heat exchanger 5 functions as the evaporator in the same manner as in Embodiment 1. On the other hand, in the second connection state, the first heat exchanger 3 functions as the evaporator, and the second heat exchanger 5 functions as the gas cooler (the radiator), contrary to Embodiment 1. Accordingly, the refrigeration cycle apparatus 8 of Embodiment 2 enables both cooling and heating operations of cooling/heating equipment, for example.

As described above, when the connection state is switched from the first connection state to the second connection state, the shaft 51 of the fluid pressure motor 4 changes its rotational direction while the shaft 7 of the compressor 2 does not change its rotational direction, resulting in the shaft 7 rotating in a direction opposite to that of the shaft 51. Therefore, in a configuration in which the shaft 51 of the fluid pressure motor 4 is coupled to the shaft 7 of the compressor 2, and the shaft 7 and the shaft 51 always rotate in association with each other as in Embodiment 1, the first connection state and the second connection state cannot be switched therebetween. Thus, the flowing direction of the refrigerant compressed by the compressor 2 cannot be changed by a mere introduction of the single four-way valve 9 to Embodiment 1.

In contrast, in a configuration in which the shaft 7 and the shaft 51 rotate independently as in the present embodiment, it also is possible to allow the shaft 7 and the shaft 51 to rotate in directions opposite to each other. More specifically, with a configuration in which the four-way valve 9 is provided and the electric generator 15 generates electricity while being connected to the shaft 51, it is possible to realize cooling/heating equipment (such as a cooling/heating air conditioner) capable of recovering mechanical power and performing both cooling and heating.

In an expander with a specific volumetric capacity ratio, the refrigerant needs to flow in a direction that increases the volumetric capacity of the working chamber, and is not allowed to flow in an direction opposite to it. Therefore, a mere replacement of an expansion valve with the expander cannot realize a configuration capable of switching between a plurality of connection states like the present embodiment. In contrast, it is possible to realize a cooling/heating air conditioner capable of recovering the internal energy highly efficiently only by using the fluid pressure motor instead of the expansion valve as described above because the flowing direction of the refrigerant is not fixed in the fluid pressure motor. There also is an advantage that a single four-way valve is sufficient for changing the flowing direction of the refrigerant.

So far, examples have been described in which the single cylinder, rotary type fluid pressure motor is used as a power recovery means, as Embodiments 1 and 2. However, the switching mechanism for switching between the first state and the second state is not limited to the four-way valve, and may be a bridge circuit, for example.

The fluid pressure motor is not limited to this configuration, and may be a multiple cylinder, rotary type fluid pressure motor, for example. Furthermore, it may be a fluid pressure motor other than rotary type fluid pressure motors, for example, a scroll type fluid pressure motor.

Modified Example 1 below describes an example in which a dual-cylinder, rotary type fluid pressure motor is used, as a modified example of Embodiment 2. Modified Example 2 describes a scroll type fluid pressure motor substitutable for the rotary type fluid pressure motors described in Embodiments 1 and 2. The description of Modified Example 1 below will be made also with reference to FIG. 9 as in Embodiment 2. The elements having substantially the same functions as those in Embodiments 1 and 2 are referred to by the same reference numerals, and the explanations thereof are omitted.

Modified Example 1

Figure 11:
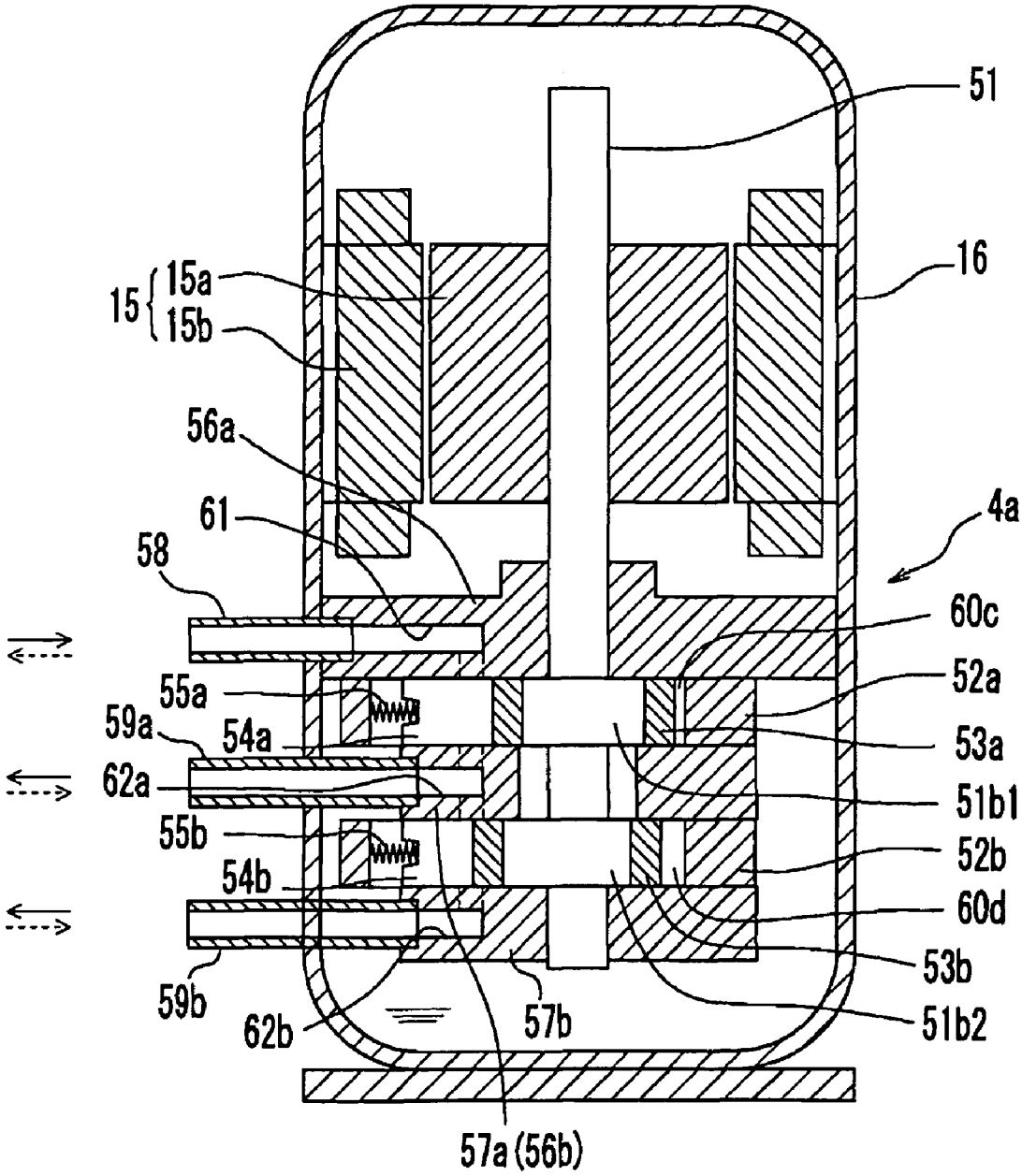
FIG. 11 is a vertical cross-sectional view of a fluid pressure motor including an electric generator according to Modified Example 1.

FIG. 11 is a vertical cross-sectional view of a fluid pressure motor 4*a* including the electric generator 15 according to Modified Example 1. The fluid pressure motor 4*a* is a dual-cylinder type fluid pressure motor provided with two cylinders 52*a* and 52*b*.

In Modified Example 1, the shaft 51 is provided with two eccentric portions 51*b*1 and 51*b*2. A piston 53*a* is attached to the eccentric portion 51*b*1 while being off-centered. The piston 53*a* is accommodated in the cylinder 52*a* with both ends closed by closing members 56*a* and 57*a*. A working chamber 60*c* is formed by the piston 53*a*, the closing member 56*a*, the closing member 57*a*, and the cylinder 52*a*. The working chamber 60*c* is partitioned into two spaces (a suction working chamber and a discharge working chamber) by a partition member 54*a* that is pushed in a direction toward the piston 53*a* by a spring 55*a*.

On the other hand, a piston 53*b* is attached to the eccentric portion 51*b*2 while being off-centered. The piston 53*b* is accommodated in the cylinder 52*b* with both ends closed by a closing member 56*b* (common with the closing member 57*a*) and a closing member 57*b*. A working chamber 60*d* is formed by the piston 53*b*, the closing members 56*b* and 57*b*, and the cylinder 52*b*. The working chamber 60*d* is partitioned into two spaces (a suction working chamber and a discharge working chamber) by a partition member 54*b* that is pushed in a direction toward the piston 53*b* by a spring 55*b*.

The first passage 61 is formed in the closing member 56*a*. The first passage 61 is connected to one end of the first connecting pipe 58, another end of which is connected to the first heat exchanger 3. The first passage 61 is in communication with one of the two spaces created by partitioning the working chamber 60*c* by the partition member 54*a*, as well as one of the two spaces created by partitioning the working chamber 60*d* by the partition member 54*b*.

A second passage 62*a* is formed in the closing member 57*a*. The second passage 62*a* is connected to one end of a second connecting pipe 59*a*, another end of which is connected to the second heat exchanger 5. The second passage 62*a* is in communication with the other one of the two spaces created by partitioning the working chamber 60*c* by the partition member 54*a*. On the other hand, a second passage 62*b* is formed in the closing member 57*b*. The second passage 62*b* is connected to a second connecting pipe 59*b*. The second passage 62*b* is in communication with the other one of the two spaces created by partitioning the working chamber 60*d* by the partition member 54*b*. The second connecting pipe 59*b* is connected to the second heat exchanger 5 together with the second connecting pipe 59*a*.

In the first connection state described with reference to FIG. 9, the refrigerant coming from the first heat exchanger 3 is supplied to both of the working chambers 60*c* and 60*d* from the first connecting pipe 58 via the first passage 61, as indicated by a solid line arrow in FIG. 11. Then, the refrigerant in the working chamber 60*c* is discharged to the second heat exchanger 5 side from the second connecting pipe 59*a* via the second passage 62*a*. On the other hand, the refrigerant in the working chamber 60*d* is discharged to the second heat exchanger 5 side from the second connecting pipe 59*b* via the second passage 62*b*. In the second connection state, the refrigerant flows in the directions indicated by dashed line arrows.

In this way, the fluid pressure motor 4*a* according to Modified Example 1 is configured in such a manner that the common first passage 61 is in communication with the one of the two spaces created by partitioning the working chamber 60*c* by the partition member 54*a*, as well as the one of the two spaces obtained by partitioning the working chamber 60*d* by the partition member 54*b*. It should be noted, however, that, the fluid pressure motor 4*a* according to Modified Example 1 may be configured in such a manner that the first passages different from each other are in communication with the working chambers 60*c* and 60*d*, respectively. That is, the dedicated first passage may be provided for each of the working chambers 60*c* and 60*d*.

In Modified Example 1, the pistons 53*a* and 53*b* are disposed in such a manner that their top dead centers are located at a constant interval in the rotational direction of the shaft 51. Specifically, the two pistons 53*a* and 53*b* are disposed facing each other in such a manner that their top dead centers are located at a constant interval in the rotational direction of the shaft 51. Accordingly, a phase of the piston 53*a* is shifted ½ period from a phase of the piston 53*b*.

According to the aforementioned configuration, the pistons 53*a* and 53*b* mutually can cancel their torque variations. Thereby, rotation of the fluid pressure motor 4*a* is more stabilized, allowing vibration and noise to be reduced. In a fluid pressure motor, in particular, the refrigerant pressure changes rapidly from a suction pressure to a discharge pressure at start of the discharge process, so vibration and noise caused by the discharge tend to be larger than in an expander having an expansion process. Thus, use of two cylinders exhibits remarkable effect as in Modified Example 1.

Three or more cylinders may be provided. In that case, the cylinders preferably are arranged in such a manner that their top dead centers are located at a constant interval in the rotational direction of the shaft 51. Specifically, when three cylinders are provided, they preferably are arranged in such a manner that they are shifted 120° from each other.

Modified Example 2

Figure 12:
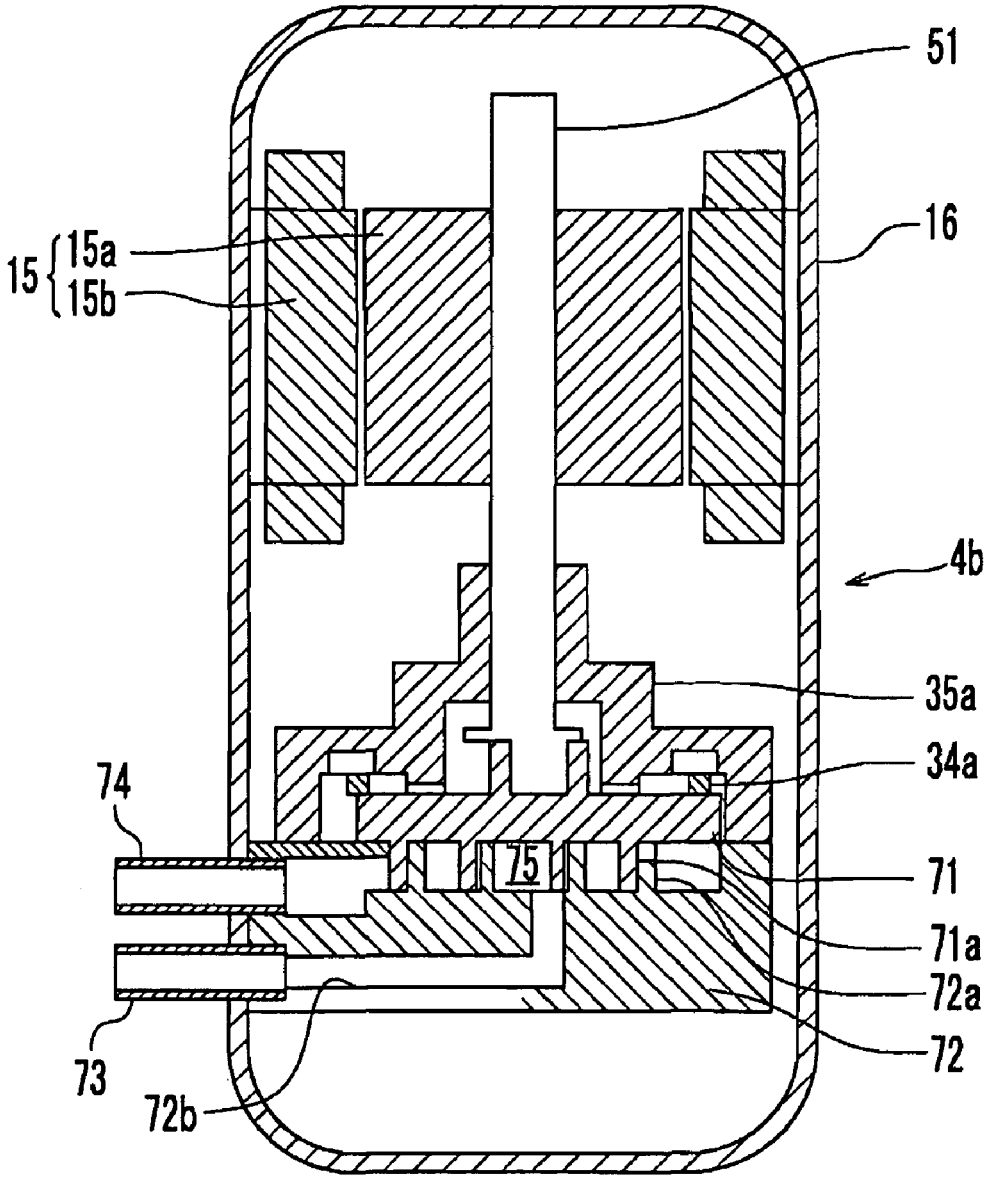
FIG. 12 is a cross-sectional view showing a configuration of a fluid pressure motor according to Modified Example 2.
Figure 13:
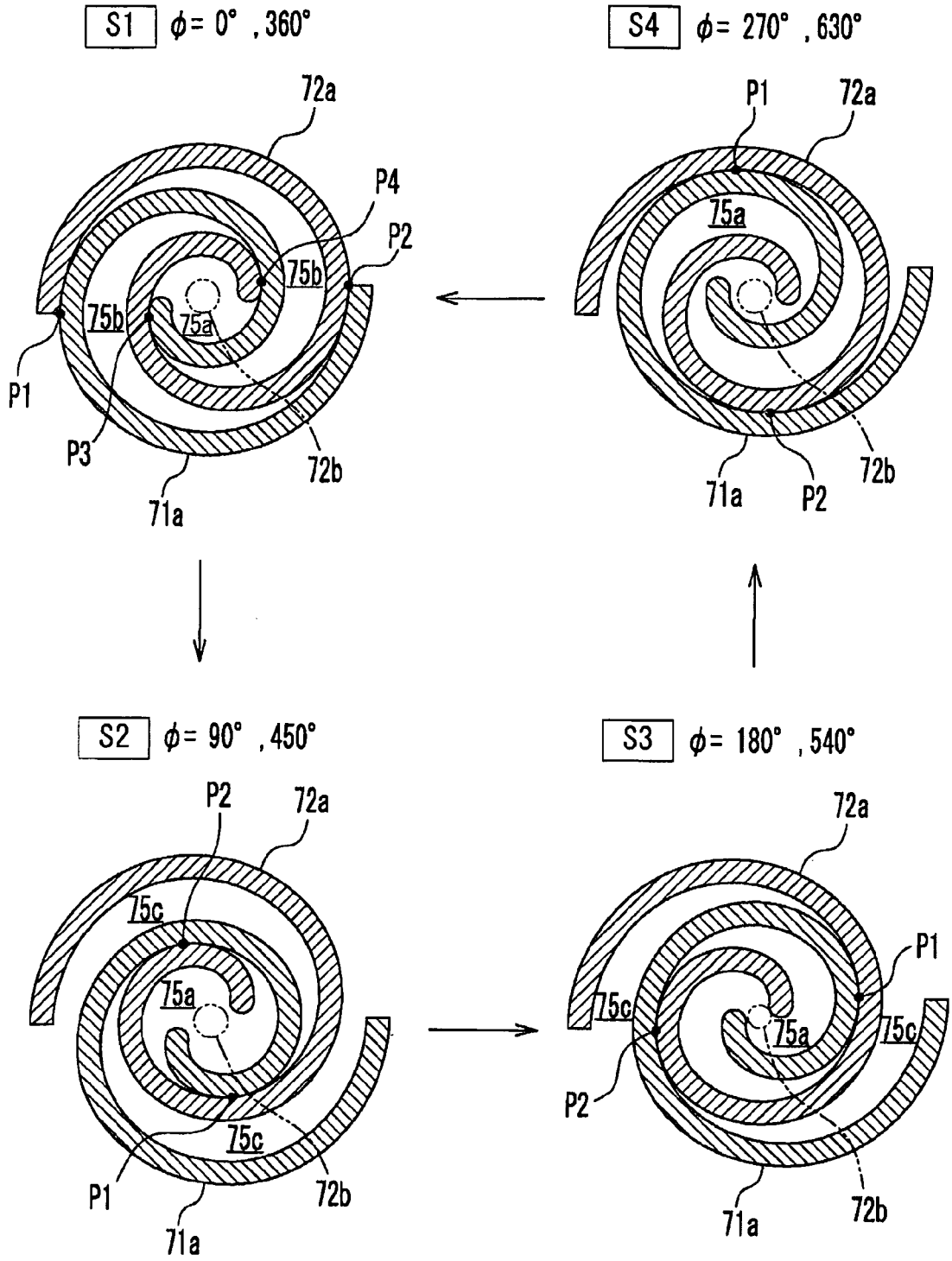
FIG. 13 is a view showing an operation principle of the fluid pressure motor according to Modified Example 2.

Modified Example 2 will describe an example of the scroll type fluid pressure motor with reference to FIG. 12 and FIG. 13. In the description of Modified Example 2, the elements having substantially the same functions as those in Embodiments 1, 2, and Modified Example 1 are referred to by the same reference numerals, and the explanations thereof are omitted.

—Configuration of Scroll Type Fluid Pressure Motor 4*b*—

A fluid pressure motor 4*b* includes an orbiting scroll 71, a stationary scroll 72, an Oldham ring 34*a*, a bearing member 35*a*, a suction pipe 73, and a discharge pipe 74, as shown in FIG. 12.

The stationary scroll 72 is attached to the closed casing 16 immovably and unrotatably. An involute-shaped lap 72*a* is formed on an upper surface of the stationary scroll 72. The orbiting scroll 71 is disposed facing the stationary scroll 72. An involute-shaped lap 71*a* meshing with the lap 72*a* is formed on a surface of the orbiting scroll 71 facing the stationary scroll 72. A working chamber 75 is formed by the laps 72*a* and 71*a*.

An eccentric portion that is provided at the lower end of the shaft 51 is inserted, fitted, and fixed in a central part of an upper portion of the orbiting scroll 71. The eccentric portion has a central axis different from that of the shaft 51. The Oldham ring 34*a* is disposed on an upper side of the orbiting scroll 71. The Oldham ring 34*a* restrains rotation of the orbiting scroll 71. By the function of the Oldham ring 34*a*, the orbiting scroll 71 scrolls as the shaft 51 rotates while being off-centered with respect to the central axis of the shaft 51.

The stationary scroll 72 has a suction passage 72*b* that is freely opened/closed relative to a central part of the working chamber 75 viewed in plane, and is connected to the suction pipe 73 communicating with outside of the closed casing 16. The refrigerant is drawn into the working chamber 75 via the suction passage 72*b*.

—Operation Principle of the Scroll Type Fluid Pressure Motor 4*b*—

Next, the operation principle of the fluid pressure motor 4*b* will be described with reference to FIG. 13. FIG. 13 shows four states from S1 to S4. In the description, ϕ denotes the rotation angle of the shaft 51, and S1 is a state in which ϕ=0°.

In the state of 51, a start edge of the lap 72*a* is in contact with an inner peripheral face of the lap 71*a*, and a start edge of the lap 71*a* is in contact with an inner peripheral face of the lap 72*a*. A suction working chamber 75*a* communicating with the suction passage 72*b* is formed by the stationary scroll 72 and the orbiting scroll 71.

As the orbiting scroll 71 scrolls and the rotation angle ϕ increases, points of contact P1 and P2 between the orbiting scroll 71 and the stationary scroll 72 move outward, and the suction working chamber 75*a* increases its volumetric capacity while drawing the refrigerant thereinto from the suction passage 72*b* (suction process, see S2 to S4).

The suction process ends when it returns to the state of S1 again, that is, when ϕ=360°. More specifically, the point of contact P1 is located at an end edge of the lap 72*a* of the stationary scroll 72, and the point of contact P2 is located at an end edge of the lap 71*a* of the orbiting scroll 71. In addition, the orbiting scroll 71 and the stationary scroll 72 are in contact with each other also at points of contact P3 and P4 located inside of the points of contact P1 and P2, as shown in 51. This blocks the suction working chamber 75*a* from the suction passage 72*b*, creating two isolated, crescent-shaped working chambers 75*b*.

When the rotation angle ϕ exceeds 360°, the points of contact P1 and P2 disappear. More specifically, the end edge of the lap 71*a* of the orbiting scroll 71 is separated from the lap 72*a* of the stationary scroll 72, and the end edge of the lap 72*a* of the stationary scroll 72 is separated from the lap 71*a* of the orbiting scroll 71. Thereby, both of the two isolated working chambers 75*b* are brought into communication with the discharge pipe 74, and they turn into a discharge working chamber 75*c*. The discharge working chamber 75*c* reduces its volumetric capacity as the rotation angle ϕ increases further, beyond 360°. Accordingly, the refrigerant in the discharge working chamber 75*c* is discharged from the discharge pipe 74 (discharge process).

As described above, the orbiting scroll 71 and the stationary scroll 72 are in contact with each other at the four points of contact P1 to P4 only at a moment when ϕ=0°, isolating the working chamber. During the whole period except for that moment, the orbiting scroll 71 and the stationary scroll 72 are in contact with each other at the two points of contact P1 and P2, and the suction working chamber 75*a* always is in communication with the suction passage 72*b* while the discharge working chamber 75*b* always is in communication with the discharge pipe 74. When thus configured, the scroll type fluid pressure motor 4*b* is realized.

When the scroll type fluid pressure motor 4*b* described in Modified Example 2 is used as the power recovery means of the refrigeration cycle apparatus, efficient mechanical power recovery also is realized as in the cases where the rotary type fluid pressure motors described in the aforementioned embodiments are used. Accordingly, it is possible to realize a refrigeration cycle apparatus that can be operated with high energy efficiency.

Moreover, the flowing direction of the refrigerant is not fixed in the scroll type fluid pressure motor 4*b* described in Modified Example 2 either, as in the rotary type fluid pressure motor 4 described in Embodiments 1 and 2. That is, the scroll type fluid pressure motor 4*b* also can be operated in such a manner that the suction port and the discharge port are switched therebetween. Thus, the fluid pressure motor 4*b* of Modified Example 2 can be used instead of the fluid pressure motor 4 of Embodiment 2.

Embodiment 3

The present embodiment has a configuration in which a supercharger composed of a fluid pressure motor is disposed between the evaporator and the compressor, and the supercharger is driven by mechanical power recovered by a power recovery means composed of a fluid pressure motor. Energy efficiency of the refrigeration cycle apparatus can be enhanced by providing the refrigeration cycle apparatus with the power recovery means and the supercharger driven by the mechanical power recovered by the power recovery means in such a manner. In addition, the refrigeration cycle apparatus is allowed to have a simple and inexpensive configuration by constituting each of the supercharger and the power recovery means by a fluid pressure motor with a relatively simple configuration compared to that of the compressor or the expander. The fluid pressure motor used in the present embodiment has a basic structure common with that of the fluid pressure motor described in the aforementioned embodiments.

Hereinafter, the refrigeration cycle apparatus according to the present embodiment will be described in detail with reference to FIG. 14 to FIG. 25.

—Outline of Refrigeration Cycle Apparatus 101—

Figure 14:
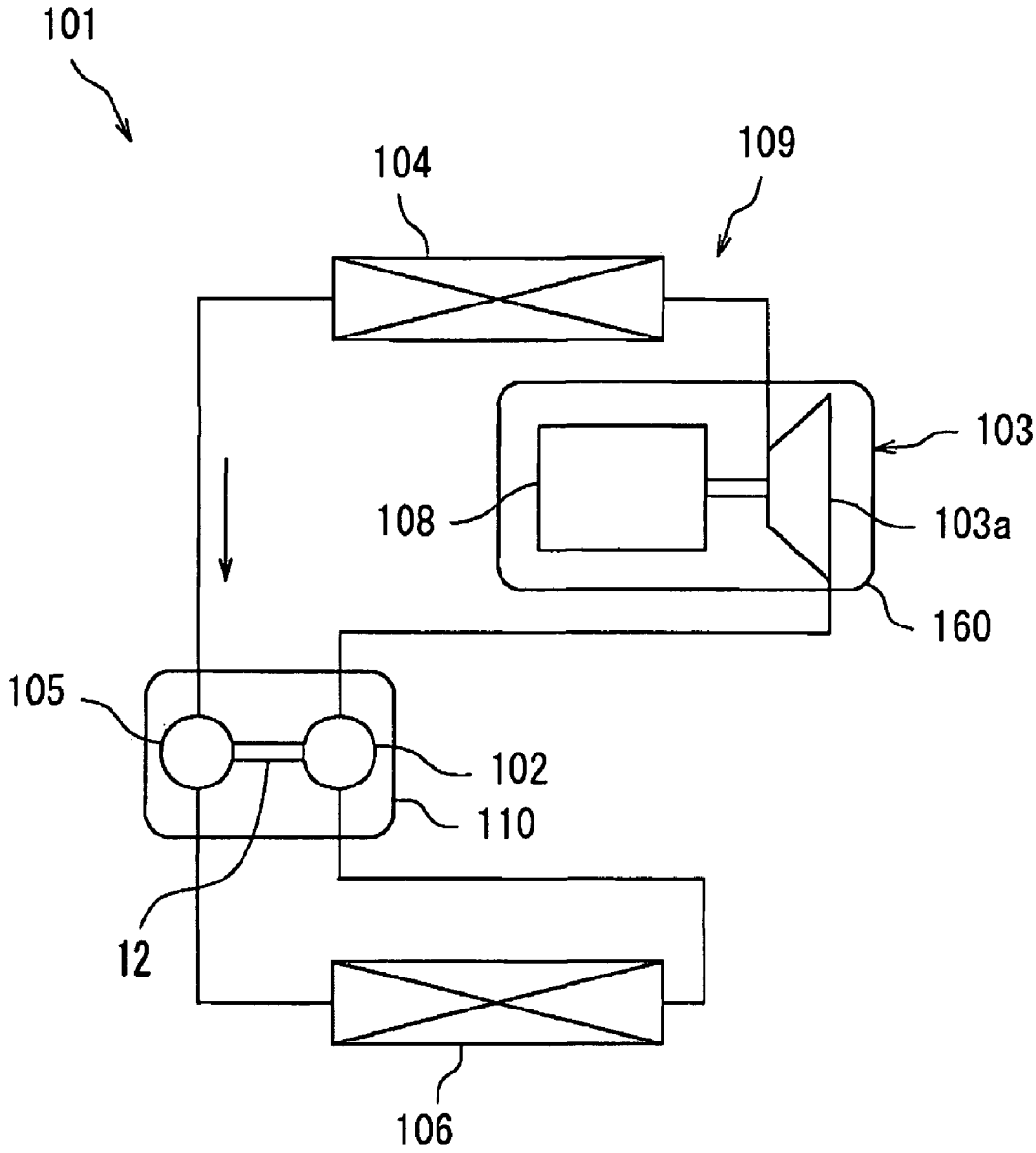
FIG. 14 is a configuration diagram of a refrigeration cycle apparatus according to Embodiment 3.

FIG. 14 is a configuration diagram of the refrigeration cycle apparatus 101 according to the present embodiment. The refrigeration cycle apparatus 101 includes a refrigerant circuit 109 having a compressor 103, a gas cooler 104, a power recovery means 105, an evaporator 106, and a supercharger 102. The refrigerant filled in the refrigerant circuit 109 is, for example, carbon dioxide and hydrofluorocarbon. As described above, the present invention exhibits excellent effect particularly when using a refrigerant that reaches a supercritical state on the high-pressure side of the refrigeration cycle, such as carbon dioxide.

The compressor 103 includes a compression mechanism 103*a* (a compressor main body), a motor 108 connected to the compression mechanism 103*a*, and a casing 160 that accommodates the compression mechanism 103*a* and the motor 108. The compression mechanism 103*a* is driven by the motor 108. The compression mechanism 103*a* compresses the refrigerant circulating in the refrigerant circuit 109 to a high temperature, high pressure state. The compression mechanism 103*a* may be, for example, the scroll type compressor or the rotary type compressor.

The gas cooler (radiator) 104 is connected to the compressor 103. The gas cooler 104 allows the refrigerant compressed by the compressor 103 to radiate heat. In other words, the gas cooler 104 cools the refrigerant compressed by the compressor 103. The refrigerant cooled by the gas cooler 104 is in the low temperature, high pressure state.

The power recovery means 105 is connected to the gas cooler 104. The power recovery means 105 is composed of the fluid pressure motor. Specifically, the power recovery means 105 performs a process for drawing the refrigerant coming from the gas cooler 104 and a process for discharging the drawn refrigerant. These processes are performed substantially continuously. That is, the power recovery means 105 draws the refrigerant that was brought into the low temperature, high pressure state by the gas cooler 104, and discharges the refrigerant to the evaporator 106 side substantially without changing the volume of the refrigerant. The compressor 103 causes the gas cooler 104 side from power recovery means 105 to have a relatively high pressure, and causes the evaporator 106 side from the power recovery means 105 to have a relatively low pressure. Accordingly, the refrigerant drawn into the power recovery means 105 is expanded when being discharged from the power recovery means 105, and its pressure is lowered.

The evaporator 106 is connected to the power recovery means 105. The evaporator 106 heats and evaporates the refrigerant coming from the power recovery means 105.

The supercharger 102 is disposed between the evaporator 106 and the compressor 103. The supercharger 102 is coupled to the power recovery means 105 by a shaft 12. The supercharger 102 is driven by mechanical power recovered by the power recovery means 105. Like the power recovery means 105, the supercharger 102 is composed of the fluid pressure motor. The supercharger 102 performs a process for drawing thereinto the refrigerant coming from the evaporator 106 and a process for discharging the drawn refrigerant to the compressor 103 side. These processes are performed substantially continuously. The supercharger 102 draws thereinto the refrigerant coming from the evaporator 106, and discharges the refrigerant to the compressor 103 side substantially without changing the volume of the refrigerant. The refrigerant from the evaporator 106 somewhat increases its pressure by being discharged from the supercharger 102. The refrigerant with the somewhat increased pressure is compressed by the compressor 103, and turns to the high temperature, high pressure state again.

—Specific Configuration of the Refrigeration Cycle Apparatus 101—

—Fluid Machine 110—

Figure 15:
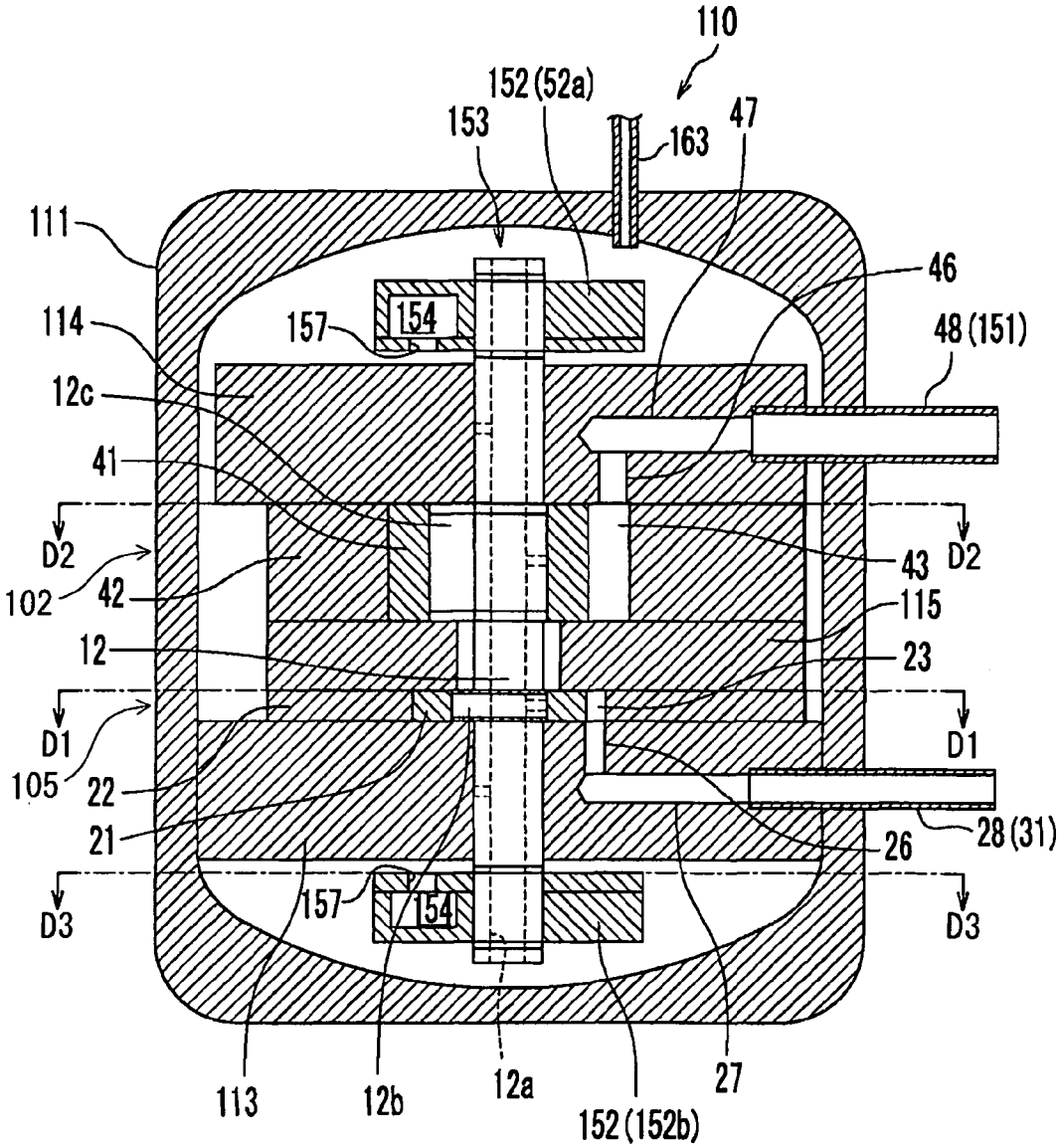
FIG. 15 is a cross-sectional view of a fluid machine shown in FIG. 14.

As shown in FIG. 15, the power recovery means 105 and the supercharger 102 constitute a single fluid machine 110. The fluid machine 110 has a closed casing 111 filled with the refrigeration oil. The power recovery means 105 and the supercharger 102 are disposed in the closed casing 111. Thereby, the refrigeration cycle apparatus 101 is made compact.

(Configuration of the Power Recovery Means 105)

The power recovery means 105 is disposed at a lower part of the closed casing 111. The present embodiment describes an example in which the power recovery means 105 is composed of a rotary type fluid pressure motor. It should be noted, however, that the power recovery means 105 may be composed of a fluid pressure motor other than rotary type fluid pressure motors, such as the scroll type fluid pressure motor shown in FIG. 12.

The power recovery means 105 includes a first closing member 115 and a second closing member 113. The first closing member 115 and the second closing member 113 are facing each other. A first cylinder 22 is disposed between the first closing member 115 and the second closing member 113. The first cylinder 22 has an internal space of a substantially cylindrical shape. The internal space of the first cylinder 22 is closed by the first closing member 115 and the second closing member 113.

The shaft 12 penetrates through the first cylinder 22 in an axial direction of the first cylinder 22. The shaft 12 is disposed on a central axis of the first cylinder 22. The shaft 12 is supported by the second closing member 113 and a third closing member 114 to be described later. The shaft 12 has an oil supply hole 12*a* penetrating therethrough in an axial direction thereof. The refrigeration oil in the closed casing 111 is supplied to bearings, gaps, etc. in the supercharger 102 and the power recovery means 105 via the oil supply hole 12*a*.

A first piston 21 is disposed in the substantially cylindrical internal space formed by an inner peripheral face of the first cylinder 22, the first closing member 115, and the second closing member 113. The first piston 21 is fit around the shaft 12 while being off-centered with respect to a central axis of the shaft 12. Specifically, the shaft 12 is provided with an eccentric portion 12*b* having a central axis different from that of the shaft 12. The tubular first piston 21 is fit around the eccentric portion 12*b*. Thus, the first piston 21 is off-centered with respect to the central axis of the first cylinder 22. Accordingly, the first piston 21 rotates eccentrically as the shaft 12 rotates.

Figure 16:
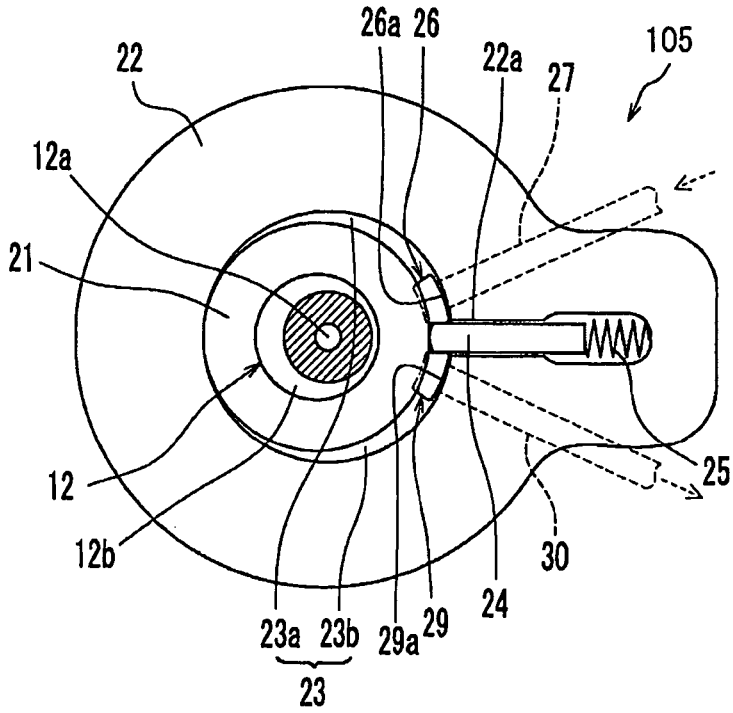
FIG. 16 is a fragmentary view taken along line D1-D1 in FIG. 15.

A first working chamber 23 is formed in the first cylinder 22 by the first piston 21, the inner peripheral face of the first cylinder 22, the first closing member 115, and the second closing member 113 (see FIG. 16 as well). The first working chamber 23 has a volumetric capacity that is substantially invariable even when the first piston 21 rotates in association with the shaft 12.

As shown in FIG. 16, a linear groove 22*a* opening to the first working chamber 23 is formed in the first cylinder 22. A plate-like first partition member 24 is disposed slidably in the linear groove 22*a*. A pushing means 25 is disposed between the first partition member 24 and a bottom portion of the linear groove 22*a*. The first partition member 24 is pressed toward an outer peripheral face of the first piston 21 by the pushing means 25. Thereby, the first working chamber 23 is partitioned into two spaces. More specifically, the first working chamber 23 is partitioned into a high-pressure side suction working chamber 23*a* and a low-pressure side discharge working chamber 23*b*.

The pushing means 25 may be composed of a spring, for example. Specifically, the pushing means 25 may be a compression coil spring.

Moreover, the pushing means 25 may be a so-called gas spring. In other words, when the first partition member 24 slides in a direction that reduces a volume of a back space of the first partition member 24, a pressure in the back space is set higher than a pressure in the first working chamber 23, and this pressure difference can cause a pressing force to press the first partition member 24 toward the first piston 21. For example, the back space of the first partition member 24 is a closed space, and an opposing force can be applied to the first partition member 24 when the volume of the back space is reduced due to a backward movement of the first partition member 24. The pushing means 25 may be composed of two or more types of springs, such as the compression coil spring and the gas spring, of course. It should be noted that the pressure in the first working chamber 23 means an average pressure between a pressure in the suction working chamber 23*a* and a pressure in the discharge working chamber 23*b*. The back space means a space formed between a rear end of the first partition member 24 and the bottom portion of the linear groove 22*a*.

As shown in FIG. 16, a suction passage 27 opens to a portion of the suction working chamber 23*a* adjacent to the first partition member 24. As shown in FIG. 15, the suction passage 27 is formed in the second closing member 113 located under the first cylinder 22. As shown in FIG. 15, the suction passage 27 is in communication with a suction pipe 28. The high pressure refrigerant coming from the gas cooler 104 shown in FIG. 14 is guided to the suction working chamber 23*a* via the suction pipe 28 and the suction passage 27.

An opening (suction port) 26 of the suction passage 27 (first suction passage) to the suction working chamber 23*a* is formed in a substantially fan shape extending, in an arc shape, from the portion of the suction working chamber 23*a* adjacent to the first partition member 24 in a direction in which the suction working chamber 23*a* stretches. The suction port 26 is closed completely by the first piston 21 when the first piston 21 is located at a top dead center thereof. At least a part of the suction port 26 is exposed to the suction working chamber 23*a* during the whole period except for the moment at which the first piston 21 is located at the top dead center. Specifically, an outer edge side 26*a* of the suction port 26 is formed in an arc shape along the outer peripheral face of the first piston 21 when the first piston 21 is located at the top dead center viewed in plane. In other words, the outer edge side 26*a* is formed in an arc shape having a radius substantially the same as the outer peripheral face of the first piston 21.

On the other hand, a discharge passage 30 (first discharge passage) opens to a portion of the discharge working chamber 23*b* adjacent to the first partition member 24. Like the suction passage 27, the discharge passage 30 also is formed in the second closing member 113, as shown in FIG. 15. The discharge passage 30 is in communication with a discharge pipe 31 (see FIG. 15). Thereby, the refrigerant in the discharge working chamber 23*b* is discharged to the evaporator 106 side via the discharge passage 30 and the discharge pipe 31. Reference numerals 31 and 28 are written side by side in FIG. 15 because the discharge pipe 31 is located behind the suction pipe 28 on the drawing. This does not mean, however, that the suction pipe 28 and the discharge pipe 31 are composed of a common pipe.

An opening (discharge port) 29 of the discharge passage 30 to the discharge working chamber 23*b* is formed in a substantially fan shape extending, in an arc shape, from the portion of the discharge working chamber 23*b* adjacent to the first partition member 24 in a direction in which the discharge working chamber 23*b* stretches. The discharge port 29 is closed completely by the first piston 21 when the first piston 21 is located at the top dead center. At least a part of the discharge port 29 is exposed to the discharge working chamber 23*b* during the whole period except for the moment at which the first piston 21 is located at the top dead center. Specifically, an outer edge side 29*a* of the discharge port 29, which is located outside with respect to a radial direction of the first cylinder 22, is formed in an arc shape along the outer peripheral face of the piston 21 when the piston 21 is located at the top dead center viewed in plane. In other words, the outer edge side 29*a* is formed in an arc shape having a radius substantially the same as that of the outer peripheral face of the first piston 21.

In this way, the power recovery means 105 has almost the same configuration as that of the rotary type fluid pressure motors described in the previous embodiments. The top dead center also is as described in Embodiment 1.

Figure 18:
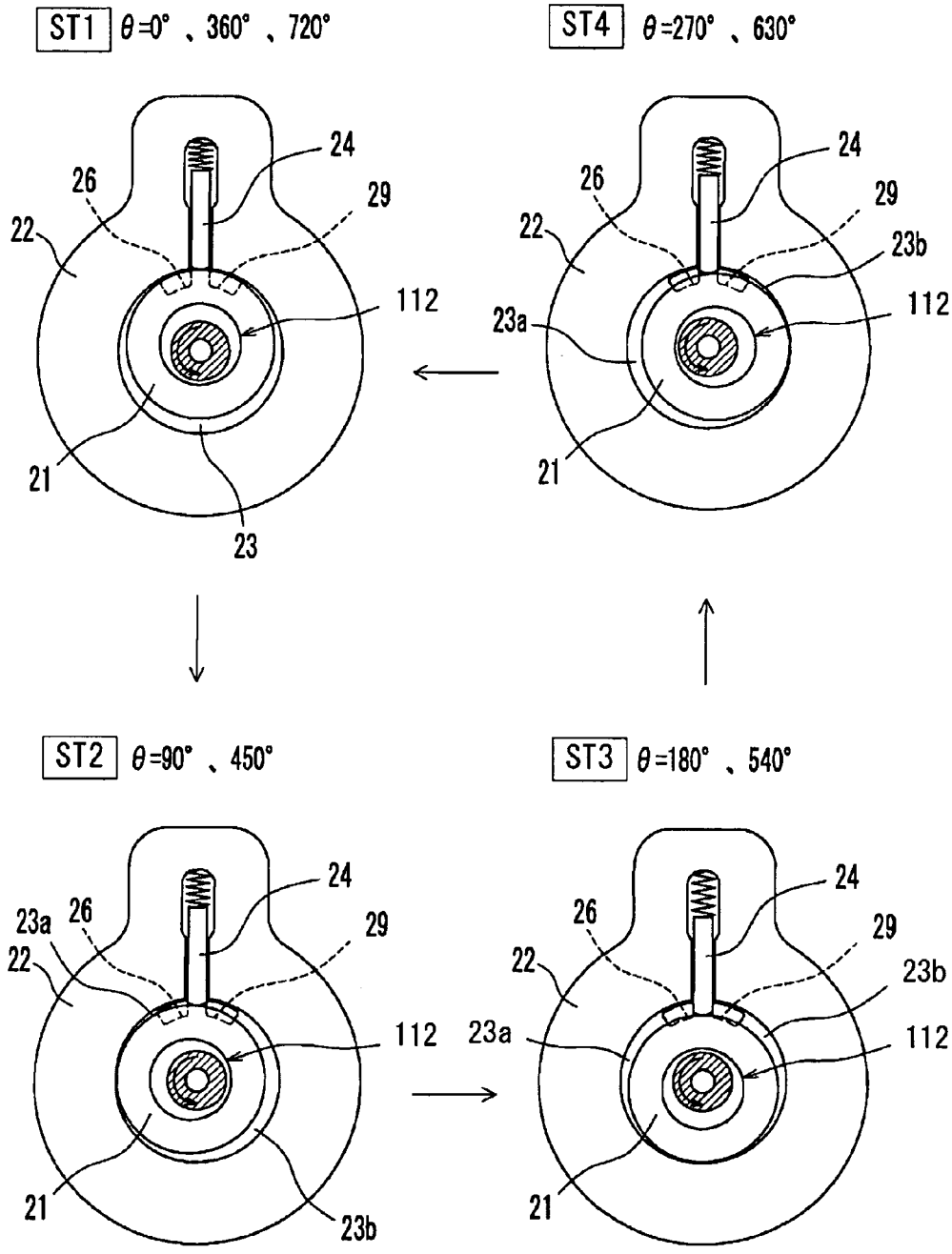
FIG. 18 is a view showing an operation principle of the fluid pressure motor.

By forming the suction passage 27 and the discharge passage 30 as mentioned above, both of the suction port 26 and the discharge port 29 are closed completely only at the moment when the first piston 21 is located at the top dead center, as shown in the upper left view (ST1) of FIG. 18. That is, both of the suction port 26 and the discharge port 29 are closed completely at a moment when the first working chamber 23 appears as a single chamber. More specifically, the suction working chamber 23*a* is in communication with the suction passage 27 until a moment at which the suction working chamber 23*a* is brought into communication with the discharge passage 30. After the moment at which the suction working chamber 23*a* is brought into communication with the discharge passage 30 to turn the suction working chamber 23*a* into the discharge working chamber 23*b*, the suction port 26 is closed by the first piston 21. Thereby, a direct flow of the refrigerant from the suction passage 27 to the discharge passage 30 is suppressed. And efficient mechanical power recovery is realized, accordingly.

From the viewpoint of forbidding completely the direct flow of the refrigerant from the suction passage 27 to the discharge passage 30, it is preferable that both of the suction port 26 and the discharge port 29 are closed at the moment when the first piston 21 is located at the top dead center. However, even in the case where only one of the suction port 26 and the discharge port 29 is closed at the moment when the first piston 21 is located at the top dead center, the direct flow between the suction passage 27 and the discharge passage 30 substantially does not occur as long as a gap between a timing at which the suction port 26 is closed and a timing at which the discharge port 29 is closed is smaller than approximately 10° in terms of the rotation angle of the shaft 12. In other words, the direct flow of the refrigerant from the suction passage 27 to the discharge passage 30 can be suppressed by setting the gap between the timing at which the suction port 26 is closed and the timing at which the discharge port 29 is closed smaller than approximately 10° in terms of the rotation angle of the shaft 12. This is the case also for Embodiment 1 and Embodiment 2.

As described above, the suction working chamber 23*a* always is in communication with the suction passage 27. The discharge working chamber 23*b* always is in communication with the discharge passage 30. In other words, the suction process for drawing the refrigerant and the discharge process for discharging the drawn refrigerant are performed substantially continuously in the power recovery means 105. Accordingly, the drawn refrigerant passes through the power recovery means 105 substantially without changing its volume.

(Operation of the Power Recovery Means 105)

FIG. 18 is a view showing an operation principle of the power recovery means 105, showing four states from ST1 to ST4. As is apparent from a comparison between FIG. 18 and FIG. 5, the description of the fluid pressure motor in Embodiment 1 can be used to describe the operation principle of the power recovery means 105.

When the first piston 21 rotates and the suction port 26 opens, a volumetric capacity of the suction working chamber 23*a* is increased by the high-pressure refrigerant flowing from the suction port 26, as shown in FIG. 18 (ST2 to ST4). In association with the increase in volumetric capacity of the suction working chamber 23*a*, a rotation torque applied to the first piston 21 makes a part of a rotation driving force for the shaft 12.

Looking from the power recovery means 105, the evaporator 106 side has a pressure lower than that on the gas cooler 104 side. The low temperature, high pressure refrigerant in the discharge working chamber 23*b* is discharged from the discharge working chamber 23*b* to the discharge passage 30 to be drawn to the evaporator 106 side. When the discharge working chamber 23*b* is brought into communication with the discharge passage 30 and the discharge process starts, the specific volume of the refrigerant increases rapidly. Another rotation torque applied to the first piston 21 by this discharge process of the refrigerant also makes a part of the rotation driving force for the shaft 12. That is, the shaft 12 is rotated by the flow of the high pressure refrigerant into the suction working chamber 23*a*, and the drawing of the refrigerant in the discharge process. A rotation torque of the shaft 12 thus obtained is utilized as mechanical power for the supercharger, as described later in detail.

(Configuration of the Supercharger 102)

As shown in FIG. 15, the supercharger 102 is disposed higher than the power recovery means 105 in the closed casing 111. By disposing the supercharger 102 with a relatively high temperature higher than the power recovery means 105 with a relatively low temperature in this way, heat exchange between the supercharger 102 and the power recovery means 105 can be suppressed. It should be noted, however, that the supercharger 102 may be disposed lower than the power recovery means 105.

The supercharger 102 is coupled to the power recovery means 105 by the shaft 12. The present embodiment describes an example in which the supercharger 102 is composed of a rotary type fluid pressure motor. However, the supercharger 102 may be composed of a fluid pressure motor other than rotary type fluid pressure motors, such as the scroll type fluid pressure motor shown in FIG. 12.

The supercharger 102 has a basic configuration substantially the same as that of the power recovery means 105. Specifically, the supercharger 102 includes the first closing member 115 and the third closing member 114 as shown in FIG. 15. The first closing member 115 is a common component between the supercharger 102 and the power recovery means 105. The first closing member 115 and the third closing member 114 are facing each other. Specifically, the third closing member 114 is facing a face of the first closing member 115 opposite to another face of the first closing member 115 facing the second closing member 113. A second cylinder 42 is disposed between the first closing member 115 and the third closing member 114. The second cylinder 42 has an internal space of a substantially cylindrical shape. The internal space of the second cylinder 42 is closed by the first closing member 115 and the third closing member 114.

The shaft 12 penetrates through the second cylinder 42 in an axial direction of the second cylinder 42. The shaft 12 is disposed on a central axis of the second cylinder 42. A second piston 41 is disposed in the substantially cylindrical internal space formed by an inner peripheral face of the second cylinder 42, the first closing member 115, and the third closing member 114. The second piston 41 is fit around the shaft 12 while being off-centered with respect to the central axis of the shaft 12. Specifically, the shaft 12 is provided with an eccentric portion 12*c* having a central axis different from that of the shaft 12. The tubular second piston 41 is fit around the eccentric portion 12*c*. Thereby, the second piston 41 is off-centered with respect to the central axis of the second cylinder 42. Accordingly, the second piston 41 rotates eccentrically as the shaft 12 rotates.

The eccentric portion 12*c* to which the second piston 41 is attached is off-centered in a direction substantially the same as a direction in which the eccentric portion 12*b* to which the first piston 21 is attached is off-centered. Accordingly, in the present embodiment, a direction in which the first piston 21 is off-centered with respect to the central axis of the first cylinder 22 is substantially the same as a direction in which the second piston 41 is off-centered with respect to the central axis of the second cylinder 42.

Figure 17:
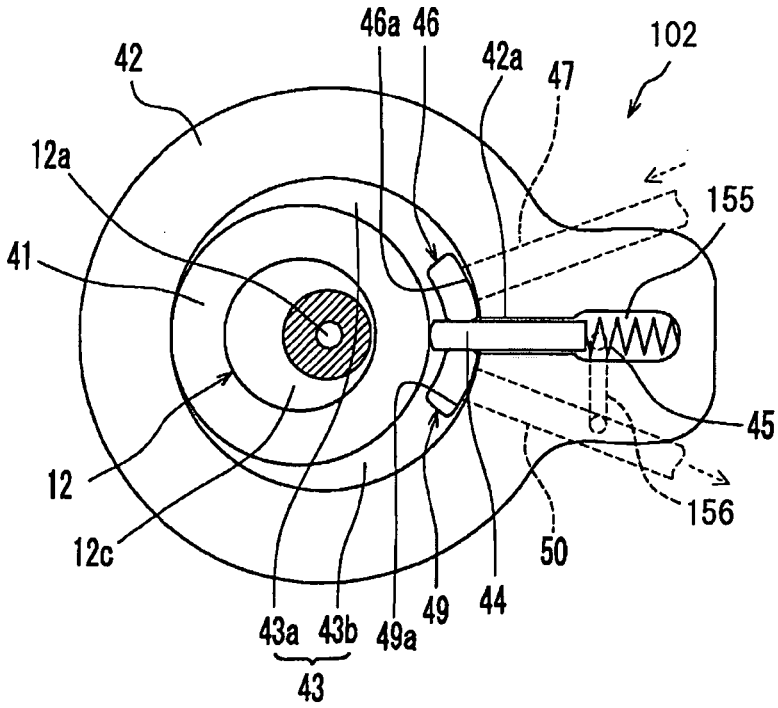
FIG. 17 is a fragmentary view taken along line D2-D2 in FIG. 15.

A second working chamber 43 is formed in the second cylinder 42 by the second piston 41, the inner peripheral face of the second cylinder 42, the first closing member 115, and the third closing member 114 (see FIG. 17 as well). The second working chamber 43 has a volumetric capacity that is substantially invariable even when the second piston 41 rotates in association with the shaft 12. The phrase "substantially the same" is meant to include not only the case of being completely the same but also the case where an error of approximately ±2 to 3° is observed.

As shown in FIG. 17, a linear groove 42*a* opening to the second working chamber 43 is formed in the second cylinder 42. A plate-like second partition member 44 is disposed slidably in the linear groove 42*a*. A pushing means 45 is disposed between the second partition member 44 and a bottom portion of the linear groove 42*a*. The second partition member 44 is pressed toward an outer peripheral face of the second piston 41 by the pushing means 45. Thereby, the second working chamber 43 is partitioned into two spaces. More specifically, the second working chamber 43 is partitioned into a high-pressure side suction working chamber 43*a* and a low pressure side discharge working chamber 43*b*.

The pushing means 45 may be composed of a spring, for example. Specifically, the pushing means 45 may be a compression coil spring.

Moreover, the pushing means 45 may be a so-called gas spring. That is, when the second partition member 44 slides in a direction that reduces a volume of a back space 155, a pressure in the back space 155 is set higher than a pressure in the second working chamber 43, and this pressure difference between the back space 155 and the second working chamber 43 can cause a pressing force to press the second partition member 44 toward the second piston 41. For example, the back space is a closed space, and an opposing force can be applied to the second partition member 44 when the volume of the back space 155 is reduced due to a backward movement of the second partition member 44. And the configuration may be made in such a manner that the back space 155 is not a closed space when the second partition member 44 approaches the central axis of the shaft 12 most closely, but the back space 155 is a closed space when the second partition member 44 is somewhat distanced from the second piston 41. The pushing means 45 may be composed of two or more types of springs, such as the compression coil spring and the gas spring, of course. It should be noted that the pressure in the second working chamber 43 means an average pressure between a pressure in the suction working chamber 43*a* and a pressure in the discharge working chamber 43*b*. The back space 155 means a space formed between a rear end of the second partition member 44 and the bottom portion of the linear groove 42*a*.

As shown in FIG. 17, a suction passage 47 (second suction passage) opens to a portion of the suction working chamber 43*a* adjacent to the second partition member 44. As shown in FIG. 15, the suction passage 47 is formed in the third closing member 114 located above the second cylinder 42. The suction passage 47 is in communication with a suction pipe 48. The refrigerant coming from the evaporator 106 (see FIG. 1) is guided to the suction working chamber 43*a* via the suction pipe 48 and the suction passage 47.

An opening (suction port) 46 of the suction passage 47 to the suction working chamber 43*a* is formed in a substantially fan shape extending, in an arc shape, from the portion of the suction working chamber 43*a* adjacent to the second partition member 44 in a direction in which the suction working chamber 43*a* stretches. The suction port 46 is closed completely by the second piston 41 when the second piston 41 is located at a top dead center thereof. At least a part of the suction port 46 is exposed to the suction working chamber 43*a* during the whole period except for the moment at which the second piston 41 is located at the top dead center. Specifically, an outer edge side 46*a* of the suction port 46, which is located outside with respect to a radial direction of the second cylinder 42, is formed in an arc shape along the outer peripheral face of the piston 21 when the second piston 41 is located at the top dead center viewed in plane. In other words, the outer edge side 46*a* is formed in an arc shape having a radius substantially the same as that of the outer peripheral face of the second piston 41.

On the other hand, a discharge passage 50 (second discharge passage) opens to a portion of the discharge working chamber 43*b* adjacent to the second partition member 44. Like the suction passage 47, the discharge passage 50 also is formed in the third closing member 114 as shown in FIG. 15. The discharge passage 50 is in communication with a discharge pipe 151. Thereby, the refrigerant in the discharge working chamber 43*b* is discharged to the compressor 103 side via the discharge passage 50 and the discharge pipe 151. Reference numerals 151 and 48 are written side by side in FIG. 15 because the discharge pipe 151 is located behind the suction pipe 48 on the drawing. This does not mean, however, that the suction pipe 48 and the discharge pipe 151 are composed of a common pipe.

The discharge passage 50 is connected to the back space 155 via a connecting passage 156. Specifically, in the present embodiment, the connecting passage 156 is in communication with the back space 155 when the second partition member 44 approaches the central axis of the shaft 12 most closely. The connecting passage 156 is closed by the second partition member 44 when the second partition member 44 is somewhat distanced from the central axis of the shaft 12. In other words, during a period in which the second partition member 44 slides from a forward position closest to the central axis of the shaft 12 to a backward position most distanced from the central axis of the shaft 12, the connecting passage 156 changes its state from an opened state to a closed state, turning the back space 155 from an open space communicating with the connecting passage 156 into a closed space blocked from the connecting passage 156. Accordingly, after the connecting passage 156 is closed by the second partition member 44 and the back space 155 is turned into the closed space, the back space 155 presses the second partition member 44 in a direction toward the second piston 41 as a gas spring.

An opening (discharge port) 49 of the discharge passage 50 to the discharge working chamber 43*b* is formed in a substantially fan shape extending, in an arc shape, from the portion of the discharge working chamber 43*b* adjacent to the second partition member 44 in a direction in which the discharge working chamber 43*b* stretches. The discharge port 49 is closed completely by the second piston 41 when the second piston 41 is located at the top dead center. At least a part of the discharge port 49 is exposed to the discharge working chamber 43*b* during the whole period except for the moment at which the second piston 41 is located at the top dead center. Specifically, an outer edge side 49*a* of the discharge port 49, which is located outside with respect to a radial direction of the second cylinder 42, is formed in an arc shape along the outer peripheral face of the second piston 41 when the second piston 41 is located at the top dead center viewed in plane. In other words, the outer edge side 49*a* is formed in an arc shape having a radius substantially the same as the outer peripheral face of the second piston 41.

The description of Embodiment 1 is used also for the top dead center of the second piston 41.

Figure 19:
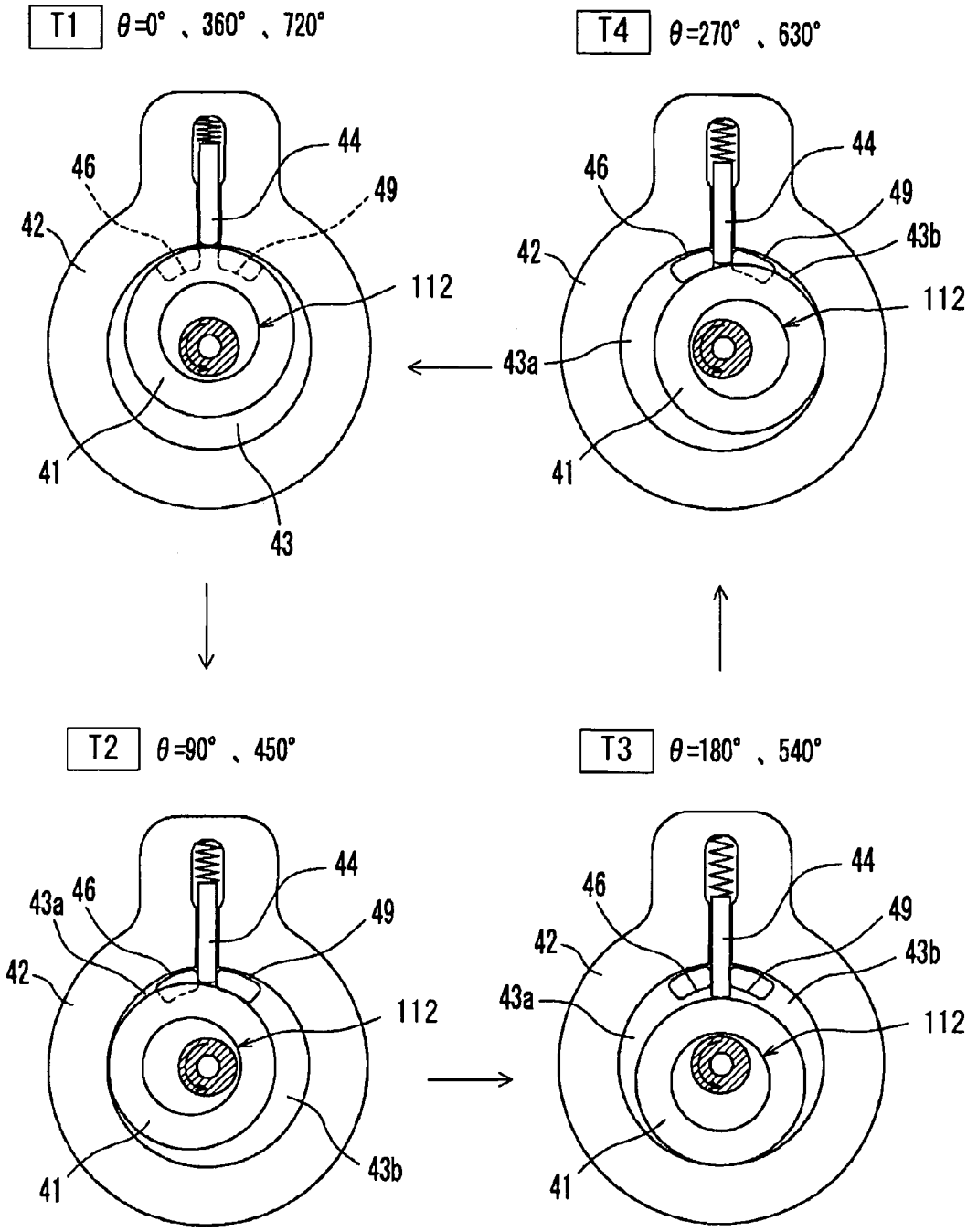
FIG. 19 is a view showing an operation principle of a supercharger.

By forming the suction passage 47 and the discharge passage 50 as mentioned above, both of the suction port 46 and the discharge port 49 are closed completely only at the moment when the second piston 41 is located at the top dead center, as shown in the upper left view of FIG. 19. In other words, both of the suction port 46 and the discharge port 49 are closed completely at a moment when the second working chamber 43 appears as a single chamber. More specifically, the suction working chamber 43*a* is in communication with the suction passage 47 until a moment at which the suction working chamber 43*a* is brought into communication with the discharge port 49. After a moment at which the suction working chamber 43*a* is brought into communication with the discharge passage 50 to turn the suction working chamber 43*a* into the discharge working chamber 43*b*, the suction port 46 is closed by the second piston 41. This suppresses a backflow of the refrigerant from the discharge passage 50 with a relatively high pressure to the suction passage 47 with a relatively low pressure. Accordingly, efficient supercharging is realized. As a result, utilization efficiency of the recovered mechanical power is enhanced.

From the viewpoint of forbidding completely the backflow of the refrigerant from the discharge passage 50 to the suction passage 47, it is preferable that both of the suction passage 47 and the discharge passage 50 are closed at the moment when the second piston 41 is located at the top dead center. However, even in the case where only one of the suction port 46 and the discharge port 49 is closed at the moment when the second piston 41 is located at the top dead center, the backflow of the refrigerant from the discharge passage 50 to the suction passage 47 substantially does not occur as long as a gap between a timing at which the suction port 46 is closed and a timing at which the discharge port 49 is closed is smaller than approximately 10° in terms of the rotation angle of the shaft 12. That is, the backflow of the refrigerant from the discharge passage 50 to the suction passage 47 can be suppressed by setting the gap between the timing at which the suction port 46 is closed and the timing at which the discharge port 49 is closed smaller than approximately 10° in terms of the rotation angle of the shaft 12.

As described above, the suction working chamber 43*a* always is in communication with the suction passage 47. The discharge working chamber 43*b* always is in communication with the discharge passage 50. In other words, the suction process for drawing the refrigerant and the discharge process for discharging the drawn refrigerant are performed substantially continuously in the supercharger 102. Accordingly, the drawn refrigerant passes through the supercharger 102 substantially without changing its volume.

(Operation of the Supercharger 102)

Next, the operation principle of the supercharger 102 will be described in detail with reference to FIG. 19. FIG. 19 shows four states from ST1 to ST4. As is apparent from a comparison between FIG. 19 and FIG. 5, the description of the fluid pressure motor in Embodiment 1 can be used to describe the operation principle of the supercharger 102.

The shaft 12 is rotated by the mechanical power recovered by the power recovery means 105. The second piston 41 also is rotated in association with the rotation of the shaft 12 to drive the supercharger 102.

The volumetric capacity of the second working chamber 43 is substantially invariable. The suction working chamber 43*a* always is in communication with the suction passage 47. The discharge working chamber 43*b* always is in communication with the discharge passage 50. Accordingly, the refrigerant is neither compressed nor expanded in the second working chamber 43 of the supercharger 102. Since the supercharger 102 is driven by the shaft 12 that is rotated by the power recovery means 105, a downstream side from the second working chamber 43 has a pressure higher than that on an upstream side from the second working chamber 43. In other words, by the supercharger 102 driven by the mechanical power recovered by the power recovery means 105, the compressor 103 side from the discharge port 49 has a pressure higher than that on the evaporator 106 side from the suction port 46. In short, the supercharger 102 increases pressure.

In the present invention, a timing at which the first piston 21 of the power recovery means 105 is located at the top dead center thereof substantially agrees with a timing at which the second piston 41 of the supercharger 102 is located at the top dead center thereof.

(Balance Weight 152)

A balance weight 152 is provided in the fluid machine 110 as shown in FIG. 15. Specifically, a balance weight 152*a* and a balance weight 152*b* are attached to ends of the shaft 12, respectively. In this specification, the balance weight 152*a* and the balance weight 152*b* are collectively called the balance weight 152.

The balance weight 152 serves to reduce unevenness in weight of a rotating body 153 around a rotation axis of the shaft 12. The rotating body 153 includes the shaft 12, the first piston 21 attached to the shaft 12 while being off-centered, the second piston 41 attached to the shaft 12 while being off-centered. Particularly, the balance weight 152 is for allowing the rotating body 153 to have a uniform weight balance around the rotation axis of the shaft 12.

Figure 20:
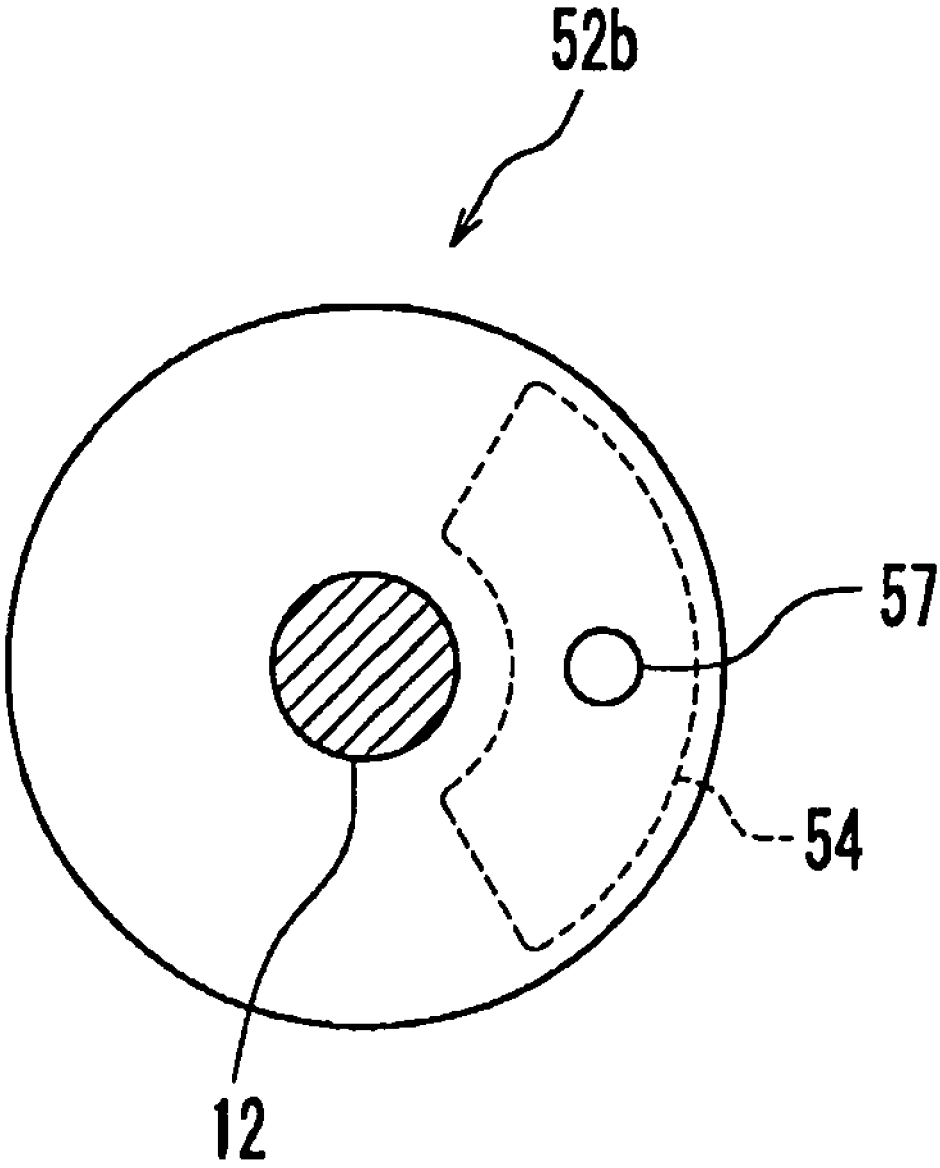
FIG. 20 is a view taken along line D3-D3 in FIG. 15.

Specifically, each of the balance weights 152*a* and 152*b* is formed in a cylindrical shape having a central axis common with that of the shaft 12, as shown in FIG. 20. More specifically, each of the balance weights 152*a* and 152*b* has a shape (external shape) axially symmetrical with respect to the rotation axis of the shaft 12. At the same time, each of the balance weights 152*a* and 152*b* has an arc-shaped internal space 154 viewed in plane around the central axis of the shaft 12. Accordingly, each of the balance weights 152*a* and 152*b* has weight variation around the central axis of the shaft 12. As shown in FIG. 15, the balance weights 152*a* and 152*b* are attached to the shaft 12 in such a manner that a portion of each of the balance weights 152*a* and 152*b* on a side opposite to the directions in which the first piston 21 and the second piston 41 are off-centered is heavier than a portion on a side that agrees with these directions. That is, each of the balance weights 152*a* and 152*b* is attached to the shaft 12 in such a manner that a portion in which the internal space 154 is formed is located on the side that agrees with the directions in which the first piston 21 and the second piston 41 are off-centered with respect to the central axis of the shaft 12.

Each of the balance weights 152*a* and 152*b* has a communication hole 157 communicating with the internal space 154. This is for allowing a lubrication oil, which will be described later, filling the interior of the closed casing 111 to flow into the internal space 154.

—Compressor 103—

Figure 21:
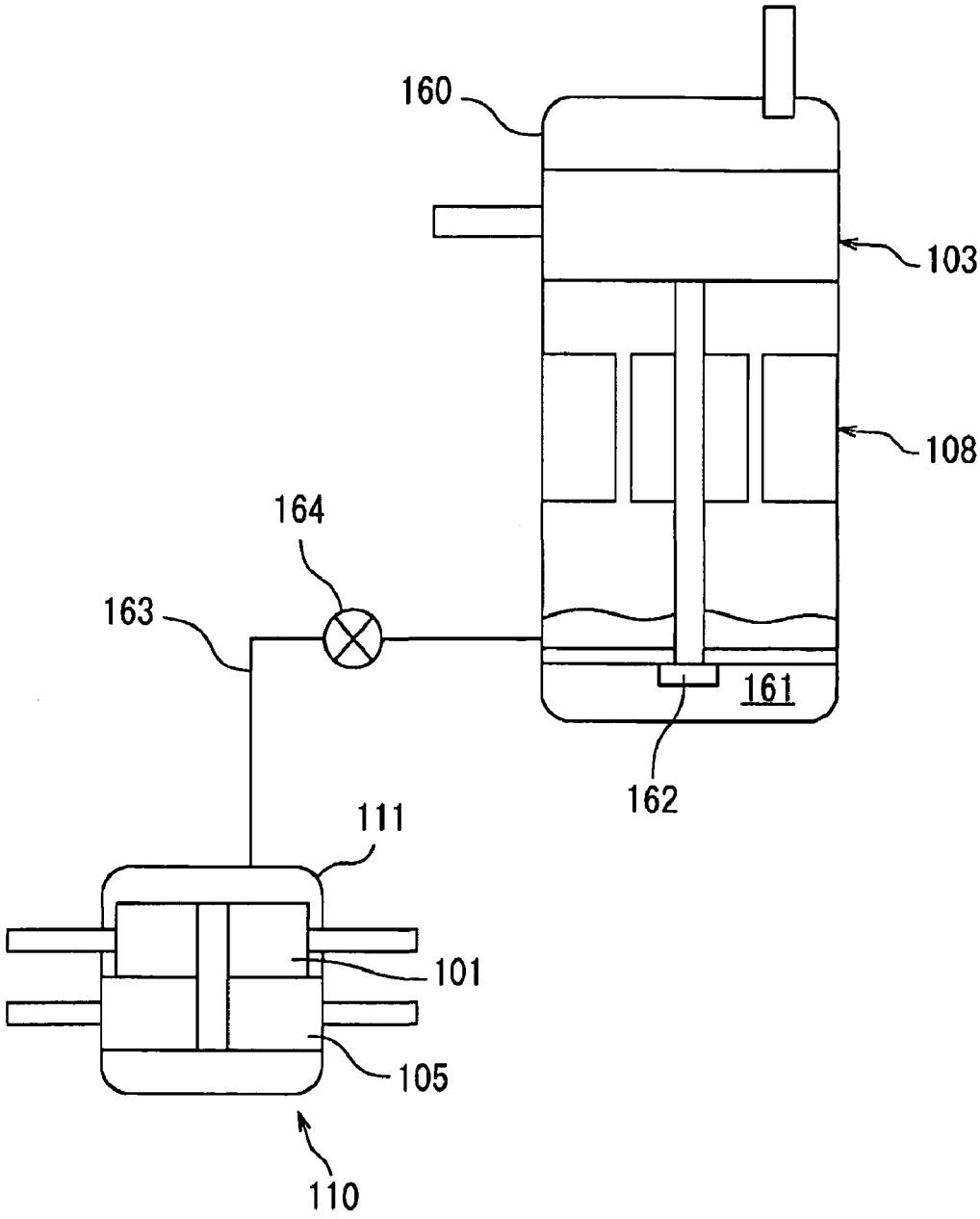
FIG. 21 is a schematic view showing a general configuration of a compressor.

FIG. 21 is a schematic view showing a general configuration of the compressor 103. The compressor 103 includes the compression mechanism 103*a*, the motor 108, and the casing 160 that accommodates them. An oil reservoir 161 holding the refrigeration oil is formed at a bottom portion of the casing 160. A fluid pump 162 is disposed in the oil reservoir 161. The fluid pump 162 pumps up the refrigeration oil held in the oil reservoir 161 and supplies it to the compression mechanism 103*a*.

In the present embodiment, the compressor 103 is disposed higher than the fluid machine 110 as shown in FIG. 21. An oil equalizing pipe 163 is connected to the oil reservoir 161. The oil equalizing pipe 163 also is connected to the closed casing 111. A throttle mechanism 164 is attached to the oil equalizing pipe 163. The throttle mechanism 164 adjusts a pressure in the casing 160 and a pressure in the closed casing 111. Specifically, the throttle mechanism 164 adjusts the pressure in the closed casing 111 to be lower than the pressure in the casing 160. More specifically, the throttle mechanism 164 adjusts the pressure in the closed casing 111 to fall between a pressure on the high pressure side of the refrigerant circuit 109 and a pressure on the low pressure side of the refrigerant circuit 109. In other words, the pressure in the closed casing 111 is set higher than the pressure on the low pressure side of the refrigerant circuit 109, and lower than the pressure on the high pressure side of the refrigerant circuit 109.

—Refrigeration cycle—

Figure 22:
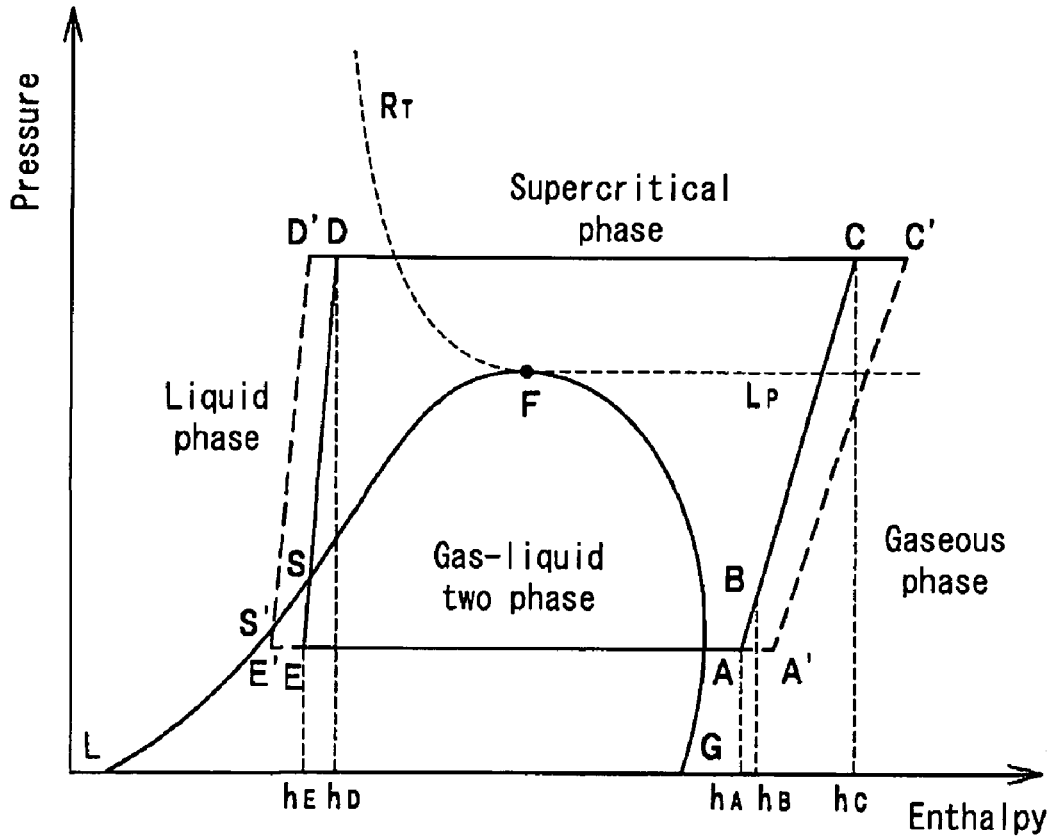
FIG. 22 is a Mollier diagram of a refrigeration cycle.

Next, the refrigeration cycle in the refrigeration cycle apparatus 101 will be described with reference to FIG. 22. FIG. 22 is a Mollier diagram like the one in FIG. 6. In FIG. 22, $h_A$, $h_B$, $h_C$, $h_D$, and $h_E$ shows enthalpy of the refrigerant at each point A, B, C, D, and E, respectively.

The closed loop ABCDE in FIG. 22 shows the refrigeration cycle of the power-recovery-type refrigeration cycle apparatus 101 shown in FIG. 14. A-B in the closed loop ABCDE shows the state change of the refrigerant caused in the supercharger 102. B-C shows the state change of the refrigerant in the compression mechanism 103*a*. C-D shows the state change of the refrigerant in the gas cooler 104. D-E shows the state change of the refrigerant in the power recovery means 105. E-A shows the state change of the refrigerant in the evaporator 106.

In the compression mechanism 103*a*, the refrigerant is compressed from a low temperature, low pressure gaseous phase (Point B) to a high temperature, high pressure supercritical phase (Point C). The refrigerant having been compressed by the compression mechanism 103*a* is cooled from the supercritical phase (Point C) to a liquid phase (Point D) in the gas cooler 104. The temperature and pressure of the refrigerant at Point B are slightly higher than the temperature and the pressure at Point A.

Then, in the power recovery means 105, the refrigerant is expanded (undergoes pressure drop) from the low temperature, high pressure liquid phase (Point D) to a gas-liquid two phase (Point E) via a saturated liquid (Point S). In this pressure drop (expansion) process, a specific volume of the refrigerant does not vary so much because the refrigerant is in the incompressible, liquid phase from Point D to Point S. On the other hand, from Point S to Point E, there occurs a pressure drop accompanied by a rapid change in the specific volume due to a phase change from liquid phase to gaseous phase, that is, there occurs a pressure drop accompanied by expansion.

The refrigerant from the power recovery means 105 is heated in the evaporator 106, and changed from the gas-liquid two phase (Point E) to the gaseous phase (Point A) while being evaporated. The pressure of the refrigerant having been heated by the evaporator 106 is increased in the supercharger 102, and the refrigerant is changed to the gaseous phase (Point B).

—Work and Effect—

As described above, the power recovery means 105 recovers mechanical power in the present embodiment. The mechanical power recovered by the power recovery means 105 is utilized as mechanical power for the supercharger 102. Thereby, high energy efficiency is realized. Describing specifically using FIG. 22, the power recovery means 105 recovers energy corresponding to $(h_D-h_E)$ from the refrigerant as mechanical power. Roughly speaking, the supercharger 102 gives the refrigerant energy corresponding to an enthalpy $\eta_{exp}\cdot\eta_{pump}$ $(h_D-h_E)=(h_B-h_A)$ obtained by multiplying the recovered enthalpy $(h_D-h_E)$ by efficiency $\eta_{exp}$ of the power recovery means 105 as well as efficiency $\eta_{pump}$ of the supercharger 102. As a result, the pressure of the refrigerant is increased from Point A to Point B shown in FIG. 22.

In a refrigeration cycle apparatus without the supercharger 102, the compression mechanism 103*a* compresses the refrigerant from Point A on the outlet side of the evaporator 106 to Point C on the inlet side of the gas cooler 104. In contrast, in the refrigeration cycle apparatus 101 of the present embodiment provided with the supercharger 102 connected to the power recovery means 105, the pressure of the refrigerant is increased from Point A to Point B by allowing the refrigerant to pass through the supercharger 102. Therefore, the compression mechanism 103*a* is supposed to compress the refrigerant only from Point B to Point C. This makes it possible to reduce the workload of the compression mechanism 103*a* by the amount of energy corresponding to $(h_B-h_A)$. As a result, COP of the refrigeration cycle apparatus 101 can be enhanced.

Using, for example, a conventional expander as the power recovery means 105 is an option. When the conventional expander is used as the power recovery means 105, it is possible to recover both of the energy resulting from expansion of the refrigerant, and the energy resulting from pressure difference between the suction side and the discharge side. In contrast, the fluid pressure motor does not allow the refrigerant to be expanded in it. Accordingly, when the fluid pressure motor is used as the power recovery means 105 as in the present embodiment, the energy resulting from pressure difference between the suction side and the discharge side only can be recovered. This makes it seem as if use of the conventional expander as the power recovery means 105 could enhance the energy efficiency more greatly.

However, as described with reference to FIG. 8 in Embodiment 1, use of the fluid pressure motor as the power recovery means 105 possibly is better for enhancing the energy efficiency of the refrigeration cycle apparatus 101 even more greatly. Particularly, in a refrigeration cycle apparatus using a supercritical refrigerant such as carbon dioxide, it is appropriate to use a fluid pressure motor having no specific volumetric capacity ratio, from the viewpoint of preventing decrease in efficiency due to overexpansion loss.

Moreover, in the present embodiment, the power recovery means 105 and the supercharger 102 each are composed of the fluid pressure motor having a configuration simpler than that of a compressor and an expander requiring a lead valve etc. Particularly, in the present embodiment, the power recovery means 105 and the supercharger 102 each are composed of the rotary type fluid pressure motor having a relatively simple structure compared with that of other fluid pressure motors. Thereby, the simple and inexpensive refrigeration cycle apparatus 101 is realized.

For example, providing a sub compressor instead of the supercharger 102 also is an option as in JP 2006-266171 A mentioned above. However, the sub compressor has a much more complicated configuration than that of the supercharger 102, and its manufacturing cost is high. Thus, use of the sub compressor complicates the configuration of the refrigeration cycle apparatus 101. It also increases manufacturing cost of the refrigeration cycle apparatus 101.

Even when the supercharger 102 is used as a booster, a result equivalent to that in the case where the sub compressor is used as a booster can be expected. Hereinafter, the reason for that will be described in detail with reference to FIG. 23.

Figure 23:
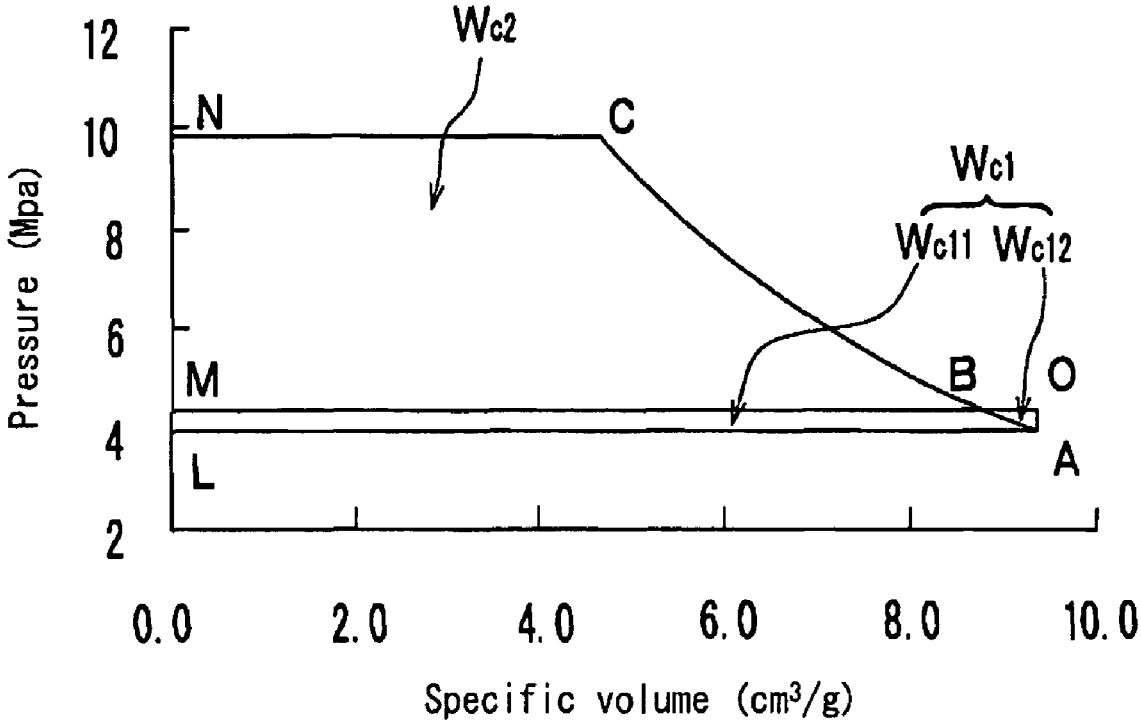
FIG. 23 is a graph showing a relationship between a specific volume of a refrigerant and a pressure of a refrigerant in the supercharger and the compressor.

FIG. 23 is a graph showing a relationship between specific volume and pressure of the refrigerant in the supercharger 102 and the compression mechanism 3*a*. Point A, Point B, and Point C in FIG. 23 correspond to Point A, Point B, and Point C in FIG. 22, respectively. FIG. 23 shows the result of a computer simulation when the refrigeration cycle apparatus 101 is used for a water heater. The pressure at Point A is 3.96 MPa. The temperature at Point A is 10.7° C. The pressure at Point B is 4.36 MPa. The pressure at Point C is 9.77 MPa. The entropy is assumed to be constant between Point A and Point B, as well as between Point B and Point C.

As shown in FIG. 23, the refrigerant coming from the evaporator 106 is drawn into the supercharger 102 first. Then, the pressure of the refrigerant is increased from Point A to Point B in the supercharger 102. More accurately speaking, the supercharger 102 discharges the refrigerant substantially without changing the volume of the refrigerant. The pressure of the refrigerant is increased by force of the supercharger 102 sending out the refrigerant. Therefore, the state of the refrigerant does not change from Point A to Point B directly as in the case where the sub compressor is used. The pressure of the refrigerant is increased from Point A to Point O when the refrigerant moves from the suction working chamber 43*a* to the discharge working chamber 43*b* while maintaining the specific volume fixed. Then, the refrigerant undergoes an isobaric change from Point O to Point B to have the same specific volume as that of the refrigerant on a suction side of the compression mechanism 103*a*, when the refrigerant is discharged from the discharge working chamber 43*b*.

Here, the area of the portion enclosed by N, C, B, O, A, L, and M in FIG. 23 corresponds to a theoretical value of work necessary to compress the refrigerant per unit mass. Total theoretical compression work $W_{c0}$ corresponding to the area of the portion enclosed by N, C, B, O, A, L, and M is represented by a sum total of theoretical compression work $W_{c1}$ at the supercharger 102 and theoretical compression work $W_{c2}$ at the compression mechanism 103*a*. Furthermore, the theoretical compression work $W_{c1}$ at the supercharger 102 is represented by sum total of work $W_{c11}$ of adiabatic compression (AB) and increased work $W_{c12}$ compared with the adiabatic compression. Assuming that the efficiency $\eta_{exp}$ of the power recovery means 105 is 81% and the efficiency $\eta_{pump}$ of the supercharger 102 is 81%, $W_{c1}$ actually accounts for 10% of $W_{c0}$ ($=W_{c1}+W_{c2}$), $W_{c2}$ accounts for 90% of $W_{c0}$, $W_{c12}$ accounts for 4% of $W_{c1}$, and $W_{c12}$ accounts for 0.4% of $W_{c0}$, in the case shown in FIG. 23.

As described above, the increased work $W_{c12}$ is very small when the supercharger 102 is used instead of the sub compressor. Moreover, the proportion of the increased work $W_{c12}$ in the total theoretical compression work $W_{c0}$ is of a negligible level. Thus, high energy efficiency can be realized even when the supercharger 102 is used as the booster.

Moreover, when the supercharger 102 is used, there is no pressure loss caused by a discharge valve. Thereby, higher energy efficiency may be realized when the supercharger 102 is used as the booster than when the sub compressor is used as the booster.

When the sub compressor is provided instead of the supercharger 102 and the expander is provided as the power recovery means, for example, a recovery torque recovered by the expander shows a waveform different from that of a load torque applied at the sub compressor. In other words, the ratio of the recovery torque to the load torque changes during one period. When the ratio of the recovery torque to the load torque is large, the number of rotations of the shaft increases. On the other hand, when the ratio of the recovery torque to the load torque is small, the number of rotations of the shaft decreases. That is, a rotation angle region in which the number of rotations of the shaft increases, and a rotation angle region in which the number of rotations of the shaft decreases are generated. This hinders the shaft from rotating smoothly, and lowers the efficiency in recovering energy.

When the sub compressor is provided instead of the supercharger 102 and the fluid pressure motor is provided as the power recovery means, it is not possible either to suppress sufficiently the variation in the rotating speed of the shaft caused by the change in the ratio of the recovery torque to the load torque, like the above-mentioned case.

In the fluid pressure motor, the suction process and the discharge process are performed continuously. Also, the pressure in the suction working chamber is equal to the suction side pressure, and is fixed. On the other hand, the pressure in the discharge working chamber is equal to the discharge side pressure, and is fixed. Therefore, the pressure acting on the piston always is fixed. The waveform of the recovery torque with respect to the rotation of the shaft has a substantially sine wave shape.

In contrast, in the sub compressor, the refrigerant is compressed while the working chamber is isolated from both of the suction passage and the discharge passage. Accordingly, the pressure in the suction working chamber is fixed, but the pressure in the working chamber is increased during a compression process. The waveform of the load torque with respect to the rotation of the shaft does not have a sine wave shape.

As described above, when the sub compressor is provided instead of the supercharger 102 and the fluid pressure motor is provided as the power recovery means, the waveform of the recovery torque is different from that of the load torque. As a result, it is difficult for the shaft to rotate sufficiently smoothly.

This is also the case when the supercharger 102 is provided and the expander is provided as the power recovery means. When the expander is used as the power recovery means, the waveform of the recovery torque with respect to the rotation of the shaft does not have a sine wave shape. In contrast, the waveform of the load torque with respect to the rotation of the shaft has a substantially sine wave shape because the supercharger 102 is a fluid pressure motor. The waveform of the recovery torque is different from that of the load torque also in this case. As a result, it is difficult for the shaft to rotate sufficiently smoothly.

Figure 24A:
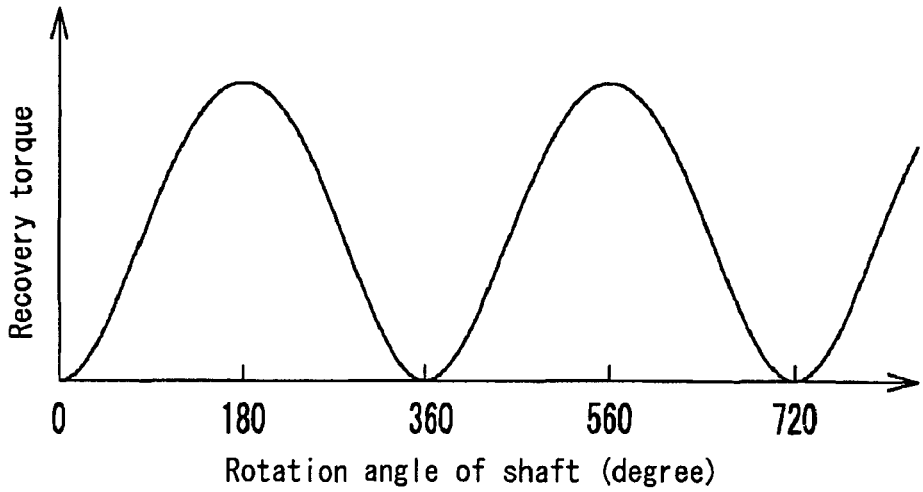
FIG. 24A is a graph showing a relationship between recovery torque and rotation angle of a shaft at the fluid pressure motor.
Figure 24B:
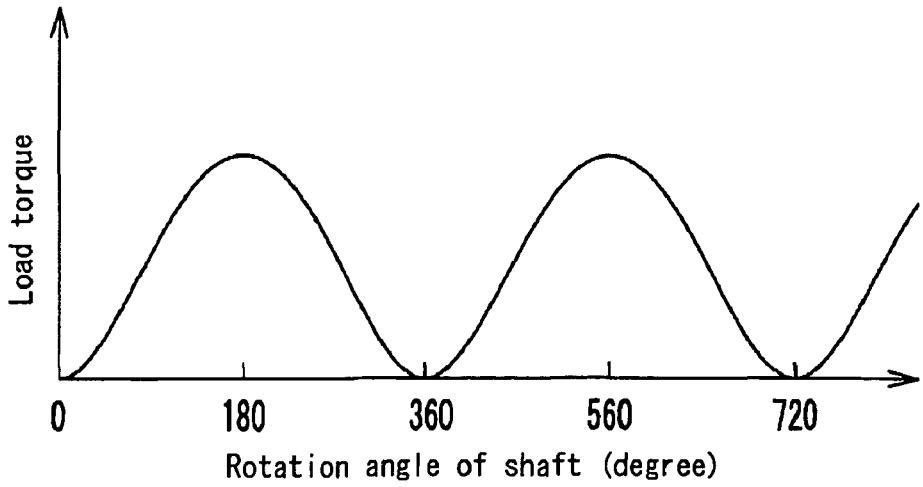
FIG. 24B is a graph showing a relationship between load torque and rotation angle of the shaft at the supercharger.

In contrast, the supercharger 102 and the power recovery means 105 coupled to each other are composed of the fluid pressure motor, respectively, in the present embodiment. Thus, the waveform of the recovery torque recovered by the power recovery means 105 is relatively similar to the waveform of the load torque at the supercharger 102, as shown in FIG. 24A and FIG. 24B. Specifically, the waveform of the recovery torque and the waveform of the load torque have similar shapes in a longitudinal axis direction representing the recovery torque. Both of the waveform of the recovery torque and the waveform of the load torque have a sine wave shape, where 360° of the rotation angle of the shaft 12 is defined as one period. Thus, the ratio of the recovery torque to the load torque is fixed. Specifically, as the load torque increases, the recovery torque also increases. When the load torque decreases, the recovery torque also decreases accordingly. As a result, the shaft rotates smoothly without slowing down. This enhances the efficiency in recovering energy as well as suppresses the occurrence of vibration and noise.

Specifically, it is possible to match the waveform of the load torque with the waveform of the recovery torque by synchronizing the timing at which the piston of the power recovery means 105 is located at the top dead center thereof to the timing at which the piston of the supercharger 102 is located at the top dead center thereof. In other words, the ratio of the recovery torque to the load torque is substantially fixed at any rotation angle of the shaft 12. This allows the unevenness in the rotating speed of the shaft to be suppressed. As a result, the energy efficiency of the refrigeration cycle apparatus can be enhanced further. Moreover, the suppressed unevenness in the rotating speed of the shaft also can suppress vibration and noise of the refrigeration cycle apparatus.

More specifically, in the present embodiment, a direction in which the first partition member 24 is disposed with respect to the shaft 12 is substantially the same as a direction in which the second partition member 44 is disposed with respect to the shaft 12. Furthermore, the direction in which the first piston 21 is off-centered with respect to the central axis of the first cylinder 22 is substantially the same as the direction in which the second piston 41 is off-centered with respect to the central axis of the second cylinder 42. Thereby, the timing at which the piston of the power recovery means 105 is located at the top dead center thereof is synchronized (agrees with) the timing at which the piston of the supercharger 102 is located at the top dead center thereof. The configuration in which the eccentric portions 12*b* and 12*c* of the shaft 12 are oriented in the same direction makes it easier to manufacture the fluid machine 110 than other different configurations do.

Moreover, the frictional force can be reduced between the shaft 12, and the second closing member 113 and the third closing member 114 axially supporting the shaft 12, by allowing the direction in which the first piston 21 is off-centered with respect to the central axis of the first cylinder 22 to be substantially the same as the direction in which the second piston 41 is off-centered with respect to the central axis of the second cylinder 42.

A force caused by differential pressure acts on the first piston 21 of the power recovery means 105 in a direction from the relatively high pressure suction working chamber 23*a* toward the relatively low pressure discharge working chamber 23*b*. Similarly, a force caused by differential pressure acts on the second piston 41 of the supercharger 102 in a direction from the relatively high pressure discharge working chamber 43*b* toward the relatively low pressure suction working chamber 43*a*. These forces caused by differential pressures push the shaft 12 via the eccentric portions 12*b* and 12*c*, and act on bearing parts of the second closing member 113 and the third closing member 114 axially supporting the shaft 12. As a result, a force that hinders the shaft 12 from rotating is generated, accelerating wear of the shaft 12 and the bearing parts.

Figure 24C:
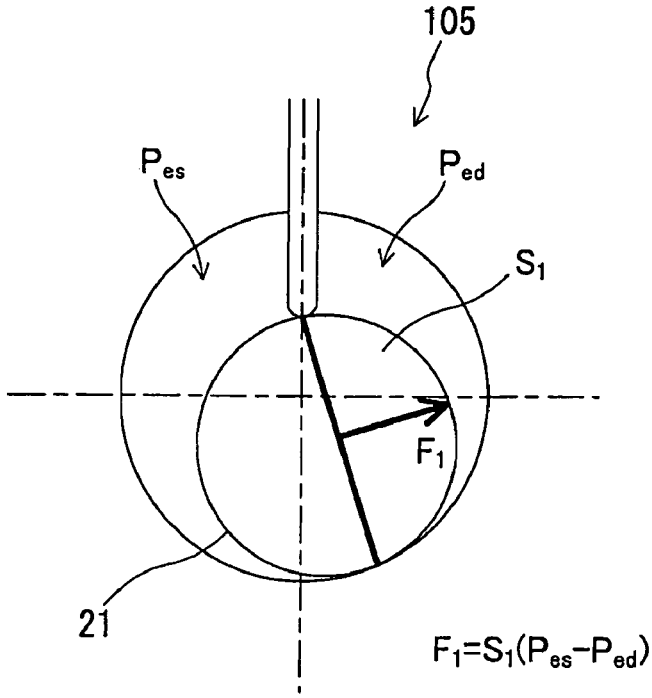
FIG. 24C is a view showing a reason why forces caused by differential pressures are canceled.
Figure 24C:
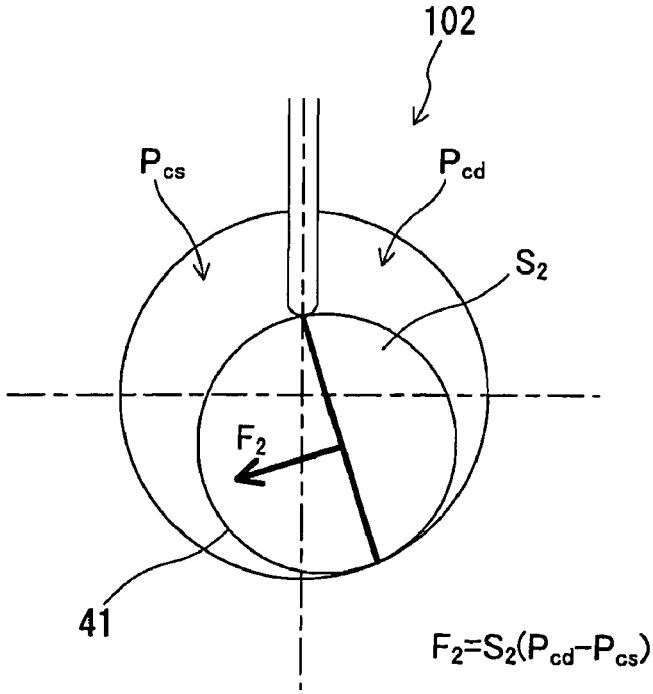

Taking this problem into account, the present embodiment employs a configuration in which the direction in which the force caused by differential pressure acts on the first piston 21 is opposite to the direction in which the force caused by differential pressure acts on the second piston 41. In the power recovery means 105, a force $F_1$ caused by differential pressure acting on the first piston 21 is a value obtained by multiplying an area $S_1$ of the first piston 21 by a result of subtracting a discharge pressure $P_{ed}$ from a suction pressure $P_{es}$, as shown in FIG. 24C. In the supercharger 102, a force $F_2$ caused by differential pressure acting on the second piston 41 is a value obtained by multiplying an area S2 of the second piston 41 by a result of subtracting a suction pressure $P_{cs}$ from a discharge pressure $P_{cd}$. When the force caused by differential pressure $F_1$ and the force caused by differential pressure $F_2$ are projected on the same plane, it is understood that they are canceled by each other. When the direction of eccentricity and amount of eccentricity of the piston 21 are equal to those of the piston 41, a point of action of the force caused by differential pressure $F_1$ agrees with that of the force caused by differential pressure $F_2$ with respect to the axial direction, and the cancellation can be performed more reliably.

The forces caused by differential pressures are canceled by each other between the first piston 21 and the second piston 41, and as a result, it is possible to reduce the frictional force between the shaft 12 and the second closing member 113 as well as the frictional force between the shaft 12 and the third closing member 114. Thereby, the mechanical power necessary to rotate the shaft 12 can be reduced, and the energy recovery can be enhanced. Furthermore, wear of the shaft 12, the second closing member 113, and the third closing member 114 also can be suppressed.

It should be noted, however, that when thus configured, there occurs unevenness in the weight balance of the rotating body 153, which includes the shaft 12, the first piston 21, and the second piston 41, around the central axis of shaft 12. Specifically, the rotating body 153 is relatively heavy on a side to which the first piston 21 and the second piston 41 are off-centered. On the other hand, it becomes relatively light on a side opposite to the side to which the first piston 21 and the second piston 41 are off-centered. In order to reduce the unevenness in weight of the rotating body 153 around the central axis of the shaft 12, the two balance weights 152*a* and 152*b* are attached to the shaft 12 in the present embodiment. The unevenness in weight of the rotating body 153 around the central axis of the shaft 12 is reduced by the two balance weights 152*a* and 152*b*. Particularly, the rotating body 153 has a uniform weight balance around the central axis of shaft 12 in the present invention. Accordingly, smooth rotation of the rotating body 153 is realized. Moreover, vibration of the rotating body 153 during rotation is suppressed, reducing the vibration and noise of the refrigeration cycle apparatus 101. From the viewpoint of reducing effectively the vibration of the rotating body 153, it is effective to provide at least the balance weight 152 on both ends of the shaft 12. Besides the balance weights 152*a* and 152*b*, an additional one or a plurality of balance weights may be attached to the shaft 12.

As shown in FIG. 15 and FIG. 20, the balance weights 152*a* and 152*b* each have the shape axially symmetrical with respect to the rotation axis of the shaft 12. Accordingly, the balance weights 152*a* and 152*b* are not displaced by the rotation of the shaft 12. In other words, spaces occupied by the balance weights 152*a* and 152*b* each have a fixed shape regardless of the rotation angle of the shaft 12. When the balance weights 152*a* and 152*b* are displaced by the rotation of the shaft 12, for example, the refrigeration oil in the closed casing 111 is stirred by rotation of the balance weights 152*a* and 152*b*. Accordingly, rotational resistance occurs on the balance weights 152*a* and 152*b*. As a result, energy loss occurs, lowering the efficiency in recovering energy. In contrast, the balance weights 152*a* and 152*b* each have the shape axially symmetrical with respect to the rotation axis of the shaft 12 in the present embodiment. Accordingly, the refrigeration oil in the closed casing 111 is not stirred so much even when the balance weights 152*a* and 152*b* rotate. This suppresses the energy loss caused by the rotation of the balance weights 152*a* and 152*b*. As a result, energy is recovered highly efficiently.

It is preferable to form the communication hole 157 communicating with the internal space 154 so that the refrigeration oil is introduced into the internal space 154, when weight variation is created around the rotation axis of the shaft 12 by forming the internal space 154 of an arc shape viewed in plane around the central axis of the shaft 12 in a cylindrical main body of each of the balance weights 152*a* and 152*b*, as in the present embodiment.

From the viewpoint of reducing the quantity of the balance weight 152, the direction in which the first piston 21 is off-centered with respect to the central axis of the first cylinder 22 may be different from the direction in which the second piston 41 is off-centered with respect to the central axis of the second cylinder 42. For example, the direction in which the first piston 21 is off-centered with respect to the central axis of the first cylinder 22 may be 180° away from the direction in which the second piston 41 is off-centered with respect to the central axis of the second cylinder 42.

In the fluid machine 110 and the compression mechanism 103*a* in which the shaft 12 rotates at high speed, the refrigeration oil is supplied to sliding parts in order to suppress wearing of the sliding parts. In the present embodiment, the interior of the closed casing 111 of the fluid machine 110 is filled with the refrigeration oil. The refrigeration oil infiltrates into each of the sliding parts to lubricate them. Accordingly, the refrigeration oil can be supplied to each of the sliding parts in a reliable manner. Methods for supplying the refrigeration oil include supplying the refrigeration oil to the sliding parts of the compression mechanism 103*a* using a fluid pump, as in the compressor 103. In this case, however, a sufficient amount of the refrigeration oil may not be supplied reliably to each of the sliding parts when the fluid pump has a failure or an oil level of the refrigeration oil is lowered. In contrast, when the interior of the closed casing 111 is filled with the refrigeration oil and the power recovery means 105 and the supercharger 102 are immersed in the refrigeration oil directly as in the present invention, a sufficient amount of the refrigeration oil can be supplied reliably to each of the sliding parts.

In the case of the compression mechanism 103*a* to which the motor 108 is attached, it is not preferable to fill the casing 160 with the refrigeration oil. This is because the motor 108 shorts out when the refrigeration oil does not have sufficient insulating properties. On the other hand, problems such as shorting out does not occur in the closed casing 111 because no electronic parts are accommodated therein.

Furthermore, in the present embodiment, the compressor 103 in which a relatively large amount of the refrigeration oil is held is disposed higher than the fluid machine 110. The oil equalizing pipe 163 is provided that allows the oil reservoir 161 of the compressor 103 to communicate with the interior of the closed casing 111. Thereby, when the amount of the refrigeration oil in the closed casing 111 is reduced, the refrigeration oil automatically is supplied from the oil reservoir 161 of the compressor 103 to the closed casing 111 via the oil equalizing pipe 163. The refrigeration oil supplied to the power recovery means 105 and the supercharger 102 returns to the oil reservoir 161 of the compressor 103 via refrigerant pipes of the refrigerant circuit 109. This makes it possible to maintain the amount of the refrigeration oil held in the oil reservoir 161 of the compressor 103 substantially fixed.

The throttle mechanism 164 is attached to the oil equalizing pipe 163. The throttle mechanism 164 makes it possible to adjust an amount of the refrigeration oil flowing to the closed casing 111, and the pressure in the closed casing 111.

Since the refrigerant whose pressure has been somewhat increased in the supercharger 102 has a relatively low temperature, heat exchange hardly occurs between the supercharger 102 and the power recovery means 105 in the fluid machine 110 of FIG. 15. The quantity of the heat exchange is smaller than that observed in the configuration (the configuration of Embodiment 1) in which the power recovery means 105 is connected to the compression mechanism 103*a*. Therefore, the configuration in which the power recovery means 105 is connected to the supercharger 102 is more advantageous than that of Embodiment 1 from the viewpoint of suppressing heat transfer from a mechanism whose temperature is high during operation to a mechanism whose temperature is low during operation, and enhancing the energy efficiency.

In the present embodiment, the power recovery means 105 and the supercharger 102 are accommodated in the closed casing 111. Thereby, the power recovery means 105 and the supercharger 102 are arranged compactly, making the refrigeration cycle apparatus 101 compact. Moreover, since the first closing member 115 is used commonly between the supercharger 102 and the power recovery means 105 in the present embodiment, the refrigeration cycle apparatus 101 is made particularly compact. Furthermore, both of the suction passage 27 and the discharge passage 30 are formed in the second closing member 113 in the present embodiment. On the other hand, the suction passage 47 and the discharge passage 50 are formed in the third closing member 114. It is possible to make the first closing member 115 thin by forming the suction passage 27 (47) and the discharge passage 30 (50) in the closing member on the same side, and the fluid machine 110 is made further compact. When any one of the suction passage 27, the discharge passage 30, the suction passage 47 and the discharge passage 50 is formed in the first closing member 115, for example, the first closing member 115 needs to be thicker accordingly. As a result, the fluid machine 110 is enlarged. From the viewpoint of making the fluid machine 110 compact, all of the suction passage 27, the discharge passages 30, the suction passages 47, and the discharge passages 50 may be formed in the first closing member 115.

The pushing means 45 that presses the second partition member 44 is a small spring provided in the narrow back space 155. The pushing force of the pushing means 45 may be insufficient depending on the operating conditions. When the pushing force of the pushing means 45 is insufficient, the suction working chamber 43*a* is brought into communication with the discharge working chamber 43*b*, causing the direct flow of the refrigerant. As a result, the energy recovery efficiency is lowered. Therefore, it is preferable to set the pressure in the back space 155 higher than that in the second working chamber 43, and to maintain a pressure with which the second partition member 44 presses the second piston 41 higher than the pressure in the second working chamber 43.

On the other hand, as the pressure with which the second partition member 44 presses the second piston 41 becomes higher, sliding friction between the second partition member 44 and the second piston 41 also increases. As a result, the second partition member 44 and the second piston 41 wear seriously. Therefore, it is preferable that the pressure with which the second partition member 44 presses the second piston 41 is as low as possible in a range that still is higher than the pressure in the second working chamber 43, In the present embodiment, the connecting passage 156, which allows the back space 155 to communicate with the relatively high pressure discharge passage 50, is formed in the cylinder 42. Accordingly, the pressure in the back space 155 is equal to the pressure in the discharge passage 50. The back space 155 serves as so called a gas spring, allowing the pressure with which the second partition member 44 presses the second piston 41 to be higher than the pressure in the second working chamber 43 all the time. As a result, the direct flow of the refrigerant is suppressed, and the energy efficiency of the refrigeration cycle apparatus 101 can be enhanced further.

Since the supercharger 102 is a fluid pressure motor, a pressure difference between the suction working chamber 43*a* and the discharge working chamber 43*b* is not so large. Accordingly, the pressure in the back space 155 is not so high. This prevents an excessive pressure from being applied between the second partition member 44 and the second piston 41, and suppresses wearing of the second partition member 44 and the second piston 41. From the viewpoint of suppressing particularly effectively the wearing of the second partition member 44 and the second piston 41, the pressure in the back space 155 preferably is lower than the pressure in the closed casing 111.

A force for pushing the second partition member 44 toward the second piston 41 is needed most when the second partition member 44 is most distanced from the central axis of the shaft 12. That is, when the second piston 41 is located at the top dead center and moving direction of the second partition member 44 changes. This is because although the second partition member 44 is pressed by the second piston 41 until the second piston 41 reaches the top dead center, a position on the peripheral surface of the second piston 41 at which the second partition member 44 is in contact approaches the central axis of the shaft 12 after the second piston 41 reaches the top dead center, and the pressure between the second piston 41 and the second partition member 44 tends to decrease after the second piston 41 passes the top dead center.

On the other hand, when the second partition member 44 approaches the central axis of the shaft 12 most closely, that is, when the second piston 41 is located at a bottom dead center thereof, such a large pushing force is not necessary for the second partition member 44. This is because the second partition member 44 starts to be pressed by the second piston 41 when the second piston 41 reaches the bottom dead center.

Thus, it is preferable that the connecting passage 156 is formed in such a manner that the connecting passage 156 is closed by the second partition member 44 when the second partition member 44 slides in the direction that reduces the volume of the back space 155. That is, it is preferable that the back space 155 turns into a closed space and the gas spring, so to speak, is formed when the second partition member 44 slides in the direction that reduces the volume of the back space 155. Thereby, the second partition member 44 is pushed toward the second piston 41 by work of the gas spring when the second piston 41 is located at the top dead center, that is, when the force for pushing the second partition member 44 toward the second piston 41 is needed most. Accordingly, the pressure between the second partition member 44 and the second piston 41 can be maintained relatively high even when the second piston 41 is located at the top dead center. As a result, the direct flow of the refrigerant from the suction working chamber 43*a* to the discharge working chamber 43*b* can be suppressed effectively.

Modified Example 1

Figure 25:
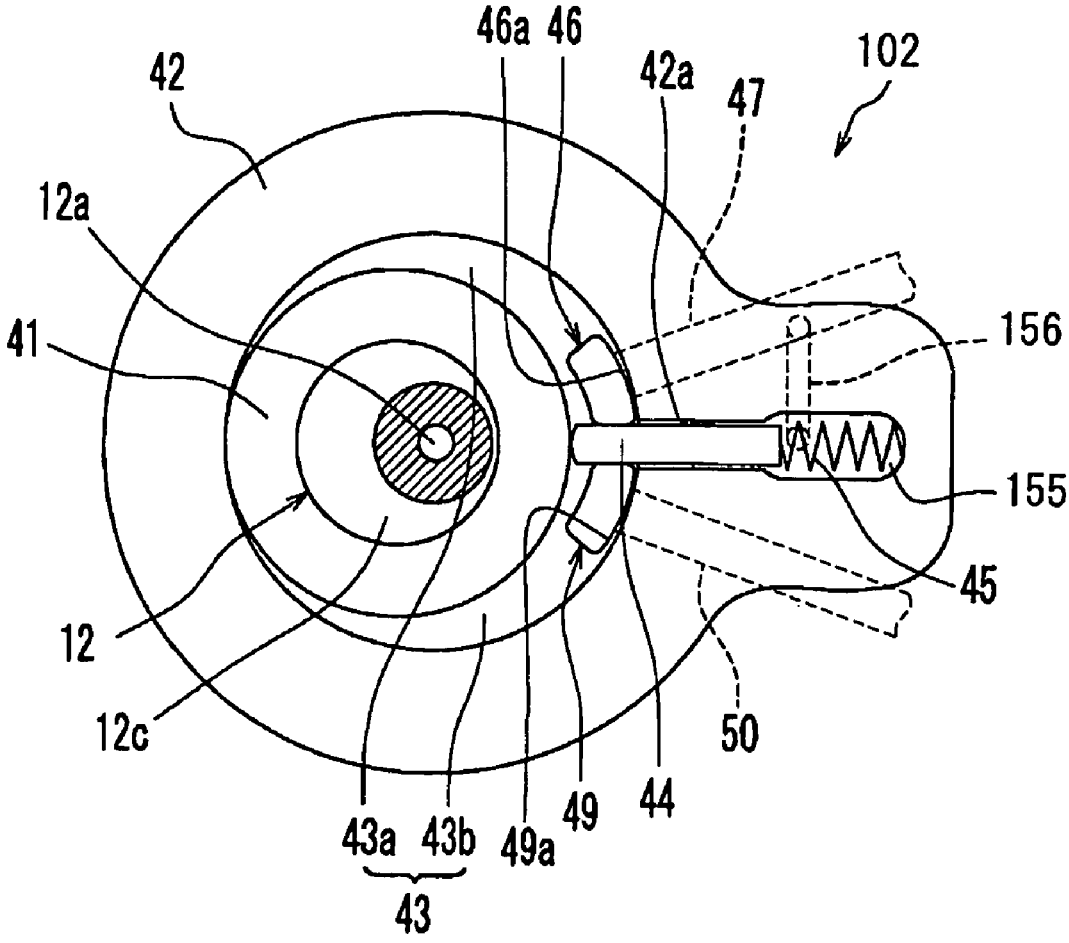
FIG. 25 is a cross-sectional view of the supercharger according to Modified Example 1.
Figure 26:
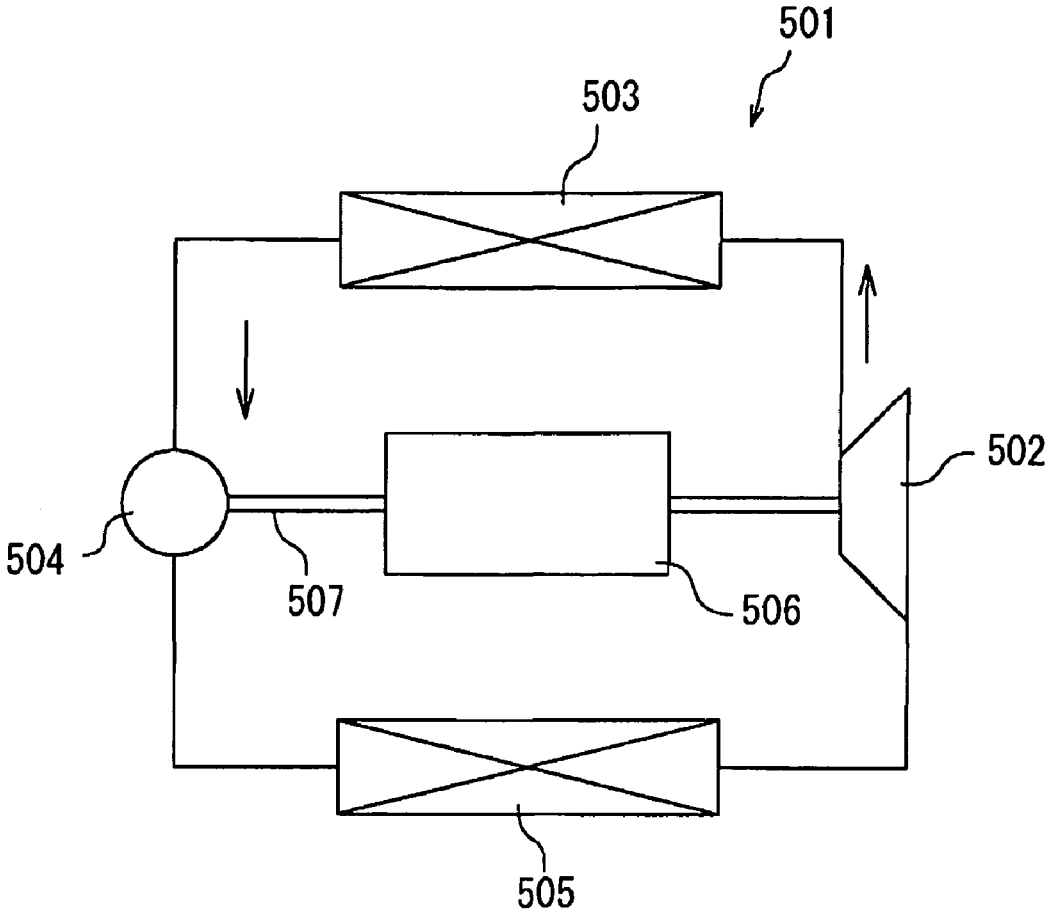
FIG. 26 is a configuration diagram of a conventional refrigeration cycle apparatus.
Figure 27:
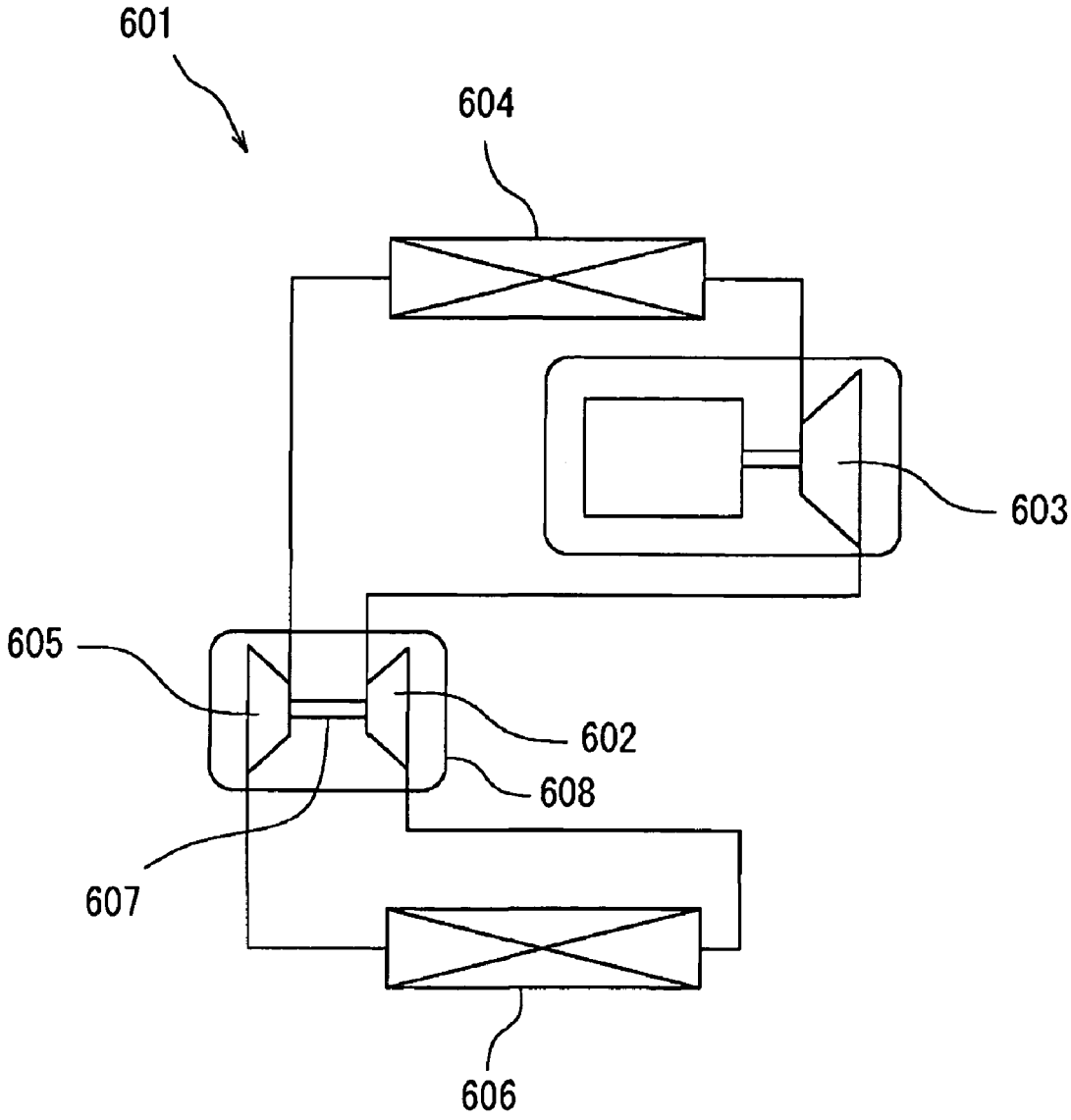
FIG. 27 is a configuration diagram of a power-recovery-type refrigeration cycle apparatus using the conventional expander-compressor unit shown in FIG. 26.
Figure 28:
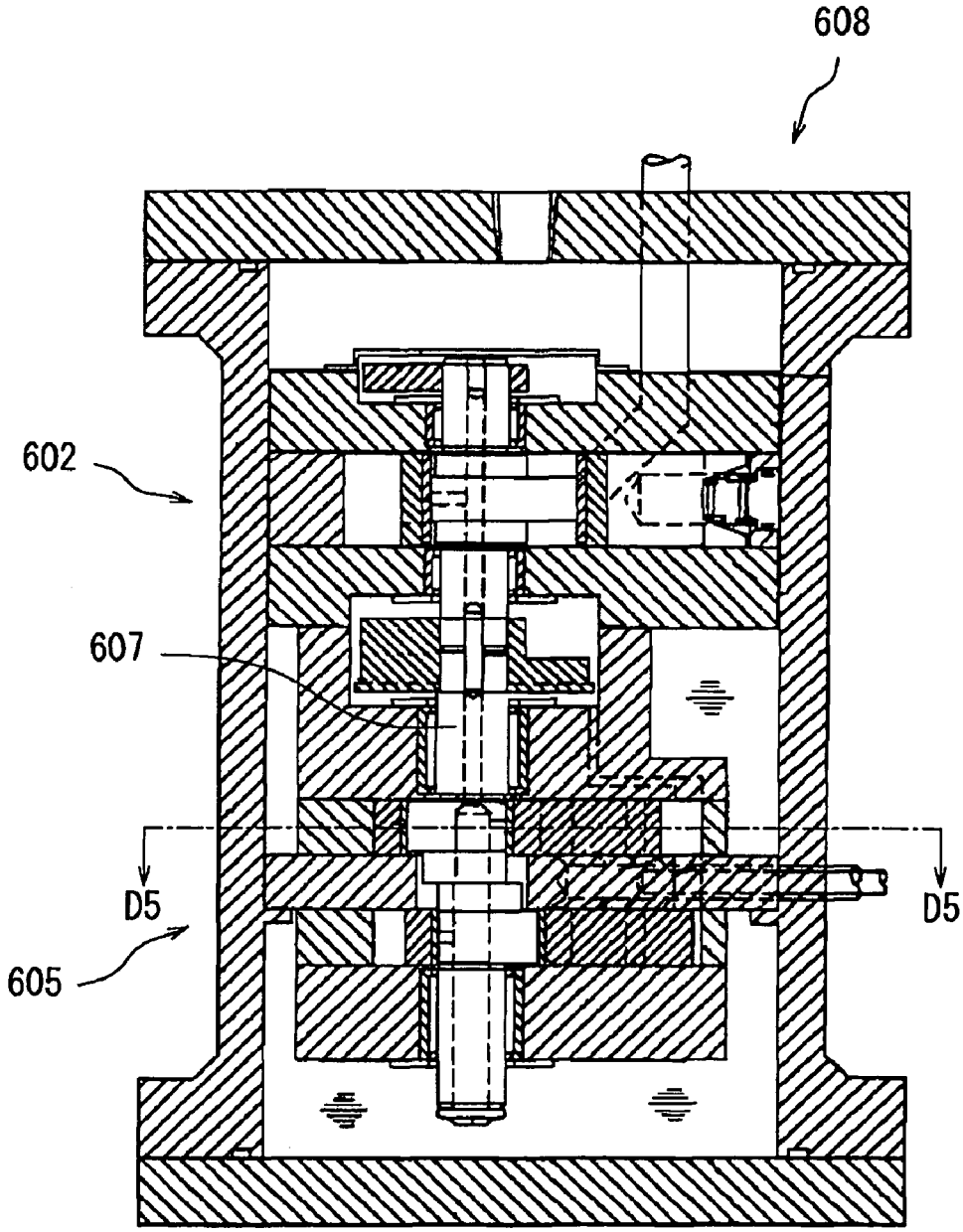
FIG. 28 is a vertical cross-sectional view of the conventional expander-compressor unit.
Figure 29:
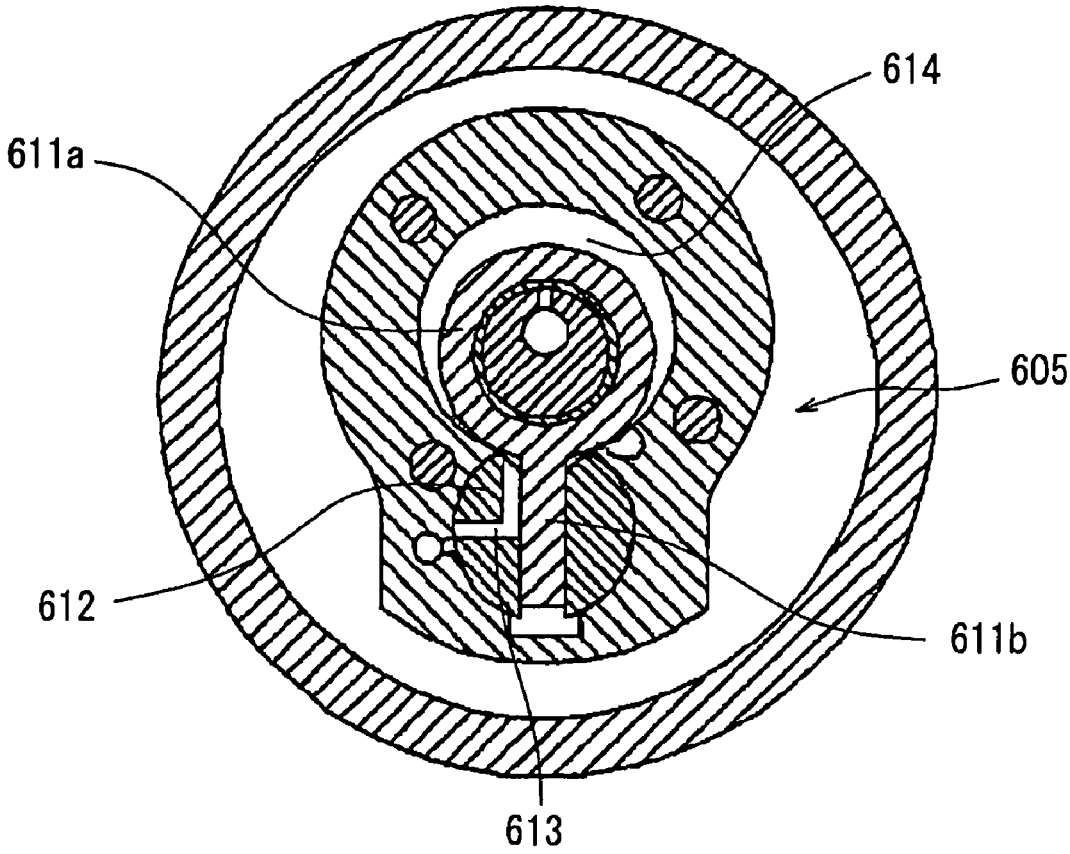
FIG. 29 is a fragmentary view taken along line D5-D5 in FIG. 28.

The aforementioned embodiment describes an example in which the back space 155 is in communication with the discharge passage 50 by the connecting passage 156. However, as shown in FIG. 25, the suction passage 47 may be in communication with the back space 155 by the connecting passage 156, depending on the pushing force of the pushing means 45.

In the present modified example, since the back space 155 is in communication with the relatively low pressure suction passage 47, the pressure in the back space 155 is lower than that in the aforementioned embodiment. Thereby, the pressure between the second partition member 44 and the second piston 41 (a load imposed at a point of contact therebetween) when the second piston 41 is located at the bottom dead center is further smaller than that in the aforementioned embodiment. Therefore, in Modified Example 1, it particularly is preferable that in order to achieve the effect of the gas spring reliably, the connecting passage 156 is formed in such a manner that the connecting passage 156 is closed by the second partition member 44 when the second partition member 44 slides in the direction that reduces the volume of the back space 155.

Modified Example 2

The back space 155 may be in communication with the interior of the closed casing 111 so as to have the same pressure as that in the closed casing 111. The pressure in the closed casing 111 and the pressure in the back space 155 may be adjusted by using the throttle mechanism 164 shown in FIG. 21. In this case, from the view point of suppressing the direct flow of the refrigerant from the high pressure side to the low pressure side in the supercharger 102, as well as suppressing excessive wearing of the second partition member 44 and the second piston 41, the pressure in the closed casing 111 and the pressure in the back space 155 preferably fall between the pressure on the high pressure side and the pressure on the low pressure side of the refrigerant circuit 109.

Modified Example 3

The back space 155 may be a closed space. In this case, the pressure in the back space 155 is preferably higher than that in the second working chamber 43. The pressure in the back space 155 is preferably lower than that in the closed casing 111.

Modified Example 4

From the viewpoint of reducing the quantity of the balance weight 152, the direction in which the first piston 21 is off-centered with respect to the central axis of the first cylinder 22 may be different from the direction in which the second piston 41 is off-centered with respect to the central axis of the second cylinder 42. Particularly, it is preferable that the direction in which the first piston 21 is off-centered with respect to the central axis of the first cylinder 22 may be 180° away from the direction in which the second piston 41 is off-centered with respect to the central axis of the second cylinder 42, from the viewpoint of reducing the quantity of the balance weight 152.

Moreover, the power recovery means 105 and the supercharger 102 start easily when the refrigeration cycle apparatus 101 starts, by allowing the direction in which the first piston 21 is off-centered with respect to the central axis of the first cylinder 22 to be different from the direction in which the second piston 41 is off-centered with respect to the central axis of the second cylinder 42.

The pressure in the entire refrigerant circuit 109 is uniform when the refrigeration cycle apparatus 101 stops. When the compressor 103 starts, a pressure on a suction side of the compressor 103, that is, a pressure in a pipe between the compressor 103 and the supercharger 102, decreases. On the other hand, a pressure on a discharge side of the compressor 103, that is, a pressure in a pipe between the compressor 103 and the power recovery means 105, increases. Accordingly, starting torque is generated at both of the supercharger 102 and the power recovery means 105 by the pressure difference between the suction side of the compressor 103 and the discharge side of the compressor 103. The starting torque allows the supercharger 102 and the power recovery means 105 to start their autonomous rotations.

For example, when the direction in which the first piston 21 is off-centered with respect to the central axis of the first cylinder 22 is the same as the direction in which the second piston 41 is off-centered with respect to the central axis of the second cylinder 42, there possibly arises the case where both of the first piston 21 of the power recovery means 105 and the second piston 41 of the supercharger 102 are located at the top dead centers, respectively (that is, $\theta=0°$) when the refrigeration cycle apparatus 101 stops. In this case, the starting torques of the power recovery means 105 and the supercharger 102 become small, possibly making it difficult for them to start.

On the other hand, when the direction in which the first piston 21 is off-centered with respect to the central axis of the first cylinder 22 is different from the direction in which the second piston 41 is off-centered with respect to the central axis of the second cylinder 42, there is no possibility that both of the starting torques are equal to zero simultaneously because they each have a different phase. This allows the power recovery means 105 and the supercharger 102 to start more easily when the refrigeration cycle apparatus 101 starts.

It particularly is preferable that the direction in which the first piston 21 is off-centered with respect to the central axis of the first cylinder 22 is 180° away from the direction in which the second piston 41 is off-centered with respect to the central axis of the second cylinder 42. In this case, when one of the starting torques is equal to zero, the other is maximized. This allows the power recovery means 105 and the supercharger 102 to start particularly easily.

Additional Modified Example

From the viewpoint of making the fluid machine 110 compact, all of the suction passage 27, the discharge passages 30, the suction passages 47, and the discharge passages 50 may be formed in the first closing member 115.

The refrigerant circuit 9 may be filled with the refrigerant that does not reach the supercritical state on the high pressure side. Specifically, the refrigerant circuit 109 may be filled with the fluorocarbon refrigerant, for example.

Besides the balance weights 152*a* and 152*b*, an additional one or a plurality of balance weights may be attached to the shaft 12.

Although description is made with respect to an example in which the refrigerant circuit 9 is composed of the compressor 103, the gas cooler 104, the power recovery means 105, the evaporator 106, and the supercharger 102, the refrigerant circuit 9 further may include components other than these components (for example, a gas-liquid separator and an oil separator).

Although the aforementioned embodiment describes an example in which the power recovery means 105 is connected directly to the supercharger 102 by the shaft 12, the present invention is not limited to this configuration. For example, it may be a configuration in which the electric generator is connected to the power recovery means 105 while the motor is connected to the supercharger 102, and the motor driving the supercharger 102 is driven by electric power obtained by the electric generator.

INDUSTRIAL APPLICABILITY

The present invention is useful for refrigeration cycle apparatuses, such as water heaters and cooling/heating air conditioners.

The invention claimed is:

1. A refrigeration cycle apparatus comprising a refrigerant circuit in which a refrigerant circulates, the refrigerant circuit including:

a compressor for compressing the refrigerant;

a radiator for allowing the refrigerant compressed by the compressor to radiate heat;

a power recovery means for performing a suction process for drawing the refrigerant coming from the radiator and a discharge process for discharging the drawn refrigerant, the suction process and the discharge process being performed substantially continuously; and an evaporator for allowing the refrigerant discharged by the power recovery means to evaporate, wherein:

the refrigerant is carbon dioxide;

the power recovery means includes: a cylinder with both ends closed by a first closing member and a second closing member, the cylinder having an inner peripheral face; a rotatable shaft penetrating through the cylinder in an axial direction thereof; a cylindrical piston supported axially by the shaft in the cylinder while being off-centered with respect to a central axis of the cylinder, the piston forming a working chamber between itself and the inner peripheral face of the cylinder; a partition member for partitioning the working chamber into a high pressure side and a low pressure side; a suction passage that is opened and closed as the piston rotates, and is brought into communication with the high pressure side working chamber; and a discharge passage that is opened and closed as the piston rotates, and is brought into communication with the low-pressure side working chamber;

the suction passage is formed in the first closing member or the second closing member, and the discharge passage is formed in the first closing member or the second closing member;

the suction passage and the discharge passage are closed by the piston only at a moment when the piston is located at a top dead center thereof;

the suction passage opens to a portion of the high pressure side working chamber adjacent to the partition member, and an opening of the suction passage to the working chamber is formed in such a manner that an outer edge of the opening is in an arc shape along an outer peripheral face of the piston when the piston is located at the top dead center thereof; and the discharge passage opens to a portion of the low pressure side working chamber adjacent to the partition member, and an opening of the discharge passage to the working chamber is formed in such a manner that an outer edge of the opening is in an arc shape along the outer peripheral face of the piston when the piston is located at the top dead center thereof.

2. The refrigeration cycle apparatus according to claim 1, wherein an opening area of the discharge passage to the working chamber is larger than an opening area of the suction passage to the working chamber.

3. The refrigeration cycle apparatus according to claim 1, wherein the discharge passage has a bore diameter larger than that of the suction passage.

4. The refrigeration cycle apparatus according to claim 1, wherein at least a part of the refrigerant discharged from the power recovery means is in a gaseous phase.

5. The refrigeration cycle apparatus according to claim 1, wherein the suction passage opens to the portion of the high pressure side working chamber adjacent to the partition member, and an opening portion of the suction passage to the working chamber is formed inclined with respect to the axial direction of the cylinder in such a manner that the opening portion extends in a direction in which the high pressure side working chamber stretches.

6. The refrigeration cycle apparatus according to claim 1, wherein the discharge passage opens to the portion of the low pressure side working chamber adjacent to the partition member, and an opening portion of the discharge passage to the working chamber is formed inclined with respect to the axial direction of the cylinder in such a manner that the opening portion extends in a direction in which the low pressure side working chamber stretches.

7. The refrigeration cycle apparatus according to claim 1, wherein one of the suction passage and the discharge passage is formed in the first closing member, and the other is formed in the second closing member.

8. The refrigeration cycle apparatus according to claim 1, wherein the power recovery means further includes:

an additional one or a plurality of cylinders with both ends closed, the additional one or the plurality of cylinders having an inner peripheral face and being positioned in such a manner that the shaft penetrates a central axis thereof;

an additional tubular piston supported axially by the shaft in the additional cylinder while being off-centered with respect to a central axis of the additional cylinder, the additional piston forming an additional working chamber between itself and the inner peripheral face of the additional cylinder;

an additional partition member for partitioning the additional working chamber into a high pressure side and a low pressure side;

an additional suction passage that is opened and closed as the additional piston rotates, and is brought into communication with the additional high pressure side working chamber; and an additional discharge passage that is opened and closed as the additional piston rotates, and is brought into communication with the additional low pressure side working chamber.

9. The refrigeration cycle apparatus according to claim 8, wherein the plurality of pistons are disposed in such a manner that a top dead center of each of the pistons is located at a constant interval in a rotational direction of the shaft.

10. The refrigeration cycle apparatus according to claim 1, wherein the compressor is a rotary type or a scroll type compressor that has a compressor shaft and performs a rotating operation around the compressor shaft, and the compressor shaft is coupled to the shaft of the power recovery means.

11. The refrigeration cycle apparatus according to claim 1, wherein the suction passage is located closer to the compressor than the discharge passage is.

12. The refrigeration cycle apparatus according to claim 1, further comprising an electric generator that is coupled to the shaft and generates electricity by rotation of the shaft.

13. The refrigeration cycle apparatus according to claim 1, further comprising:

a first heat exchanger and a second heat exchanger that are disposed in the refrigerant circuit and connected to the power recovery means, respectively; and a switching mechanism capable of switching states between a first connection state and a second connection state, the first connection state being a state in which the discharge port of the compressor is connected to the first heat exchanger while the suction port of the compressor is connected to the second heat exchanger, the second connection state being a state in which the discharge port of the compressor is connected to the second heat exchanger while the suction port of the compressor is connected to the first heat exchanger, wherein the first heat exchanger functions as the radiator and the second heat exchanger functions as the evaporator in the first connection state, and the first heat exchanger functions as the evaporator and the second heat exchanger functions as the radiator in the second connection state.

14. The refrigeration cycle apparatus according to claim 1, wherein the refrigerant circuit further includes a supercharger that is driven by mechanical power recovered by the power recovery means, and performs a process for drawing the refrigerant coming from the evaporator and a process for discharging the drawn refrigerant to a side of the compressor, the processes being performed substantially continuously.

15. The refrigeration cycle apparatus according to claim 14, further comprising a closed casing for accommodating the power recovery means and the supercharger.

16. The refrigeration cycle apparatus according to claim 15, wherein the closed casing is filled with an refrigeration oil.

17. The refrigeration cycle apparatus according to claim 15, wherein:

the compressor includes a compressor main body that compresses the refrigerant and then discharges it, and a casing that accommodates the compressor main body and has an internal space into which the compressed refrigerant is discharged from the compressor main body;

an oil reservoir in which an refrigeration oil for lubricating the compressor main body is held is formed at a lower part of the internal space; and an oil pipe that allows the oil reservoir to communicate with an interior of the closed casing is provided in the refrigeration cycle apparatus.

18. The refrigeration cycle apparatus according to claim 17, further comprising a throttle mechanism attached to the oil pipe.

19. The refrigeration cycle apparatus according to claim 17, wherein an internal pressure of the closed casing is lower than a pressure on a high pressure side of the refrigerant circuit, and is higher than a pressure on a low pressure side of the refrigerant circuit.

20. The refrigeration cycle apparatus according to claim 14, further comprising:

a first closing member;

a second closing member facing the first closing member;

a first cylinder with both ends closed by the first closing member and the second closing member, the first cylinder having an inner peripheral face;

a third closing member facing the first closing member;

a second cylinder with both ends closed by the first closing member and the third closing member, the second cylinder having an central axis common with a central axis of the first cylinder, and an inner peripheral face;

a rotatable shaft that is disposed on the central axis of the first cylinder and the second cylinder and penetrates through the first cylinder and the second cylinder;

a first piston that is tubular, and supported axially by the shaft in the first cylinder while being off-centered with respect to the central axis of the first cylinder, the first piston forming a first working chamber with a substantially invariable volumetric capacity between itself and the inner peripheral face of the first cylinder;

a first partition member for partitioning the first working chamber into a high pressure side and a low pressure side;

a first suction passage that is opened and closed as the first piston rotates, and is brought into communication with the high pressure portion of the first working chamber;

a first discharge passage that is opened and closed as the first piston rotates, and is brought into communication with the low pressure portion of the first working chamber;

a second piston that is tubular, and supported axially by the shaft in the second cylinder while being off-centered with respect to the central axis of the second cylinder, the second piston forming a second working chamber with a substantially invariable volumetric capacity between itself and the inner peripheral face of the second cylinder;

a second partition member for partitioning the second working chamber into a high pressure side and a low pressure side;

a second suction passage that is opened and closed as the second piston rotates, and is brought into communication with the low pressure portion of the second working chamber; and a second discharge passage that is opened and closed as the second piston rotates, and is brought into communication with the high pressure portion of the second working chamber;

wherein the power recovery means is composed of the first closing member, the second closing member, the first cylinder, the first piston, the first partition member, the first suction passage, and the first discharge passage; and the supercharger is composed of the first closing member, the third closing member, the second cylinder, the second piston, the second partition member, the second suction passage, and the second discharge passage.

21. The refrigeration cycle apparatus according to claim 20, wherein both of the first suction passage and the first discharge passage are formed in the second closing member.

22. The refrigeration cycle apparatus according to claim 20, wherein at least one of the first suction passage and the first discharge passage is closed by the first piston only at a moment when the first piston is located at a top dead center thereof.

23. The refrigeration cycle apparatus according to claim 20, wherein both of the second suction passage and the second discharge passage are formed in the third closing member.

24. The refrigeration cycle apparatus according to claim 20, wherein at least one of the second suction passage and the second discharge passage is closed by the second piston only at a moment when the second piston is located at a top dead center thereof.

25. The refrigeration cycle apparatus according to claim 20, wherein a timing at which the first piston is located at the top dead center is substantially the same as a timing at which the second piston is located at the top dead center.

26. The refrigeration cycle apparatus according to claim 20, wherein a direction in which the first piston is off-centered with respect to the central axis of the first cylinder is substantially the same as a direction in which the second piston is off-centered with respect to the central axis of the second cylinder.

27. The refrigeration cycle apparatus according to claim 20, further comprising balance weights that are disposed at each end of the shaft respectively and reduce unevenness in weight of a rotating body including the shaft, the first piston, and the second piston, around a rotation axis of the shaft.

28. The refrigeration cycle apparatus according to claim 27, wherein each of the balance weights has an axially symmetric shape with respect to the rotation axis of the shaft.

29. The refrigeration cycle apparatus according to claim 20, wherein:

the compressor includes a compressor main body that compresses the refrigerant and then discharges it, and a casing that accommodates the compressor main body and has an internal space into which the compressed refrigerant is discharged from the compressor main body;

the internal space is in communication with the closed casing;

the second cylinder has a groove in which the second partition member is disposed slidably; and a pressure in a back space formed by the groove and the second partition member is lower than a pressure in the closed casing.

30. The refrigeration cycle apparatus according to claim 20, wherein:

the second cylinder has a groove in which the second partition member is disposed slidably; and a pressure in a back space formed by the groove and the second partition member is higher than a pressure in the second working chamber.

31. The refrigeration cycle apparatus according to claim 20, wherein:

the second cylinder has a groove in which the second partition member is disposed slidably; and a back space formed by the groove and the second partition member is a closed space.

32. The refrigeration cycle apparatus according to claim 20, wherein:

the second cylinder has a groove in which the second partition member is disposed slidably; and a communication pipe is provided in the refrigeration cycle apparatus, the communication pipe allowing a back space formed by the groove and the second partition member to communicate with the second suction passage or the second discharge passage.

33. The refrigeration cycle apparatus according to claim 32, wherein:

the communication pipe is a pipe that allows the back space formed by the groove and the second partition member to communicate with the second suction passage; and the second partition member closes the communication hole when the second partition member slides in a direction in which a volume of the back space is reduced.

* * * * *